US008491313B2

(12) United States Patent
McNamara et al.

(10) Patent No.: US 8,491,313 B2
(45) Date of Patent: Jul. 23, 2013

(54) MEZZANINE CONNECTOR

(75) Inventors: David M. McNamara, Amherst, NH (US); Brian Kirk, Amherst, NH (US)

(73) Assignee: Amphenol Corporation, Wallingford Center, CT (US)

( * ) Notice: Subject to any disclaimer, the term of this patent is extended or adjusted under 35 U.S.C. 154(b) by 0 days.

(21) Appl. No.: 13/365,197

(22) Filed: Feb. 2, 2012

(65) Prior Publication Data

US 2012/0202386 A1 Aug. 9, 2012

Related U.S. Application Data

(60) Provisional application No. 61/438,956, filed on Feb. 2, 2011, provisional application No. 61/473,565, filed on Apr. 8, 2011.

(51) Int. Cl.
*H01R 23/7068* (2006.01)

(52) U.S. Cl.
USPC ..... 439/59

(58) Field of Classification Search
USPC ..... 439/59, 218, 61, 502, 631
See application file for complete search history.

(56) References Cited

U.S. PATENT DOCUMENTS

| | | | |
|---|---|---|---|
| 3,322,885 | A | 5/1967 | May et al. |
| 3,786,372 | A | 1/1974 | Epis et al. |
| 3,825,874 | A | 7/1974 | Peverill |
| 4,175,821 | A | 11/1979 | Hunter |
| 4,195,272 | A | 3/1980 | Boutros |
| 4,276,523 | A | 6/1981 | Boutros et al. |
| 4,457,576 | A | 7/1984 | Cosmos et al. |
| 4,472,765 | A | 9/1984 | Hughes |
| 4,518,651 | A | 5/1985 | Wolfe, Jr. |
| 4,519,664 | A | 5/1985 | Tillotson |
| 4,519,665 | A | 5/1985 | Althouse et al. |

(Continued)

FOREIGN PATENT DOCUMENTS

| | | |
|---|---|---|
| CN | 1398446 | 2/2003 |
| DE | 102006044479 A1 | 5/2007 |

(Continued)

OTHER PUBLICATIONS

PCT Search Report and Written Opinion for Application No. PCT/US2012/023689 mailed on Sep. 12, 2012.

(Continued)

*Primary Examiner* — Tulsidas C Patel
*Assistant Examiner* — Phuongchi T Nguyen
(74) *Attorney, Agent, or Firm* — Wolf, Greenfield & Sacks, P.C.

(57) ABSTRACT

A two-piece mezzanine connector for high speed, high density signals. One piece of the connector may have conductive elements with beam-shaped mating contacts. The beams may include openings to control mechanical properties while allowing edge to edge spacing between adjacent beams to be selected to provide desired electrical properties. The openings may be teardrop shaped, with a larger width at a distal end of the beams. Beams associated with signal conductors may have openings that are shaped differently from openings of beams associated with ground conductors. For a first connector piece, mating contact regions of signal conductors may be wider than mating contact regions of ground conductors. For a second connector piece adapted to mate with the first connector piece, mating contact regions of signal conductors may be narrower than mating contact regions of ground conductors. These contact shapes may provide float while maintaining a high contact density.

36 Claims, 35 Drawing Sheets

U.S. PATENT DOCUMENTS 4,607,907 A 8/1986 Bogursky
4,655,518 A 4/1987 Johnson et al.
4,674,812 A 6/1987 Thom et al.
4,682,129 A 7/1987 Bakermans et al.
4,686,607 A 8/1987 Johnson
4,728,762 A 3/1988 Roth et al.
4,751,479 A 6/1988 Parr
4,761,147 A 8/1988 Gauthier
4,836,791 A 6/1989 Grabbe et al.
4,846,724 A 7/1989 Sasaki et al.
4,846,727 A 7/1989 Glover et al.
4,871,316 A 10/1989 Herrell et al.
4,876,630 A 10/1989 Dara
4,889,500 A 12/1989 Lazar et al.
4,902,243 A 2/1990 Davis
4,992,060 A 2/1991 Meyer
5,000,700 A 3/1991 Masubuchi et al.
5,246,388 A 9/1993 Collins et al.
5,259,773 A 11/1993 Champion et al.
5,335,146 A 8/1994 Stucke
5,346,410 A 9/1994 Moore, Jr.
5,352,123 A 10/1994 Sample et al.
5,429,520 A 7/1995 Morlion et al.
5,429,521 A 7/1995 Morlion et al.
5,456,619 A 10/1995 Belopolsky et al.
5,551,893 A 9/1996 Johnson
5,562,497 A 10/1996 Yagi et al.
5,605,469 A 2/1997 Wellinsky et al.
5,755,597 A 5/1998 Panis et al.
5,761,050 A * 6/1998 Archer ..... 361/791
5,795,191 A 8/1998 Preputnick et al.
5,831,491 A 11/1998 Buer et al.
5,870,528 A 2/1999 Fukuda
5,887,158 A 3/1999 Sample et al.
5,924,899 A 7/1999 Paagman
5,931,686 A 8/1999 Sasaki et al.
5,959,591 A 9/1999 Aurand
5,971,809 A 10/1999 Ho
5,980,321 A 11/1999 Cohen et al.
5,993,259 A 11/1999 Stokoe et al.
6,083,047 A 7/2000 Paagman
6,102,747 A 8/2000 Paagman
6,132,255 A 10/2000 Verhoeven
6,146,202 A 11/2000 Ramey et al.
6,152,747 A 11/2000 McNamara
6,163,464 A 12/2000 Ishibashi et al.
6,171,115 B1 1/2001 Mickievicz et al.
6,174,202 B1 1/2001 Mitra
6,174,203 B1 1/2001 Asao
6,174,944 B1 1/2001 Chiba et al.
6,217,372 B1 4/2001 Reed
6,238,245 B1 5/2001 Stokoe et al.
6,267,604 B1 7/2001 Mickievicz et al.
6,293,827 B1 9/2001 Stokoe
6,299,483 B1 10/2001 Cohen et al.
6,299,492 B1 10/2001 Pierini et al.
6,328,572 B1 12/2001 Higashida et al.
6,343,955 B2 2/2002 Billman et al.
6,343,957 B1 2/2002 Kuo et al.
6,350,134 B1 2/2002 Fogg et al.
6,364,711 B1 4/2002 Berg et al.
6,364,713 B1 4/2002 Kuo
6,379,188 B1 4/2002 Cohen et al.
6,380,485 B1 4/2002 Beaman et al.
6,392,142 B1 5/2002 Uzuka et al.
6,394,839 B2 5/2002 Reed
6,398,588 B1 6/2002 Bickford
6,409,543 B1 6/2002 Astbury, Jr. et al.
6,428,344 B1 8/2002 Reed
6,435,913 B1 8/2002 Billman
6,454,605 B1 9/2002 Bassler et al.
6,461,202 B2 10/2002 Kline
6,482,017 B1 11/2002 Van Doorn
6,503,103 B1 1/2003 Cohen et al.
6,506,076 B2 1/2003 Cohen et al.
6,517,360 B1 2/2003 Cohen
6,520,803 B1 2/2003 Dunn
6,527,587 B1 3/2003 Ortega et al.
6,528,737 B1 3/2003 Kwong et al.
6,538,899 B1 3/2003 Krishnamurthi et al.
6,540,522 B2 4/2003 Sipe
6,540,559 B1 4/2003 Kemmick et al.
6,541,712 B1 4/2003 Gately et al.
6,554,647 B1 4/2003 Cohen et al.
6,565,387 B2 5/2003 Cohen
6,579,116 B2 6/2003 Brennan et al.
6,592,381 B2 7/2003 Cohen et al.
6,602,095 B2 8/2003 Astbury, Jr. et al.
6,607,402 B2 8/2003 Cohen et al.
6,608,762 B2 8/2003 Patriche
6,609,933 B2 8/2003 Yamasaki
6,612,871 B1 9/2003 Givens
6,616,482 B2 9/2003 De La Cruz et al.
6,616,864 B1 9/2003 Jiang et al.
6,652,319 B1 11/2003 Billman
6,655,966 B2 12/2003 Rothermel et al.
6,663,427 B1 12/2003 Billman et al.
6,663,429 B1 12/2003 Korsunsky et al.
6,705,895 B2 3/2004 Hasircoglu
6,709,294 B1 3/2004 Cohen et al.
6,713,672 B1 3/2004 Stickney
6,717,825 B2 4/2004 Volstorf
6,722,897 B1 4/2004 Wu
6,743,057 B2 6/2004 Davis et al.
6,762,941 B2 7/2004 Roth
6,764,341 B2 7/2004 Lappoehn
6,776,645 B2 8/2004 Roth et al.
6,776,659 B1 8/2004 Stokoe et al.
6,786,771 B2 9/2004 Gailus
6,808,419 B1 10/2004 Korsunsky et al.
6,808,420 B2 10/2004 Whiteman et al.
6,816,486 B1 11/2004 Rogers
6,817,870 B1 11/2004 Kwong et al.
6,823,587 B2 11/2004 Reed
6,830,483 B1 12/2004 Wu
6,851,980 B2 * 2/2005 Nelson et al. ..... 439/607.05
6,857,899 B2 2/2005 Reed et al.
6,872,085 B1 3/2005 Cohen et al.
6,875,031 B1 4/2005 Korsunsky et al.
6,899,566 B2 5/2005 Kline et al.
6,903,939 B1 6/2005 Chea, Jr. et al.
6,913,490 B2 7/2005 Whiteman et al.
6,932,649 B1 8/2005 Rothermel et al.
6,957,967 B2 10/2005 Petersen et al.
6,960,103 B2 11/2005 Tokunaga
6,971,916 B2 12/2005 Tokunaga
6,979,202 B2 12/2005 Benham et al.
7,021,969 B2 4/2006 Matsunaga
7,044,794 B2 5/2006 Consoli et al.
7,057,570 B2 6/2006 Irion, II et al.
7,074,086 B2 7/2006 Cohen et al.
7,094,102 B2 8/2006 Cohen et al.
7,108,556 B2 9/2006 Cohen et al.
7,137,849 B2 11/2006 Nagata
7,163,421 B1 1/2007 Cohen et al.
7,182,643 B2 2/2007 Winings et al.
7,229,318 B2 6/2007 Winings et al.
7,270,573 B2 9/2007 Houtz
7,303,427 B2 12/2007 Swain
7,309,239 B2 12/2007 Shuey et al.
7,316,585 B2 1/2008 Smith et al.
7,322,855 B2 1/2008 Mongold et al.
7,335,063 B2 2/2008 Cohen et al.
7,347,721 B2 3/2008 Kameyama
7,351,114 B2 4/2008 Benham et al.
7,371,117 B2 5/2008 Gailus
7,390,218 B2 6/2008 Smith et al.
7,494,383 B2 2/2009 Cohen et al.
7,554,096 B2 6/2009 Ward et al.
7,581,990 B2 9/2009 Kirk et al.
7,588,464 B2 9/2009 Kim
7,588,467 B2 9/2009 Chang
7,594,826 B2 9/2009 Kobayashi et al.
7,699,663 B1 4/2010 Little et al.
7,722,401 B2 5/2010 Kirk et al.
7,753,731 B2 7/2010 Cohen et al.
7,771,233 B2 8/2010 Gailus

| | | | | |
|---|---|---|---|---|
| 7,794,240 | B2 | 9/2010 | Cohen et al. | |
| 7,806,704 | B2 * | 10/2010 | Miyoshi et al. | 439/108 |
| 7,906,730 | B2 | 3/2011 | Atkinson et al. | |
| 7,914,304 | B2 | 3/2011 | Cartier et al. | |
| 8,083,553 | B2 | 12/2011 | Manter et al. | |
| 8,215,968 | B2 | 7/2012 | Cartier et al. | |
| 8,371,875 | B2 | 2/2013 | Gailus | |
| 2001/0012730 | A1 | 8/2001 | Ramey et al. | |
| 2001/0042632 | A1 | 11/2001 | Manov et al. | |
| 2001/0046810 | A1 | 11/2001 | Cohen et al. | |
| 2002/0042223 | A1 | 4/2002 | Belopolsky et al. | |
| 2002/0086582 | A1 | 7/2002 | Nitta et al. | |
| 2002/0098738 | A1 | 7/2002 | Astbury, Jr. et al. | |
| 2002/0102885 | A1 | 8/2002 | Kline | |
| 2002/0111068 | A1 | 8/2002 | Cohen et al. | |
| 2002/0111069 | A1 | 8/2002 | Astbury, Jr. et al. | |
| 2002/0123266 | A1 | 9/2002 | Ramey et al. | |
| 2002/0168898 | A1 | 11/2002 | Billman et al. | |
| 2002/0181215 | A1 | 12/2002 | Guenthner | |
| 2002/0187688 | A1 | 12/2002 | Marvin et al. | |
| 2003/0003803 | A1 | 1/2003 | Billman et al. | |
| 2003/0008561 | A1 | 1/2003 | Lappoehn | |
| 2003/0022555 | A1 | 1/2003 | Vicich et al. | |
| 2003/0143894 | A1 | 7/2003 | Kline et al. | |
| 2003/0162441 | A1 * | 8/2003 | Nelson et al. | 439/608 |
| 2003/0220018 | A1 | 11/2003 | Winings et al. | |
| 2003/0220021 | A1 | 11/2003 | Whiteman et al. | |
| 2004/0043661 | A1 | 3/2004 | Okada et al. | |
| 2004/0072473 | A1 | 4/2004 | Wu | |
| 2004/0115968 | A1 | 6/2004 | Cohen | |
| 2004/0121652 | A1 | 6/2004 | Gailus | |
| 2004/0171305 | A1 | 9/2004 | McGowan et al. | |
| 2004/0196112 | A1 | 10/2004 | Welbon et al. | |
| 2004/0224559 | A1 | 11/2004 | Nelson et al. | |
| 2004/0235352 | A1 | 11/2004 | Takemasa | |
| 2004/0259419 | A1 | 12/2004 | Payne et al. | |
| 2005/0020135 | A1 | 1/2005 | Whiteman et al. | |
| 2005/0039331 | A1 | 2/2005 | Smith | |
| 2005/0048838 | A1 | 3/2005 | Korsunsky et al. | |
| 2005/0048842 | A1 | 3/2005 | Benham et al. | |
| 2005/0070160 | A1 | 3/2005 | Cohen et al. | |
| 2005/0133245 | A1 | 6/2005 | Katsuyama et al. | |
| 2005/0148239 | A1 | 7/2005 | Hull et al. | |
| 2005/0170700 | A1 * | 8/2005 | Shuey et al. | 439/701 |
| 2005/0176300 | A1 | 8/2005 | Hsu et al. | |
| 2005/0176835 | A1 | 8/2005 | Kobayashi et al. | |
| 2005/0215121 | A1 | 9/2005 | Tokunaga | |
| 2006/0019517 | A1 | 1/2006 | Raistrick et al. | |
| 2006/0019538 | A1 | 1/2006 | Davis et al. | |
| 2006/0024983 | A1 | 2/2006 | Cohen et al. | |
| 2006/0024984 | A1 | 2/2006 | Cohen et al. | |
| 2006/0068640 | A1 | 3/2006 | Gailus | |
| 2006/0073709 | A1 | 4/2006 | Reid | |
| 2006/0292932 | A1 | 12/2006 | Benham et al. | |
| 2007/0004282 | A1 | 1/2007 | Cohen et al. | |
| 2007/0004828 | A1 | 1/2007 | Khabbaz | |
| 2007/0021000 | A1 | 1/2007 | Laurx | |
| 2007/0021001 | A1 | 1/2007 | Laurx et al. | |
| 2007/0021002 | A1 | 1/2007 | Laurx et al. | |
| 2007/0021003 | A1 | 1/2007 | Laurx et al. | |
| 2007/0021004 | A1 | 1/2007 | Laurx et al. | |
| 2007/0037419 | A1 | 2/2007 | Sparrowhawk | |
| 2007/0042639 | A1 | 2/2007 | Manter et al. | |
| 2007/0054554 | A1 | 3/2007 | Do et al. | |
| 2007/0059961 | A1 | 3/2007 | Cartier et al. | |
| 2007/0111597 | A1 | 5/2007 | Kondou et al. | |
| 2007/0141872 | A1 | 6/2007 | Szczesny et al. | |
| 2007/0218765 | A1 | 9/2007 | Cohen et al. | |
| 2008/0194146 | A1 | 8/2008 | Gailus | |
| 2008/0246555 | A1 | 10/2008 | Kirk et al. | |
| 2008/0248658 | A1 | 10/2008 | Cohen et al. | |
| 2008/0248659 | A1 | 10/2008 | Cohen et al. | |
| 2008/0248660 | A1 | 10/2008 | Kirk et al. | |
| 2009/0011641 | A1 | 1/2009 | Cohen et al. | |
| 2009/0011645 | A1 | 1/2009 | Laurx et al. | |
| 2009/0117386 | A1 | 5/2009 | Vacanti et al. | |
| 2009/0239395 | A1 | 9/2009 | Cohen et al. | |
| 2009/0291593 | A1 | 11/2009 | Atkinson et al. | |
| 2010/0081302 | A1 | 4/2010 | Atkinson et al. | |
| 2010/0203768 | A1 * | 8/2010 | Kondo et al. | 439/676 |
| 2010/0294530 | A1 | 11/2010 | Atkinson et al. | |
| 2011/0003509 | A1 | 1/2011 | Gailus | |
| 2011/0230095 | A1 | 9/2011 | Atkinson et al. | |
| 2011/0230096 | A1 | 9/2011 | Atkinson et al. | |
| 2012/0156929 | A1 | 6/2012 | Manter et al. | |
| 2012/0202363 | A1 | 8/2012 | McNamara et al. | |
| 2012/0202387 | A1 | 8/2012 | McNamara | |

FOREIGN PATENT DOCUMENTS

| | | | |
|---|---|---|---|
| EP | 2169770 | A2 | 3/2010 |
| GB | 1272347 | A | 4/1972 |
| JP | 2002-117938 | A | 4/2002 |
| JP | 2003-17193 | A | 1/2003 |
| WO | WO 98/35409 | A1 | 8/1998 |
| WO | WO 01/39332 | A | 5/2001 |
| WO | WO 01/57963 | A2 | 8/2001 |
| WO | WO 03/047049 | A1 | 6/2003 |
| WO | WO 2004/059794 | A2 | 7/2004 |
| WO | WO 2004/059801 | A1 | 7/2004 |
| WO | WO 2005/011062 | A2 | 2/2005 |
| WO | WO 2006/039277 | A1 | 4/2006 |
| WO | WO 2007/005597 | A2 | 1/2007 |
| WO | WO 2007/005598 | A2 | 1/2007 |
| WO | WO 2007/005599 | A1 | 1/2007 |
| WO | WO 2008/124052 | A1 | 10/2008 |
| WO | WO 2008/124054 | A1 | 10/2008 |
| WO | WO 2008/124057 | A1 | 10/2008 |
| WO | WO 2008/124101 | A1 | 10/2008 |

OTHER PUBLICATIONS

Tyco Electronics, "High Speed Backplane Connectors," Product Catalog No. 1773095, Revised Dec. 2008, pp. 1-40.

www.gore.com, Military Fibre Channel High Speed Cable Assembly, © 2008, accessed Aug. 2, 2012 via Internet Archive: Wayback Machine (http://web.archive.org). Link archived: http://www.gore.com/en_xx/products/cables/copper/networking/military/military_fibre . . . Last archive date Apr. 6, 2008.

Brian Beaman, High Performance Mainframe Computer Cables, Electronic Components and Technology Conference, 1997, pp. 911-917.

Microwave Theory and Techniques by Reich, Ordung, Krauss, and Skalink. Copyright 1965, Boston Technical Publishers, Inc. pp. 182-191.

* cited by examiner

MEZZANINE CONNECTOR

RELATED APPLICATIONS

This application claims priority benefit, under 35 U.S.C. §119(e), of U.S. Provisional Patent Application Ser. No. 61/438,956, entitled "Mezzanine Connector", filed on Feb. 2, 2011; and this application further claims priority benefit, under 35 U.S.C. §119(e), of U.S. Provisional Patent Application Ser. No. 61/473,565, entitled "Mezzanine Connector", filed on Apr. 8, 2011.

Each of the above-referenced applications is hereby incorporated by reference in its entirety.

BACKGROUND

The present disclosure relates generally to electrical interconnections for connecting printed circuit boards ("PCBs").

Electrical connectors are used in many electronic systems. It is generally easier and more cost effective to manufacture a system on several PCBs that are connected to one another by electrical connectors than to manufacture a system as a single assembly. A traditional arrangement for interconnecting several PCBs is to have one PCB serve as a backplane. Other PCBs, which are called daughter boards or daughter cards, are then connected through the backplane by electrical connectors.

Connectors in different formats are used, depending on the types or orientations of PCBs to be connected. Some connectors are right angle connectors, meaning that they are used to join two printed circuit boards that are mounted in an electronic system at a right angle to one another. Another type of connector is called a mezzanine connector. Such a connector is used to connect printed circuit boards that are parallel to one another.

Examples of mezzanine connectors may be found in: U.S. patent application Ser. No. 12/612,510, published as U.S. Patent Application Publication No. 2011-0104948; International Application No. PCT/US2009/005275, published as International Publication No. WO/2010/039188; U.S. Pat. No. 6,152,747; and U.S. Pat. No. 6,641,410. All of these patents and patent applications are assigned to the assignee of the present application and are hereby incorporated by reference in their entireties.

Electronic systems have generally become smaller, faster and functionally more complex. These changes mean that the number of circuits in a given area of an electronic system, along with the frequencies at which the circuits operate, have increased significantly in recent years. Current systems pass more data between printed circuit boards and require electrical connectors that are electrically capable of handling more data at higher speeds than connectors of even a few years ago.

One of the difficulties in making a high density, high speed connector is that electrical conductors in the connector can be so close that there can be electrical interference between adjacent signal conductors. To reduce interference, and to otherwise provide desirable electrical properties, metal members are often placed between or around adjacent signal conductors. The metal acts as a shield to prevent signals carried on one conductor from creating "crosstalk" on another conductor. The metal also impacts the impedance of each conductor, which can further contribute to desirable electrical properties.

As signal frequencies increase, there is a greater possibility of electrical noise being generated in the connector in forms such as reflections, crosstalk and electromagnetic radiation.

Therefore, the electrical connectors are designed to limit crosstalk between different signal paths and to control the characteristic impedance of each signal path. Shield members are often placed adjacent the signal conductors for this purpose.

Crosstalk between different signal paths through a connector can be limited by arranging the various signal paths so that they are spaced further from each other and nearer to a shield, such as a grounded plate. Thus, the different signal paths tend to electromagnetically couple more to the shield and less with each other. For a given level of crosstalk, the signal paths can be placed closer together when sufficient electromagnetic coupling to the ground conductors is maintained.

Although shields for isolating conductors from one another are typically made from metal components, U.S. Pat. No. 6,709,294, which is assigned to the same assignee as the present application and is hereby incorporated by reference in its entirety, describes making an extension of a shield plate in a connector from conductive plastic.

In some connectors, shielding is provided by conductive members shaped and positioned specifically to provide shielding. These conductive members are designed to be connected to a reference potential, or ground, when mounted on a printed circuit board. Such connectors are said to have a dedicated ground system.

In other connectors, all conductive members may be generally of the same shape and positioned in a regular array. If shielding is desired within the connector, additional conductive members may be connected to an AC-ground. All other conductive members may be used to carry signals. Such a connector, called an "open pin field connector," provides flexibility in that the number and specific conductive members that are grounded, and conversely the number and specific conductive members available to carry signals or power, can be selected when a system using the connector is designed. However, the shape and positioning of conductive members providing shielding is constrained by the need to ensure that those conductive members, if connected to carry a signal rather than providing a ground, provide a suitable path for signals.

Other techniques may be used to control the performance of a connector. For example, transmitting signals differentially can also reduce crosstalk. Differential signals are carried by a pair of conducting paths, called a "differential pair." The voltage difference between the conductive paths represents the signal. In general, a differential pair is designed with preferential coupling between the conducting paths of the pair. For example, the two conducting paths of a differential pair may be arranged to run closer to each other than to adjacent signal paths in the connector. Conventionally, no shielding is desired between the conducting paths of the pair, but shielding may be used between differential pairs.

Examples of differential electrical connectors are shown in U.S. Pat. No. 6,293,827, U.S. Pat. No. 6,503,103, U.S. Pat. No. 6,776,659, and U.S. Pat. No. 7,163,421, all of which are assigned to the assignee of the present application and are hereby incorporated by reference in their entireties.

Differential connectors are generally regarded as "edge coupled" or "broadside coupled." In both types of connectors the conductive members that carry signals are generally rectangular in cross section. Two opposing sides of the rectangle are wider than the other sides, forming the broad sides of the conductive member. When pairs of conductive members are positioned with broad sides of the members of the pair closer to each other than to adjacent conductive members, the connector is regarded as being broadside coupled. Conversely, if pairs of conductive members are positioned with the narrower edges joining the broad sides closer to each other than to adjacent conductive members, the connector is regarded as being edge coupled.

Electrical characteristics of a connector may be controlled through the use of absorptive material. U.S. Pat. No. 6,786,771, which is assigned to the same assignee as the present application and which is hereby incorporated by reference in its entirety, describes the use of absorptive material to reduce unwanted resonances and improve connector performance, particularly at high speeds (for example, signal frequencies of 1 GHz or greater, particularly above 3 GHz). U.S. Pat. No. 7,371,117, U.S. Pat. No. 7,581,990, and U.S. patent application Ser. No. 13/029,052, published as U.S. Patent Application Publication No. 2011-0230095, which are assigned to the assignee of the present application and are hereby incorporated by reference in their entireties, describe the use of lossy material to improve connector performance.

SUMMARY

Aspects of the present disclosure relate to improved high speed, high density interconnection systems. The inventors have recognized and appreciated design techniques for connectors and circuit assemblies to provide high signal densities through a connector for high frequency signals. These techniques may be used together, separately, or in any suitable combination.

In some embodiments, an improved connector may include two component pieces adapted to mate with each other. One of the connector pieces may have conductive elements with beam-shaped mating contact portions, while the other connector piece may have conductive elements with pad-shaped mating contact portions adapted to mate with corresponding beam-shaped mating contact portions. The beams may be compliant and the pads may be relatively non-yielding, so that, when the two connector pieces are mated with each other, the beams press against the pads to facilitate good electrical connection between each beam and the corresponding pad.

In some further embodiments, each beam may have an opening to control mechanical properties of the beam while allowing edge to edge spacing between adjacent beams to be selected to provide desired electrical properties. For example, an opening may be teardrop shaped, with a larger width towards a distal end of the beam and a smaller width towards a proximal end of the beam. This results in less beam material towards the distal end, so that a distribution of spring forces along the length of the beam approximates a distribution of forces achieved with a tapered beam. In this manner, beams can be made wider, but without being made stiffer, to achieve a desired edge-to-edge spacing between adjacent beams.

In yet some further embodiments, beams shaped for different functions may have differently shaped cutouts. For example, a beam associated with a conductive element configured as a ground conductor may have a narrower cutout than a beam associated with a conductive elements configured as signal conductor. This may equalize the stiffness of all of the beams in a wafer, even if the beams have different dimensions.

In yet some further embodiments, mating contact portions of conductive elements configured as ground conductors may be narrower than those of conductive elements configured as signal conductors in one connector piece of a two-piece connector. In the same two-piece connector, mating contact portions of the other connector piece may have opposite relative dimensions, with mating contact portions of conductive elements configured as ground conductors being wider than mating contact portions of conductive element configured as signal conductor. This design may reduce overall dimensions of a wafer, while allowing "float" (i.e., some degree of misalignment) between corresponding mating contact portions that are adapted to mate with each other.

In yet some further embodiments, a beam-shaped mating contact portion may have a tab portion at a distal end and a neck portion closer to a proximal end. A contact region may be formed between the tab portion and the neck portion, where the contact region is wider than both the tab portion and the neck portion. A distance between the tab portion and the neck portion may be at most 1.5 mm. The widened contact region may provide float, as discussed above and in greater detail below, while the neck portion may be provided to offset a change in impedance that may result from the widened contact region.

Other advantages and novel features will become apparent from the following detailed description of various non-limiting embodiments of the present disclosure when considered in conjunction with the accompanying figures and from the claims.

BRIEF DESCRIPTION OF DRAWINGS

The accompanying drawings are not intended to be drawn to scale. For purposes of clarity, not every component may be labeled in every drawing.

DETAILED DESCRIPTION

Figure 1A:
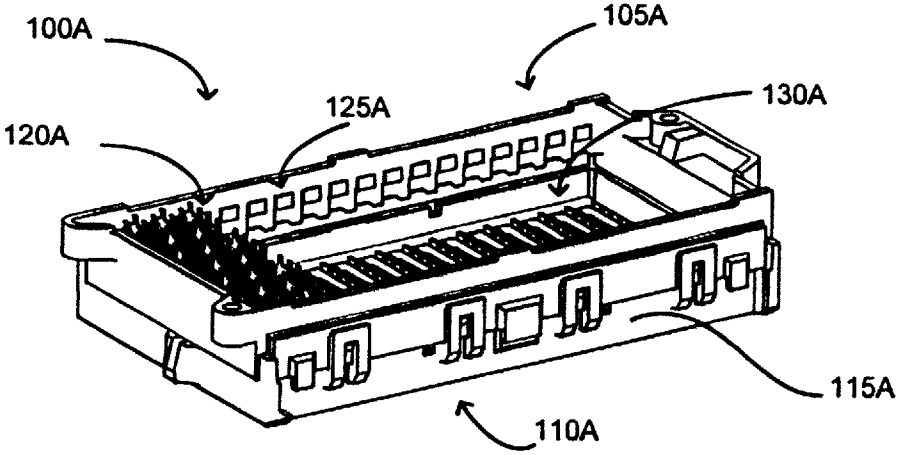
FIG. 1A is a perspective view of a first connector suitable for use in an interconnection system, in accordance with some embodiments.
Figure 1B:
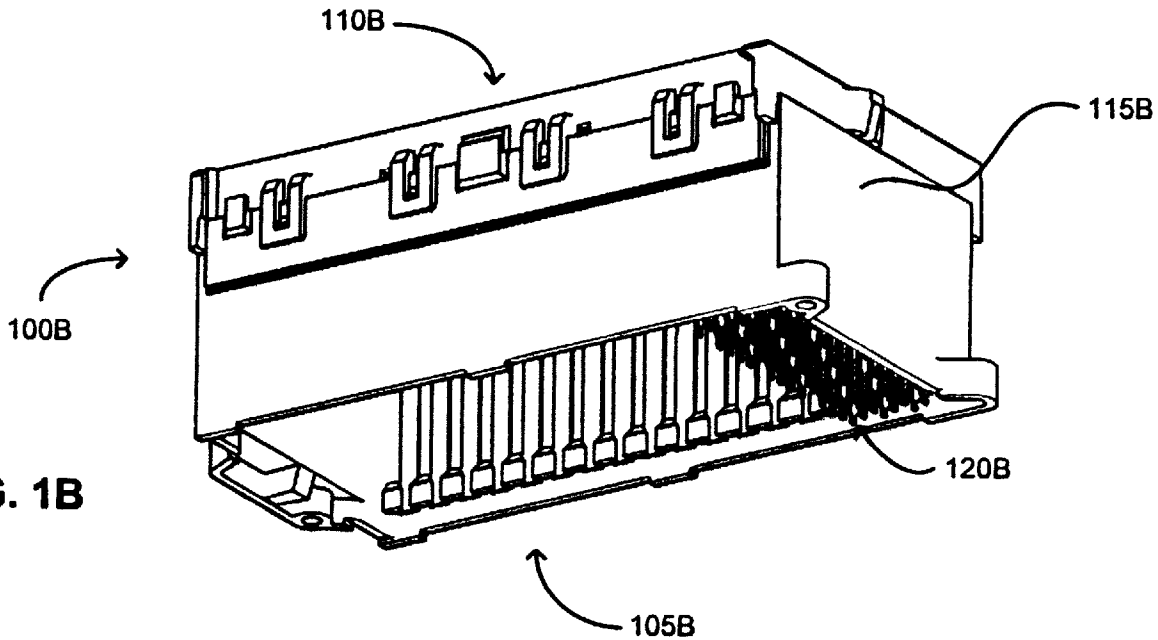
FIG. 1B is a perspective view of a second connector configured to mate with first connector shown in FIG. 1A, in accordance with some embodiments.

FIG. 1A is a perspective view of a first connector 110A, and FIG. 1B is a perspective view of a second connector 100B configured to mate with first connector 110A. The connectors 100A and 100B together form a two-piece electrical connector, in accordance with some embodiments of the present disclosure. This two-piece connector is here shown configured as a mezzanine connector for connecting two PCBs that are parallel to one another. For instance, the connector 100A may have an attachment face 105A adapted to attach to a first PCB (not shown), and the connector 100B may have an attachment face 105B adapted to attach to a second PCB (not shown) that is parallel to the first PCB. Furthermore, the connector 100A may have a mating face 110A adapted to mate with a mating face 110B of the connector 100B, so as to make electrical connections between traces in the first and second PCBs.

In the example shown in FIG. 1A, the connector 100A comprises a housing into which a plurality of wafers may be removably or fixedly installed. Here, the housing is shaped as a shell 115A having outer walls defining a generally open interior region. The shell 115A may be generally shaped as a hollow rectangular tube, though other shapes may be also used. The shell 115A may also be made of one or more pieces that may be interconnected in any suitable way. For example, in some embodiments, the shell 115A may include at least two component pieces, a first piece including the mating face 110A and a second piece including the attachment face 105A. Each of these pieces may be made in any suitable way. As one example, a piece may be molded of a thermoplastic polymer with reinforcing fiber filler. Such a structure may be made to be insulative. However, in some embodiments, conductive or lossy members or portions may be incorporated into the shell 115A for shielding, impedance control, and/or resonance control.

For clarity, FIG. 1A shows an illustrative arrangement in which only a portion of the shell 115A is occupied by installed wafers 120A. More wafers may be installed at the unoccupied portion of the shell 115A. The wafers 120A may be installed in the shell 115A using any suitable mechanism. For example, as discussed in greater detail below in connection with FIGS. 4A-C, the vertical edges of the wafers 120A may be shaped to slide within channels formed by grooves on interior side walls of the shell 115A (e.g., groove 125A shown in FIG. 1A). The grooves may be formed in such a manner to substantially restrict lateral and/or rotational movements of the wafers 120A once the vertical edges of the wafers 120A are inserted into the grooves. Thus, the relative spacing between grooves may determine the relative spacing between installed wafers. Such spacing may, but need not, be regular.

In some embodiments, a wafer may include one or more conductive elements, each of which may have a contact tail adapted for attachment to a PCB, and a mating contact portion adapted to make electrical connection with a corresponding conductive element of a corresponding connector (e.g., the connector 100B shown in FIG. 1B) in a two-piece connector. In the view illustrated in FIG. 1A, the contact tail portions of the wafers are facing upward and visible, and the mating contact portions are facing downward and obscured from view. Illustrative constructions of a wafer suitable for use in the connector 100A are shown in FIGS. 2A-C and 3A-D, and are described in greater detail below.

In various embodiments, either or both faces 105A and 110A of the shell 115A may be partially or totally enclosed. For example, in the embodiment illustrated in FIG. 1A, the mating face 110A of the shell 115A is partially enclosed. As can be seen in a portion of the mating face 110A not obscured by the installed wafers 120A, the mating face 110A may have slots, such as slot 130A. These slots may be positioned relative to installed wafers in the connector 100A such that, when the connector 100A is mated with a corresponding connector (e.g., the connector 100B shown in FIG. 1B), mating contact portions of the corresponding connector can pass through the slots to engage mating contact portions of the installed wafers of the connector 100A.

FIG. 1B is a perspective view of a connector 100B that can be used for attachment to a PCB in an interconnection system, in accordance with some embodiments of the present disclosure. For example, the connector 100B may be used in conjunction with the connector 100A shown in FIG. 1A in a mezzanine connector configuration to form electrical connections between two parallel PCBs.

The connector 100B may be constructed using techniques similar to those used to make the connector 100A. For example, in the embodiment shown in FIG. 1B, the connector 100B may include a shell 115B and a plurality of wafers 120B that may be removably or fixedly installed in the shell 115B. Like the wafers 120A of the connector 100A, the wafers 120B also include conductive elements that have contact tails and mating contact portions. The contact tails of conductive elements of the wafers 120B may be shaped in a same, or similar, way as the contact tails of conductive elements of the wafers 120A, and may therefore also be suitable for attachment to a PCB. On the other hand, the mating contact portions of conductive elements of the wafers 120B may be complementary to the mating contact portions of conductive elements of the wafers 120A such that, when the connectors 100A and 100B are mated, the mating contact portions of conductive elements of the wafers 120A will make electrical and mechanical connections with the mating contact portions of corresponding conductive elements of the wafers 120B. In this way, signal paths will be created through the two-piece connector formed by the connectors 100A and 100B.

Figure 6A:
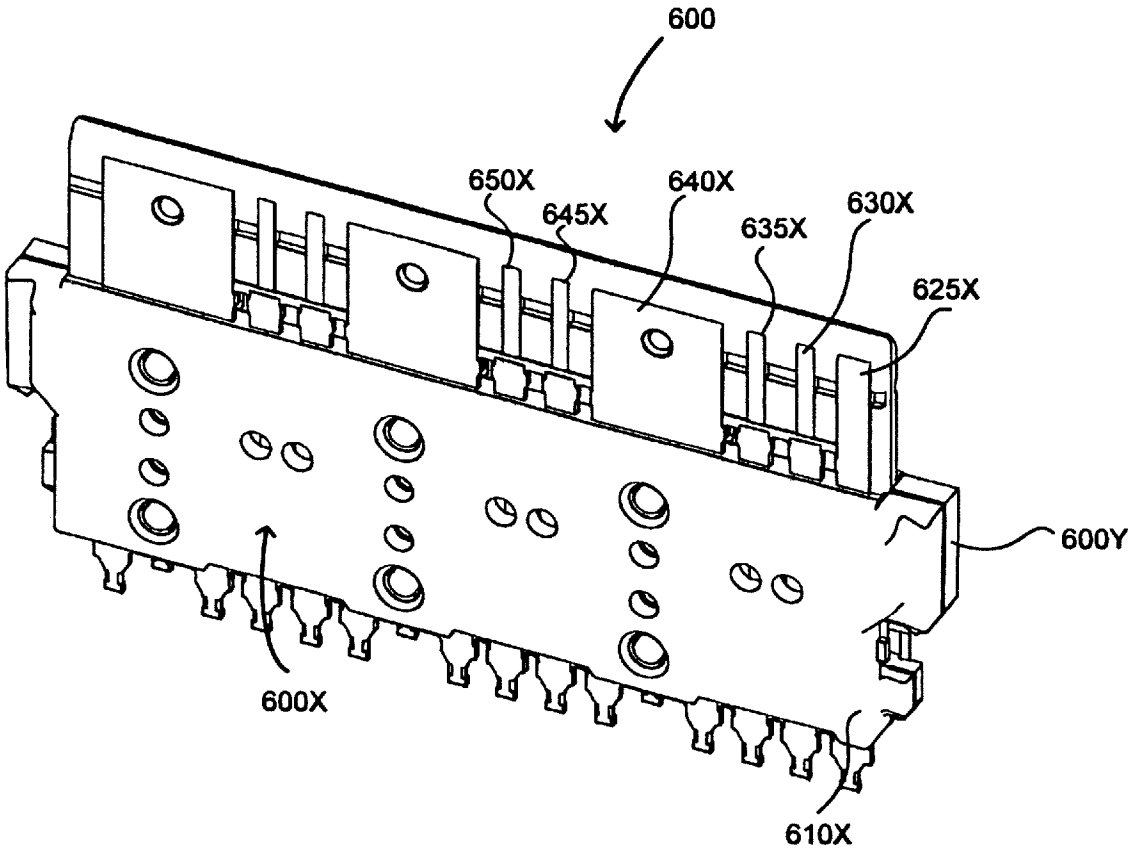
FIG. 6A is a perspective view of another illustrative wafer suitable for use in a connector of a two-piece electrical connector, in accordance with some embodiments.
Figure 6B:
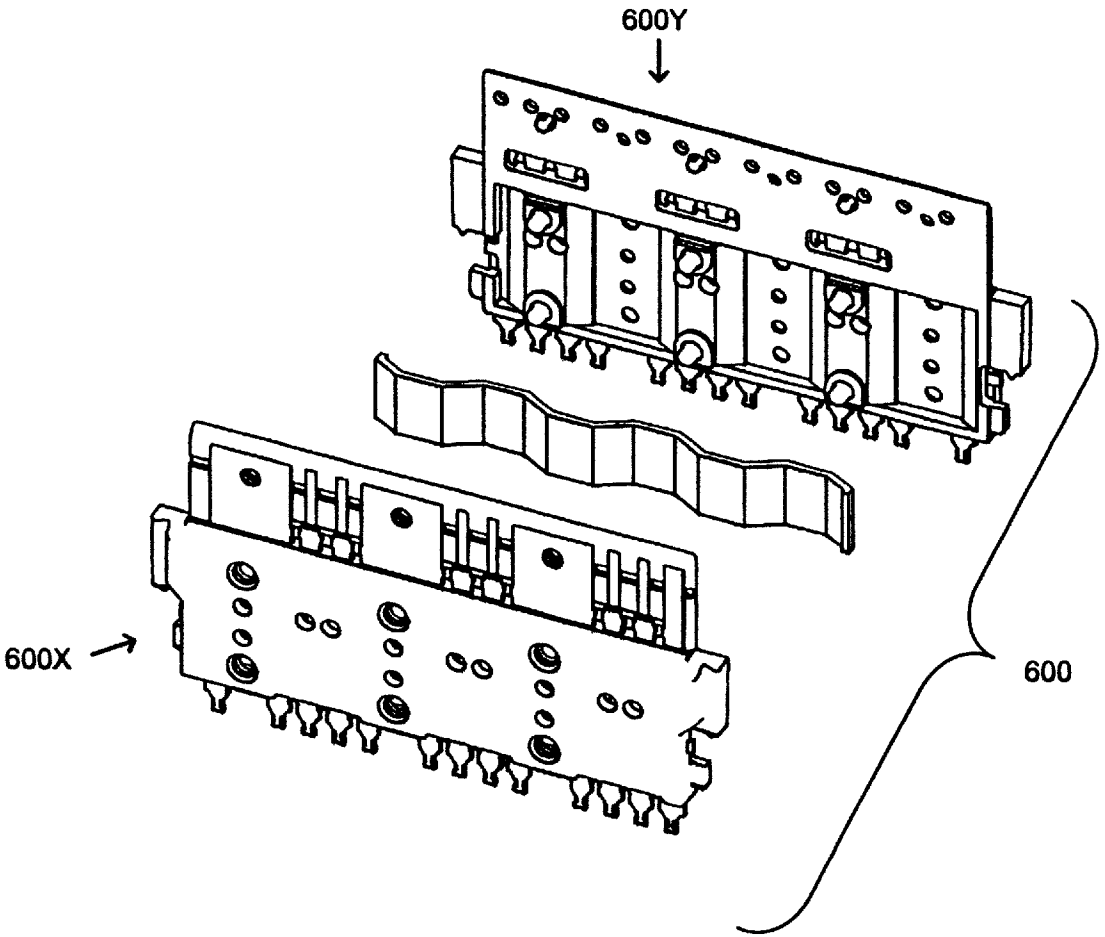
FIG. 6B is an exploded view of the illustrative wafer shown in FIG. 6A.

To provide suitable electrical and/or mechanical connections between two mating contact portions adapted to mate with each other, one of the two mating contact portions may be compliant and the other may be relatively non-yielding. In the embodiment illustrated in FIGS. 1A-B, compliance may be provided by beam-shaped mating contact portions ("beams," for short), which may be formed in the connector 100A. Examples of such beam-shaped mating contact portions are shown in FIGS. 2A-C and 3A-D and are further described below. The corresponding relatively non-yielding mating contact portions may be pad-shaped and may be formed in the connector 100B. Examples of such pad-shaped mating contact portions ("pads," for short) are shown in FIGS. 6A-B and described in further detail below.

As illustrated by a comparison of FIGS. 1A and 1B, the connectors 100A and 100B in some embodiments may be of different heights. In this example, the connector 100B is shown to be taller than the connector 100A. However, it should be appreciated that any suitable combination of heights may be used in conjunction with any and all of the inventive concepts disclosed.

The shell 115B of the connector 100B, like the shell 115A of the connector 100A, may be of a generally tubular shape. In the embodiment illustrated in FIGS. 1A-B, the shell 115B of the connector 100B has dimensions generally the same as, or similar to, the connector 100A, but may have a mating face 110B that is shaped to mate with the mating face 110A of the connector 100A. In this example, the mating face 110B of the connector 100B is not enclosed. Rather, the mating face 110B is such that the wafers 120B of the connector 100B, including conductive elements with pad-shaped mating contact portions, may be inserted into respective slots in the mating face 110A of the connector 100A, so as to allow electrical and/or mechanical connections between corresponding mating contact portions in the two connectors.

Figure 2A:
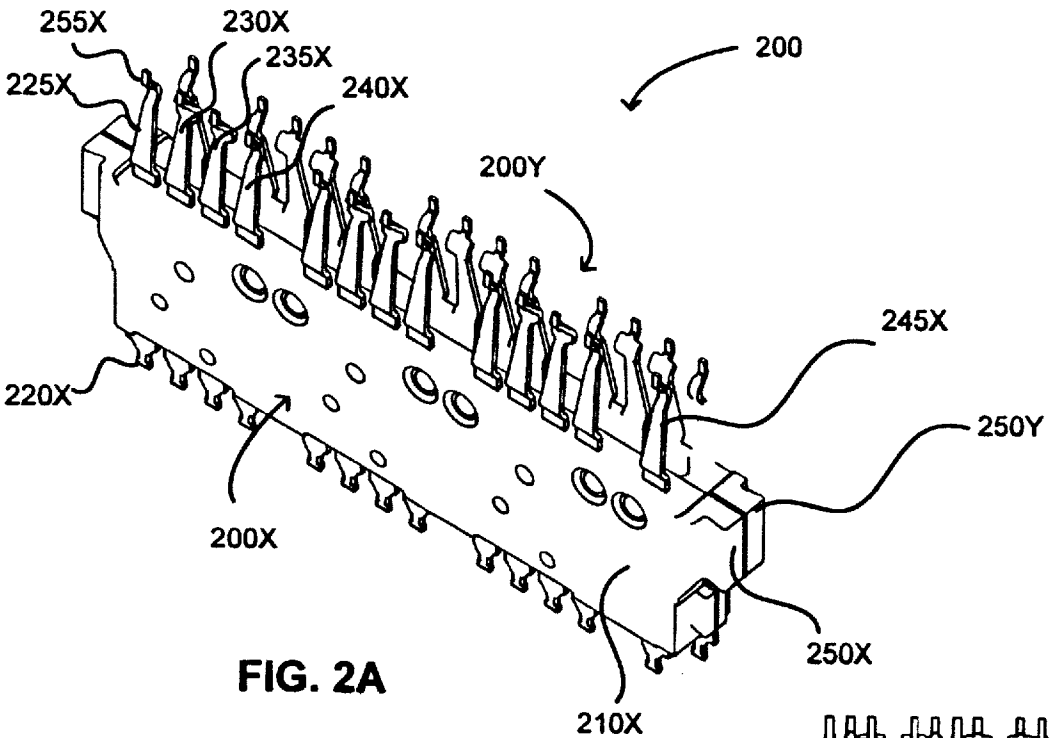
FIG. 2A is a perspective view of an illustrative wafer suitable for use in the connector shown in FIG. 1A, in accordance with some embodiments.

FIG. 2A is a perspective view of an illustrative wafer 200 suitable for use in the connector 100A shown in FIG. 1A. In this example, the wafer 200 is made of two pieces (hereinafter "wafer halves") 200X and 200Y that are held together by some suitable attachment mechanism. However, it should be appreciated that the wafer 200 in alternative embodiments may be formed as an integral piece or as a combination of more than two pieces.

In some embodiments, each of the wafer halves 200X and 200Y may be formed by molding an insulative material around one or more conductive elements. In the example shown in FIG. 2A, the wafer half 200X may include an insulative portion 210X formed generally around a plurality of conductive elements disposed generally in parallel to each other. Each conductive element may have exposed portions not covered by the insulative portion 210X. Such exposed portions may include a contact tail (e.g., contact tail 220X shown in FIG. 2A) and a mating contact portion (e.g., beam-shaped mating contact portions 225X, 230X, 235X, 240X, and 245X shown in FIG. 2A).

In the example shown in FIG. 2A, each wafer half may have a protruding portion at either end, such as protruding portion 250X of the wafer half 200X and protruding portion 250Y of the wafer half 200Y. A cross section of each protruding portion may have a generally trapezoidal shape, so that the protruding portions 250X and 250Y, when held together, form a dove-tailed piece at an end of the wafer 200. The dove-tailed piece may be shaped to fit within a groove in a connector shell, such as the groove 125A of the shell 115A shown in FIG. 1A. Further details of illustrative methods for installing wafers in a connector shell are described below in connection with FIGS. 4A-C and 5A-B.

As discussed above, contact tails of conductive elements in a connector may be adapted for attachment to a PCB. For example, in the embodiment shown in FIG. 2A, the contact tail 220X may be suitable for surface mounting onto a PCB. A solder ball (not shown in FIG. 2A) may be attached to an end portion of the contact tail 220X to facilitate surface mount attachment of a connector including wafer 200 to a PCB. Such attachment may be provided using known manufacturing techniques. In one example, the contact tail may be appropriately positioned over a pad on a surface of a PCB, so as to melt the solder and thereby form an electrical connection between the contact tail 220X and a selected trace or, for ground conductors, a ground plane, in the PCB connected to the pad. An example of a suitable arrangement of pads is illustrated in FIG. 9 and discussed below.

In the example shown in FIG. 2A, the contact tail 220X may "neck down" (i.e., become narrower) at or near the end portion where a solder ball can be attached. Such a construction may simplify manufacturing and/or provide improved electrical properties. For example, because the end portion of the contact tail 220X is narrower than the rest of the contact tail 220X, the contact tail 220X as a whole may have a more uniform distribution of conductive material when a solder ball is attached to the end portion. Alternatively, the shape of the contact tail may facilitate attachment of a solder ball.

It should be appreciated that solder balls may be attached to contact tails of conductive elements of the wafer half 200X using any suitable technique, for example, by inserting the contact tails into solder balls held in cavities and heated to a temperature that softens the solder to a state that the contact tail may be inserted into the solder ball. Furthermore, solder balls may be attached to the contact tails at any suitable stage of manufacturing, for example, while the wafer half 200X is being formed, after the wafer half 200X has been formed, after the wafer half 200X has been combined with another wafer half to form a wafer, or after the formed wafer is installed in a connector shell. Though, in some embodiments, the solder balls are attached in the same operation for all of the contact tails for all wafers in a connector.

As discussed above, conductive elements of the wafer half 200X may have compliant beam-shaped mating contact portions (e.g., beams 225X, 230X, 235X, 240X, and 245X shown in FIG. 2A) adapted to mate with respective pad-shaped mating contact portions of conductive elements of a corresponding connector in a two-piece connector. In the embodiment shown in FIG. 2A, each beam may have a generally tapered shape that is wider at a base portion near the insulative portion 210X of the wafer half 200X, and narrower at a distal end. Such a tapered shape may provide a more uniform distribution of spring force along the length of the beam when the beam is mated with a corresponding pad, which may in turn facilitate more uniform electrical connection between the beam and the pad.

In the embodiment shown in FIG. 2A, a tab (e.g., tab 255X) is provided at each beam, extending from the distal end of the beam. As explained in greater detail below in connection with FIG. 5, such a tab may engage a feature in a structure defining a mating face of a connector shell (e.g., the mating face 110A of the shell 115A shown in FIG. 1A), so as to reduce the chance of stubbing upon mating between a beam and a pad.

FIG. 2A illustrates some specific designs and arrangements of connector wafers. It should be appreciated that such designs and arrangements are provided solely for purpose of illustration. Other designs and/or arrangements may also be suitable, as the various inventive concepts disclosed herein are not limited to any particular mode of implementation.

Figure 2B:
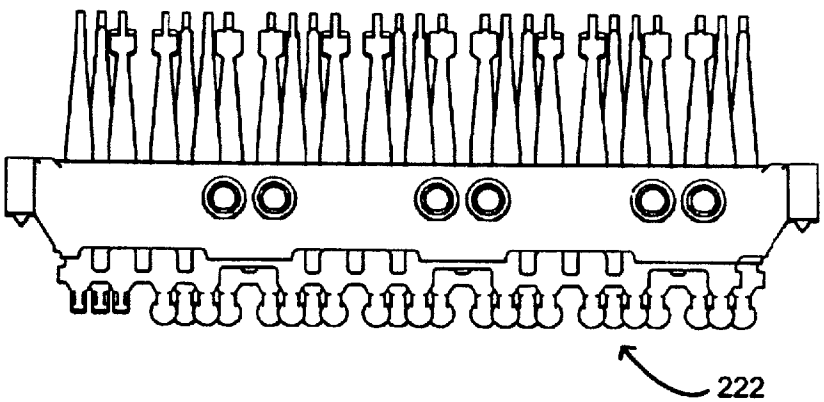
FIG. 2B is a plan view of the illustrative wafer shown in FIG. 2A.

FIG. 2B is a plan view of the illustrative wafer 200 shown in FIG. 2A. In this view, some of the contact tails of conductive elements of the wafer 200 are shown with solder balls 222 attached thereto. However, it should be appreciated that solder balls are described herein merely as an example of a mechanism for attaching a connector to a PCB. Other attachment mechanisms may also be suitable.

Figure 2C:
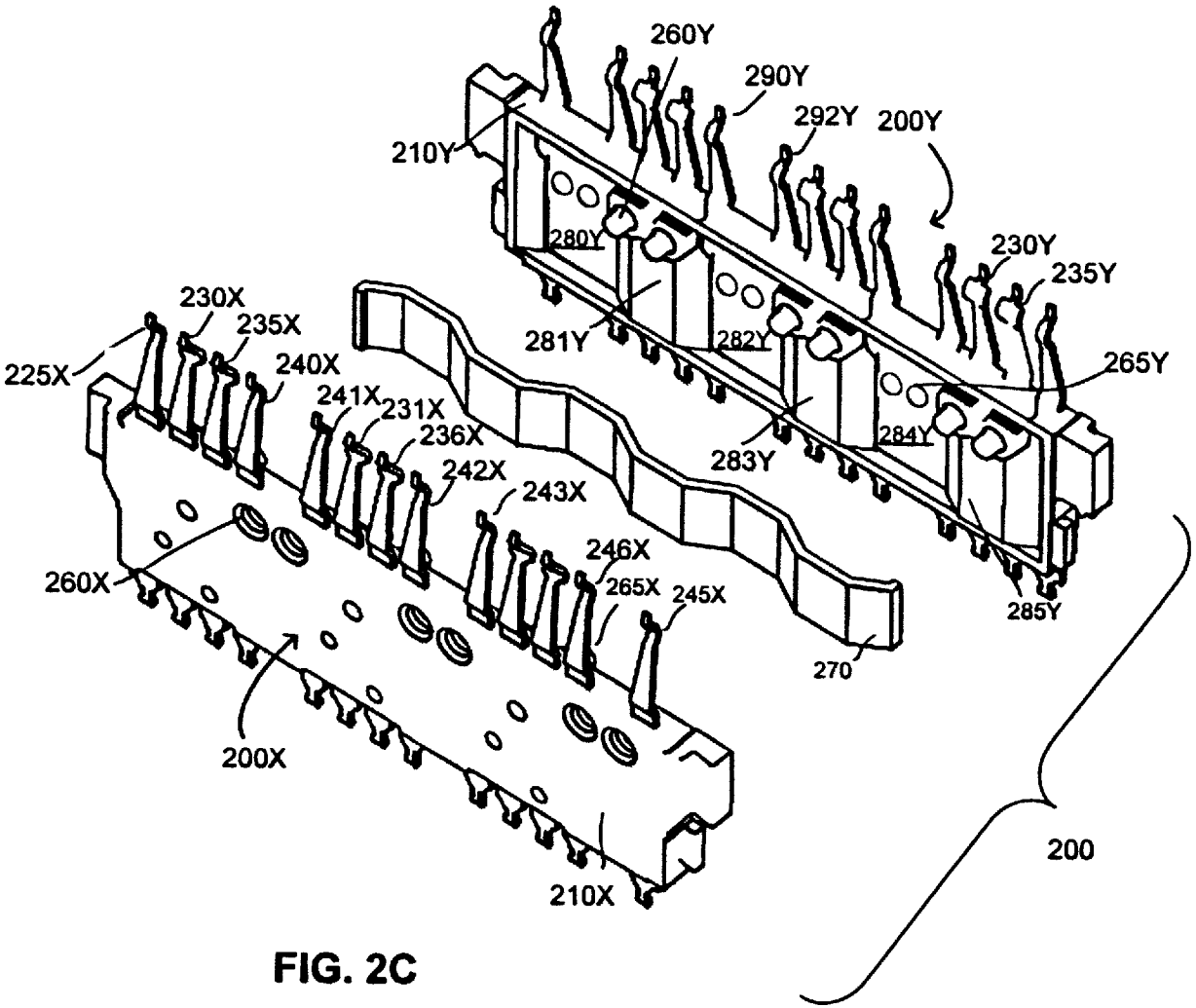
FIG. 2C is an exploded, perspective view of the illustrative wafer shown in FIG. 2A.

FIG. 2C is an exploded, perspective view of the illustrative wafer 200 shown in FIG. 2A. Both wafer halves 200X and 200Y are visible in this view, as are some illustrative attachment features for holding the wafer halves 200X and 200Y together. The illustrative attachment features include posts formed on one wafer half and corresponding holes formed on the other wafer half. For example, a post 260Y may be molded in an insulative portion 210Y of the wafer half 200Y and may be shaped to be inserted into a hole 260X formed in the wafer half 200X. The hole 260X may pass through a conductive element of the wafer half 200X and may have a diameter slightly smaller than that of the post 260Y. As a portion of the post 260Y is forced through the hole 260X, it may be compressed, but may re-expand once through the hole 260X. As a result, the post 260Y may become securely held in the hole 260X. Similarly, a post 265X (partially obscured from view in FIG. 2C) may be molded in the insulative portion 210X of the wafer half 200X and may be shaped to be inserted into a hole 265Y formed in the wafer half 200Y.

While posts and corresponding holes are shown in the FIG. 2C to attach the wafer halves 200X and 200Y, it should be appreciated that other suitable attachment mechanisms may also be used for that purpose. Alternative attachment mechanisms may include, for example, adhesives, welds, or latching members.

In some embodiments, wafer halves may have the same size and shape such that both wafer halves may be formed using the same manufacturing tooling for some or all of the manufacturing steps. This tooling may include dies to stamp and form lead frames from a sheet of conductive material, as well as molds used to over-mold insulative portions onto the lead frames. In the embodiment illustrated in FIG. 2C, the same tooling has been used such that the wafer halves 200X and 200Y are, within normal deviations found in manufacturing, identical. Accordingly, the wafer 200 shown in FIG. 2A may be made of two identical wafer halves which, when attached to form the wafer 200, are arranged in reversed orientations from one another. This design may simplify manufacturing and thereby reduce costs. However, it should be appreciated that the present disclosure does not require the use of identical wafer halves. Other designs with non-identical wafer halves may also be used.

In the embodiment shown in FIG. 2C, the wafer halves 200X and 200Y each include multiple conductive elements held in an insulative portion. Such wafer halves may be manufactured, for example, using an insert molding operation. The conductive elements in each wafer half may be arranged, except on one end, in groups of four. Each group may comprise, in the center, a pair of conductive elements that are shaped to serve as signal conductors. In the embodiment illustrated, these signal conductors are shaped to provide a pair of edge-coupled signal conductors adapted to carry a differential signal. The two remaining conductive elements on either side of the center pair may be shaped to serve as ground conductors.

For example, the beams 225X, 230X, 235X, and 240X may be parts of conductive elements within the same group. The beams 230X and 235X may be mating contact portions of a pair of conductive elements configured as signal conductors, while the beams 225X and 240X may be mating contact portions of two conductive elements configured as ground conductors.

An additional conductive element, not included within any group, may be at an end of each wafer half. This conductive element may be configured as a ground conductor. Inclusion of such a conductive element may provide a generally uniform pattern of ground conductors around all pairs of signal conductors, even those signal conductors located near an end of a row. For example, the beam 245X, which is located at an opposite end of the wafer half 200X from the beams 225X, 230X, 235X, and 240X, may be a mating contact portion of a conductive element configured as a ground conductor. Though not visible in the view of FIG. 2C, beam 245X may be formed as part of the same conductive element as beam 246X, which may also be configured as a ground conductor. Beams 245X and 246X may be joined through a planar structure, which in the embodiment of FIG. 2C is within the insulative portion 210X. This planar structure aligns with intermediate portions of conductive elements forming beams 230Y and 235Y when the wafer halves 200X and 200Y are pressed together. That planar portion is terminated on both ends by beams 245X and 246X and corresponding contact tails (not numbered). Similar planar conductive structures span beams designated as ground conductors in adjacent groups. For example, beams 240X and 241X may be portions of a single conductive element such that beams 240X and 241X are joined by a planar member within the insulative portion 210X. Likewise, beams 242X and 243X may be joined by a conductive member within the insulative portion 210X. Each of these planar members may align with the intermediate portions of a pair of signal conductors in the opposing wafer half 200Y.

While FIG. 2C shows an illustrative arrangement of conductive elements suitable for carrying differential signals, it should be appreciated that various inventive concepts described herein may also be applied to connectors having conductive element arranged and configured to carry single-ended signals. For example, in some embodiments, a column of conductive elements in a wafer half may have signal conductors and ground conductors arranged in an alternating pattern, rather than in groups of four as in the example of FIG. 2C. In one implementation, each ground conductor may be about twice as wide as each signal conductor, so that each ground conductor may have two corresponding beams, whereas each signal conductor may have just one corresponding beam. The signal and ground conductors may be arranged in such a manner as to provide uniform spacing between adjacent beams. However, it should be appreciated that aspects of the present disclosure are not limited to any particular arrangement or relative dimension of signal conductors and ground conductors. As discussed above, the illustrative wafer halves 200X and 200Y shown in FIG. 2C are identically manufactured. Therefore, the wafer halves 200X and 200Y contain the same number of groups of conductive elements. These groups are positioned such that, when the wafer halves 200X and 200Y are mated with each other (in opposite orientations), conductive elements configured as signal conductors in the wafer half 200X are generally aligned with conductive elements configured as ground conductors in the wafer half 200Y, and vice versa. Such an arrangement may further enhance the general pattern that ground conductors surround all pairs of signal conductors. As another example, all of the conductive elements may be of substantially the same size such that no conductors are designated as ground conductors While not visible in FIG. 2C, intermediate portions of conductive elements configured as ground conductors may be wider than intermediate portions of conductive elements configured as signal conductors. However, in the example illustrated in FIG. 2C, mating contact portions of conductive elements configured as ground conductors (e.g., the beams 225X and 240X) may be narrower than those of conductive elements configured as signal conductors (e.g., the beams 230X and 235X). As described below in greater detail in connection with FIGS. 6A-B and 7A-B, the corresponding pad-shaped mating contact portions may have opposite relative dimensions, with pads of conductive elements configured as ground conductors being wider than pads of conductive elements configured as signal conductors. As a result, the overall dimensions of a wafer may be reduced, while allowing "float" (i.e., some degree of misalignment) between corresponding wafers that are adapted to mate with each other in a two-piece connector.

FIG. 2C also shows that the wafer 200 may, in some embodiments, include a lossy member 270. In this example, the lossy member 270 is corrugated and may fit within a groove formed by alignment of cavities in opposing inner surfaces of the two wafer halves 200X and 200Y. The cavities may be formed in the insulative portions of the two wafer halves 200X and 200Y that hold conductive elements. For example, the wafer half 200Y may have cavities 280Y, 282Y, and 284Y, and projections 281Y, 283Y, and 285Y, arranged in an alternating pattern. Although not visible in the view shown in FIG. 2C, the inner surface of the wafer half 200X may also have alternating cavities and projections, because the wafer half 200X may be identically manufactured as the wafer half 200Y. When the wafer halves 200X and 200Y are attached to each other (in opposite orientations), each projection in the wafer half 200X may align with, and extend into, a corresponding cavity in the wafer half 200Y, and vice versa. Thus, in this example, the pattern of cavities and projections on each wafer half is not symmetric around the center of the wafer half; rather, there are as many cavities as there are projections.

While the illustrated pattern of cavities and projections on the wafer halves 200X and 200Y may be beneficial for various reasons noted below, such a pattern is not required. For example, in some alternative embodiments, only one of the two wafer halves may have such alternating cavities and projections. In yet some further embodiments, the wafer halves may not have any pattern of cavities and projections at all.

In the example shown in FIG. 2C, the lossy member 270 may be captured between the wafer halves 200X and 200Y when the halves 200X and 200Y are secured to each other. Accordingly, no special attachment features for holding lossy member 270 are necessary. Moreover, lossy member 270, in the embodiment illustrated, does not form a structural member of wafer 200, allowing wafer 200 to be assembled with or without lossy member 270. However, other techniques for fastening or otherwise attaching the lossy member 270 to the wafer 200 may also be used, including incorporating lossy member 270 as a structural member of wafer 200, as the present disclosure does not require any particular attachment method. Furthermore, the wafer 200 may, in alternative embodiments, be made without any lossy member between two wafer halves.

Figure 2D:
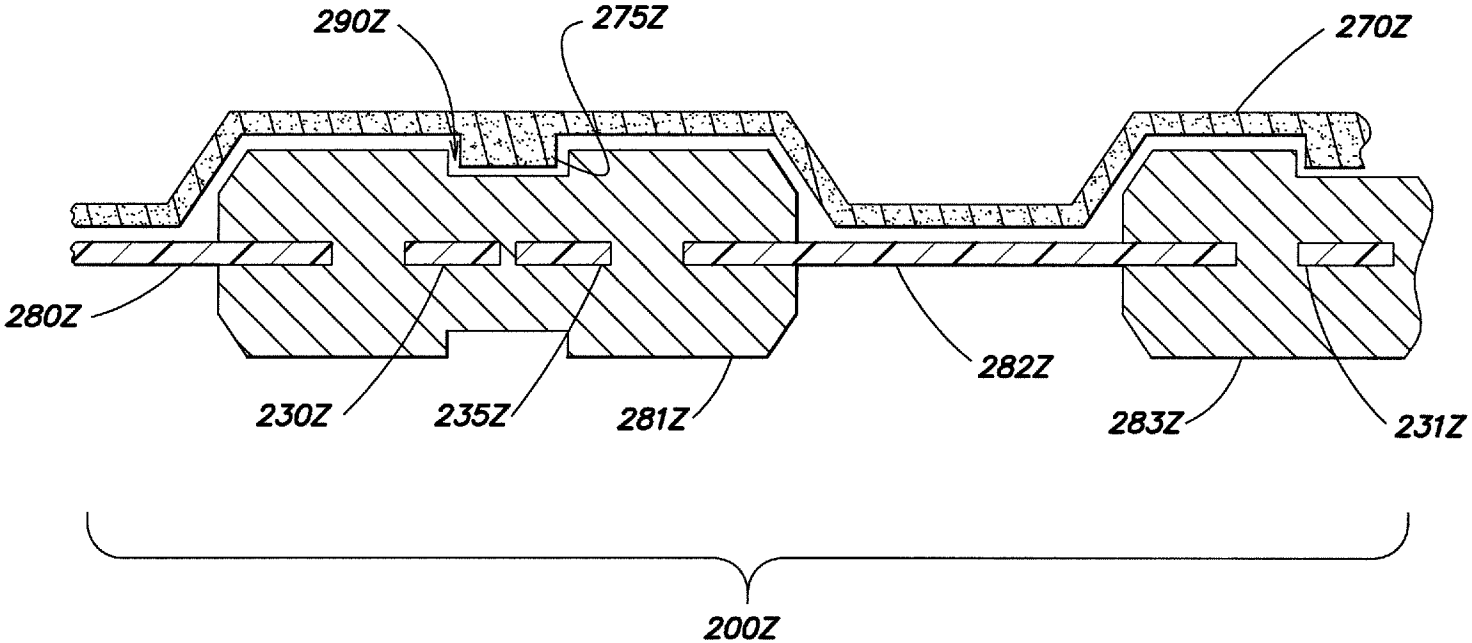
FIG. 2D is a cross-sectional view of a portion of an illustrative wafer half and a portion of an illustrative lossy insert, in accordance with some embodiments.

FIG. 2D shows a cross-sectional view of a portion of a wafer half 200Z and a portion of a lossy insert 270Z, in accordance with some embodiments. In this example, features are provided to deter relative movement between the wafer half 200Z and the lossy insert 270Z. Such a feature may be desirable for reducing a likelihood that the lossy insert 270Z dislodges from the wafer half 200Z during a manufacturing process, before a corresponding wafer half (not shown) is attached to the wafer half 200Z to form a wafer having the lossy insert 270Z incorporated therein.

In the example shown in FIG. 2D, the wafer half 200Z includes a plurality of conductive elements, such as the conductive elements 280Z, 230Z, 235Z, 282Z, and 231Z. The conductive elements 280Z and 282Z may be configured as ground conductors, while the conductive elements 230Z, 231Z, and 235Z may be configured as signal conductors.

Similar to the illustrative lossy insert 270 shown in FIG. 2C, the lossy insert 270Z may have a serpentine shape so that lossy material is disposed close to ground conductors (e.g., the conductive elements 280Z and 282Z) but away from signal conductors (e.g., the conductive elements 230Z, 231Z, and 235Z) when the lossy insert 270Z is incorporated into the wafer. The wafer half 200Z may further include one or more insulative portions (e.g., insulative portions 281Z and 283Z) that further insulate the lossy insert 270Z from the signal conductors and, in some embodiments, ground conductors.

Unlike the illustrative lossy insert 270 shown in FIG. 2C, the lossy insert 270Z in the example of FIG. 2D may have a protruding portion 275Z adapted to be inserted into a recess 290Z formed in the insulative portion 281Z. These features may be provided to deter relative movement between the wafer half 200Z and the lossy insert 270Z. In some embodiments, these features may function to attach the lossy insert 270Z to the wafer half 200Z, for example, via an interference or adhesive fit. In alternative embodiments, the protruding portion 275Z may move freely in a vertical direction, but lateral movement may be deterred by walls of the recess 290Z. In yet some further embodiments, a protruding portion may be formed in the insulative portion 281Z (rather than in the lossy insert 270Z), and a corresponding recess may be formed in the lossy insert 270Z (rather than in the protruding portion 281Z).

While specific examples of movement deterring features are discussed above in connection with FIG. 2D, it should be appreciated that other features may also be used for deterring relative movement between a wafer half and a lossy insert during a manufacturing process. For example, in alternative embodiments, an adhesive may be used for this purpose, without forming a recess in an insulative portion nor a protrusion on a lossy insert.

In some embodiments, lossy member 270 may be formed, such as by molding, from a lossy material. Materials that conduct, but with some loss, over the frequency range of interest are referred to herein generally as "lossy" materials. Electrically lossy materials can be formed from lossy dielectric and/or lossy conductive materials. The frequency range of interest depends on the operating parameters of the system in which such a connector is used, but may generally be between about 1 GHz and 25 GHz. Frequencies outside this range (e.g., higher or lower frequencies) may also be of interest in some applications. On the other hand, some connector designs may have frequency ranges of interest that span only a portion of this range, such as 1 to 10 GHz, 3 to 15 GHz, or 3 to 6 GHz.

Electrically lossy material can be formed from material traditionally regarded as dielectric materials, such as those that have an electric loss tangent greater than approximately 0.003 in the frequency range of interest. The "electric loss tangent" is the ratio of the imaginary part to the real part of the complex electrical permittivity of the material.

Electrically lossy materials can also be formed from materials that are generally thought of as conductors, but are either relatively poor conductors over the frequency range of interest, contain particles or regions that are sufficiently dispersed that they do not provide high conductivity, or otherwise are prepared with properties that lead to a relatively weak bulk conductivity over the frequency range of interest. Electrically lossy materials typically have a conductivity of about 1 siemans/meter to about $6.1\times10^7$ siemans/meter, preferably about 1 siemans/meter to about $1\times10^7$ siemans/meter, and most preferably about 1 siemans/meter to about 30,000 siemans/meter.

Electrically lossy materials may be partially conductive materials, such as those that have a surface resistivity between 1Ω/square and $10^6$Ω/square. In some embodiments, an electrically lossy material may be used that has a surface resistivity between 1Ω/square and $10^3$Ω/square. In some alternative embodiments, an electrically lossy material may be used that has a surface resistivity between 10Ω/square and 100 Ω/square. As a more specific example, an electrically lossy material may be used that has a surface resistivity of between about 20Ω/square and 40Ω/square.

In some embodiments, electrically lossy material is formed by adding to a binder a filler that contains conductive particles. Examples of conductive particles that may be used as a filler to form an electrically lossy material include carbon or graphite formed as fibers, flakes or other particles. Metal in the form of powder, flakes, fibers or other particles may also be used to provide suitable electrically lossy properties. Alternatively, combinations of fillers may be used. For example, metal plated carbon particles may be used. Silver and nickel are suitable metal plating for fibers. Coated particles may be used alone or in combination with other fillers, such as carbon flakes. In some embodiments, the conductive particles may be disposed in a lossy member generally evenly throughout, rendering a conductivity of the lossy member generally constant. In other embodiments, a first region of a lossy member may be made more conductive than a second region of the lossy member, so that the conductivity, and therefore an amount of loss within the lossy member, may vary.

The binder or matrix may be any material that will set, cure or can otherwise be used to position the filler material. In some embodiments, the binder may be a thermoplastic material such as is traditionally used in the manufacture of electrical connectors to facilitate molding of the electrically lossy material into desired shapes and locations as part of the manufacture of an electrical connector. However, many alternative forms of binder materials may be used. Curable materials, such as epoxies, can serve as a binder. Alternatively, materials such as thermosetting resins or adhesives may be used. Also, while the above described binder materials may be used to create an electrically lossy material by forming a binder around conducting particle fillers, other methods of forming an electrically lossy material may also be used. For example, conducting particles may be impregnated into a formed matrix material, or may be coated onto a formed matrix material, such as by applying a conductive coating to a plastic housing. As used herein, the term "binder" encompasses any material that encapsulates the filler, is impregnated with the filler, or otherwise serves as a substrate to hold the filler.

Preferably, the fillers will be present in a sufficient volume percentage to allow conducting paths to be created from particle to particle. For example, when metal fiber is used, the fiber may be present in about 3% to 40% by volume. The amount of filler may impact the conducting properties of the material.

Filler materials may be purchased commercially, such as materials sold under the trade name Celestran® by Ticona. A lossy material, such as lossy conductive carbon filled adhesive perform, such as those sold by Techfilm of Billerica, Mass., U.S. may also be used. This perform can include an epoxy binder filled with carbon particles. The binder surrounds carbon particles, which acts as a reinforcement for the perform. Such a perform may be shaped to form all or part of a lossy member and may be positioned to adhere to ground conductors in the connector. In some embodiments, the perform may adhere through the adhesive in the perform, which may be cured in a heat treating process. Various forms of reinforcing fiber, in woven or non-woven form, coated or non-coated, may be used. Non-woven carbon fiber is one suitable material. Other suitable materials, such as custom blends as sold by RTP Company, can also be employed, as the present disclosure does not require any particular type of filler material.

Returning to the example illustrated in FIG. 2C, the projecting portions 281Y, 283Y, and 285Y may be adjacent to conductive elements in the wafer half 200Y that are configured to be signal conductors. Likewise, the cavities 280Y, 282Y, and 284Y may be aligned with conductive elements configured as ground conductors. In some embodiments, conductive elements configured as ground conductors in adjacent groups of four (e.g., conductive elements 290Y and 292Y) may be joined to a common, generally planar intermediate portion that is conductive and that spans the distance between the adjacent groups. In the example illustrated in FIG. 2C, such a planar conductive portion may be in the floor of a cavity (e.g., the cavity 282Y) on the inner surface of the wafer half 200Y.

In some embodiments, the planar conductive portion may be exposed such that the lossy member 270 may press against the planar conductive portion. In such an embodiment, the lossy member 270 may make Ohmic contact with the planar conductive portion. However, it is not a requirement that lossy member 270 make such Ohmic contact, and the planar conductive portion may be partially or totally separated from lossy member 270 by insulative material of the insulative portion 210Y of the wafer half 200Y. Even if the lossy member 270 does not make Ohmic contact with the conductive elements designated as ground conductors, shaping lossy member 270 such that portions of the lossy member 270 are in close proximity to portions of the ground conductors provides coupling between the ground conductors and lossy member 270. This coupling may dampen resonances that may form in the grounding system of the connector.

As can be seen in the example of FIG. 2C, lossy member 270 may have a serpentine shape, winding along the channel formed between wafer halves 210X and 210Y as the lossy member 270 is routed alternately closer to the ground conductors and farther from the signal conductors in the wafer halves 210X and 210Y.

Such a corrugated structure may also impart some spring-like properties to the lossy member 270, which may allow the lossy member to press against the inner surfaces of the wafer halves 200X and 200Y when the wafer halves 200X and 200Y are secured together. This structure may facilitate good contact between the lossy member 270 and one or more conductive elements designated as ground conductors, if such conductive elements are totally or partially exposed in a floor of a cavity (e.g., any of the cavities 280Y, 282Y, and 284Y). This structure also may facilitate more uniform electrical properties from part to part, despite routine manufacturing variations.

While FIG. 2C illustrates some specific designs and arrangements of connector wafer elements, it should be appreciated that such designs and arrangements are provided solely for purpose of illustration. Other designs and/or arrangements may also be suitable, as the various inventive concepts disclosed herein are not limited to any particular mode of implementation.

Turning now to FIGS. 3A-D, an alternative design for an illustrative wafer half 300 is shown, in accordance with some embodiments of the present disclosure Like the wafer halves 200X and 200Y shown in FIGS. 2A-C, the wafer half 300 may be joined with another like wafer half to form a wafer that is suitable for use in a connector such as the connector 100A shown in FIG. 1A.

Wafer half 300 may be constructed using components and techniques as described above in connection with wafer halves 200X and 200Y. However, as can be seen in FIG. 3A, the beams of the conductive elements of wafer half 300 have a different configuration than the beams of wafer halves 200X and 200Y.

Figure 3A:
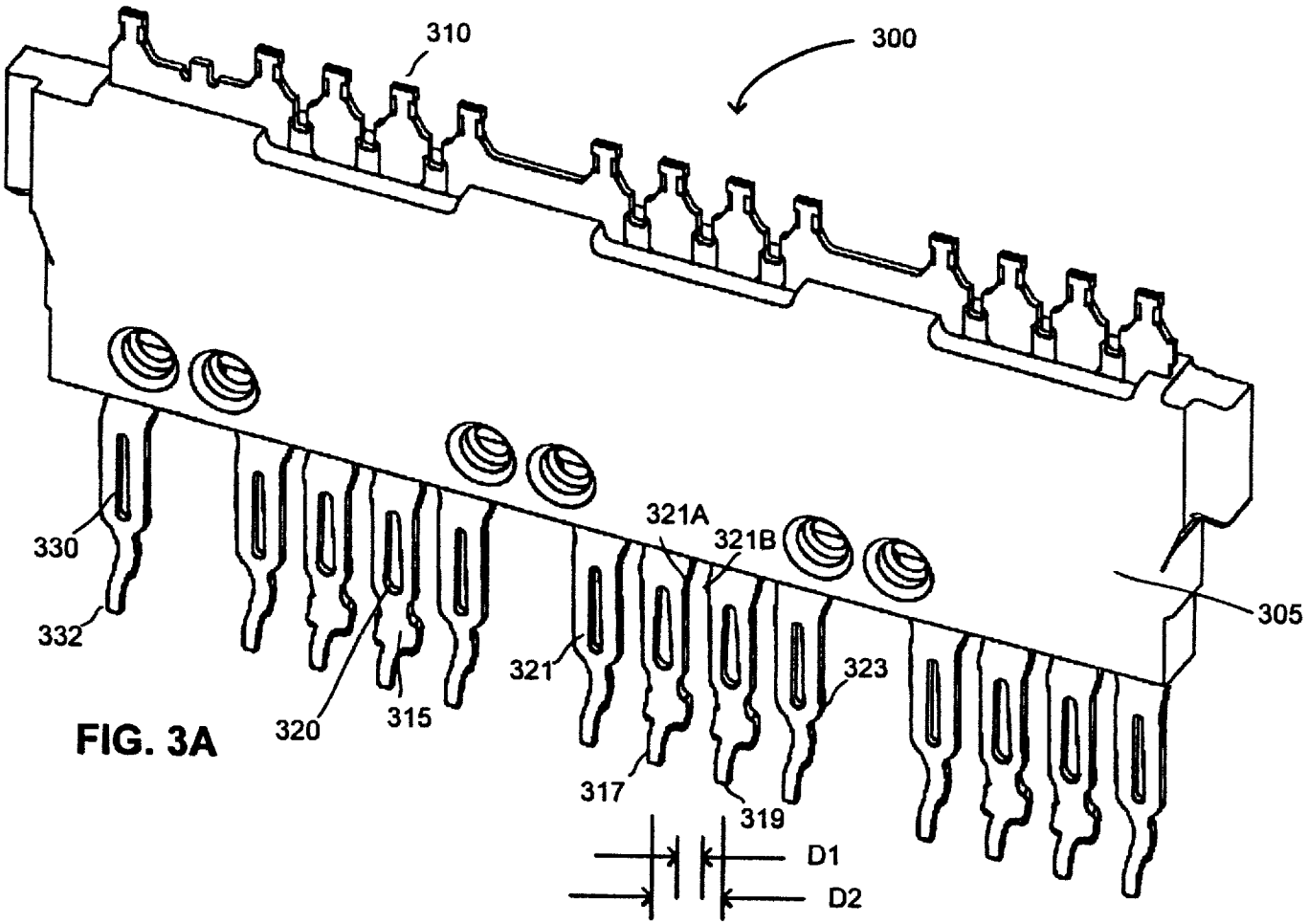
FIG. 3A is a perspective view of a front side of an illustrative wafer half, in accordance with some embodiments.

FIG. 3A is a perspective view of a front side of the illustrative wafer half 300. In this example, the wafer half 300 may include an insulative portion 305 at least partially enclosing a plurality of conductive elements. Each conductive element may have a contact tail (e.g., contact tail 310 shown in FIG. 3A) for attachment to a PCB, and a beam-shaped mating contact portion (e.g., beam 315 shown in FIG. 3A) for mating with a pad-shaped mating contact portion of a corresponding conductive element in a mating connector. The beam 315 may have a shape that is different from the beams of the wafer halves 200X and 200Y shown in FIGS. 2A-C. For example, the beam 315 may have a cutout 320 shaped to provide enhanced electrical properties.

As a more specific example, the cutout 320 may be located in a middle portion of the beam 315, and may have an elongated teardrop shape that is narrower towards a boundary of the insulative portion 305 and wider towards a distal end of the beam 315. This configuration may improve uniformity of mechanical and/or electrical properties along a length of the beam 315. For example, by controlling a size and/or shape of the cutout 320, and hence an amount of conductive material removed at various locations along the beam 315, a desirable impedance value may be achieved, such as 85 or 100 Ohms.

In the example illustrated in FIG. 3A, incorporating a cutout 320 in each of the beams allows a position of the outer edges of the beams to be positioned independently of the amount of material in the beams. For example, adjacent beams 317 and 319 have facing edges 321A and 321B, respectively. Beams 317 and 319 may be separated by a distance $D_2$. This separation may be determined by a desired pitch of the connector or other factors. When beams 317 and 319 form portions of conductive elements used to carry a differential signal, the spacing $D_1$ between edges 321A and 321B may impact the impedance of the conducting path for such a differential signal. Similar spacings of edges of beams 317 and 319 relative to other adjacent beams, such as beams 321 and 323, which may form portions of ground conductors, may similarly impact the impedance.

Accordingly, beams such as beams 317 and 319 may be formed with an edge-to-edge width designed to position the edges of beams 317 and 319 with a suitable spacing relative to adjacent beams. The inventors have recognized and appreciated that forming beams with desired edge positioning to achieve desired electrical properties may have undesirable mechanical properties. For example, achieving a desired edge-to-edge spacing of $D_1$ while maintaining a center line-to-center line spacing of $D_2$ may result in beams that are wider, and therefore stiffer, than desired. By incorporating a cutout, such as cutout 320, in the beams, the stiffness of the beams may be reduced relative to a beam formed without such a cutout. Cutouts 320 may be shaped to provide a stiffness for beams such as beams 317 and 319 equivalent to the stiffness of beams such as beams 230X and 235X in the example illustrated in FIG. 2C.

Further, the shape of the cutout 320 may be selected to distribute the spring forces along the length of the beam. In the example illustrated in FIG. 3A, the pear-shaped cutout 320 results in a wider cutout and less beam material towards the distal tip of the beam. Such a configuration provides a distribution of spring forces along the length of the beam that approximates the distribution of forces achieved with a tapered beam. Accordingly, appropriate selection of the size and shape of cutouts 320 provides desired mechanical properties for the beams while achieving desired electrical properties.

In the embodiment illustrated in FIG. 3A, beams shaped for different functions may have differently shaped cutouts. For example, cutout 330 is illustrated in a beam 332 serving as a mating contact portion of a ground conductor. In this example, beam 332 has a narrower distal portion than beam 315. Accordingly, cutout 300 in beam 332 is narrower than cutout 320 in beam 315. Though not a requirement of the invention, choosing cutouts with different dimensions for beams with different dimensions can equalize the stiffness of all of the beams in a wafer half 300. Any suitable dimensions may be used for $D_1$ and $D_2$ and for the length, width and overall shape of the cutouts, such as cutouts 320 and 330. In some embodiments, the dimension $D_1$ may be between 0.1 mm and 0.5 mm and the dimension $D_2$ may be between 0.5 mm and 2 mm. In some embodiments, the dimension $D_1$ may be approximately 0.3 mm, and may approximate the edge-to-edge spacing of intermediate portions of the conductive elements carrying signals (which are not visible in FIG. 3A). Some or all of the dimensions may depend on other characteristics of the connector. For example, the size and shape of the cutouts, such as cutouts 320 and 330, may depend on the overall length of the portion of the beams, such as beams 317, 319, and 332 extending from the insulative portion 305 of wafer half 300. However, as an example, these dimensions may be approximately: 2 mm to 5 mm for the length of the beams, 0.5 mm to 1.5 mm for the width of the beams, 1 mm to 2 mm for the length of the cutouts, and 0.1 mm to 0.5 mm for the with of the cutouts.

Figure 3B:
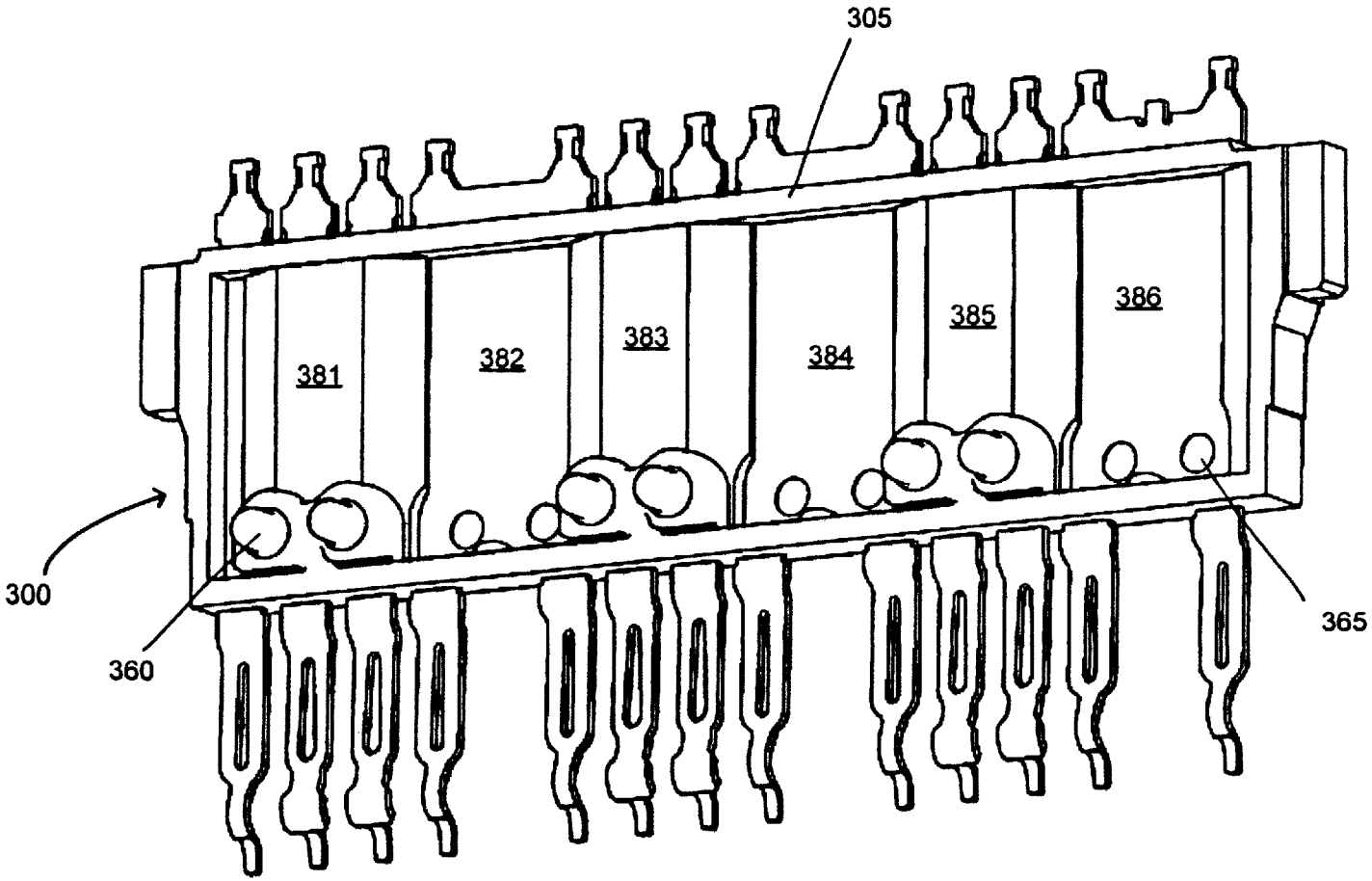
FIG. 3B is a perspective view of a back side of the illustrative wafer half shown in FIG. 3A.

FIG. 3B is a perspective view of a back side of the illustrative wafer half 300, which will form an inner surface of a wafer when wafer half 300 is attached to another similarly shaped wafer half. In this view, that inner surface and the insulative portion 305 is visible, including cavities 382, 384, and 386, and projections 381, 383, and 385. Also visible are a plurality of posts and a plurality of holes. The posts may be formed on the insulative portion 305, including post 360, which may be adapted to extend through a corresponding hole formed on another wafer half (not shown) to attach the wafer half 300 and the other wafer half through an interference fit between the post 360 and the corresponding hole. The corresponding hole in the other wafer half may be similarly located as hole 365 in the wafer half 300. In the illustrated example, the holes, such as hole 365, pass through portions of the wafer half 300 containing a planar portion of a conductive element configured to act as a ground conductor. Deformation of the plastic posts, such as post 360, when pressed through a hole in the metal sheet provides a secure connection between the wafer halves. Though, it should be appreciated that any suitable mechanism for securing a post, such as post 360, in a hole, such as hole 365, may be used.

Figure 3C:
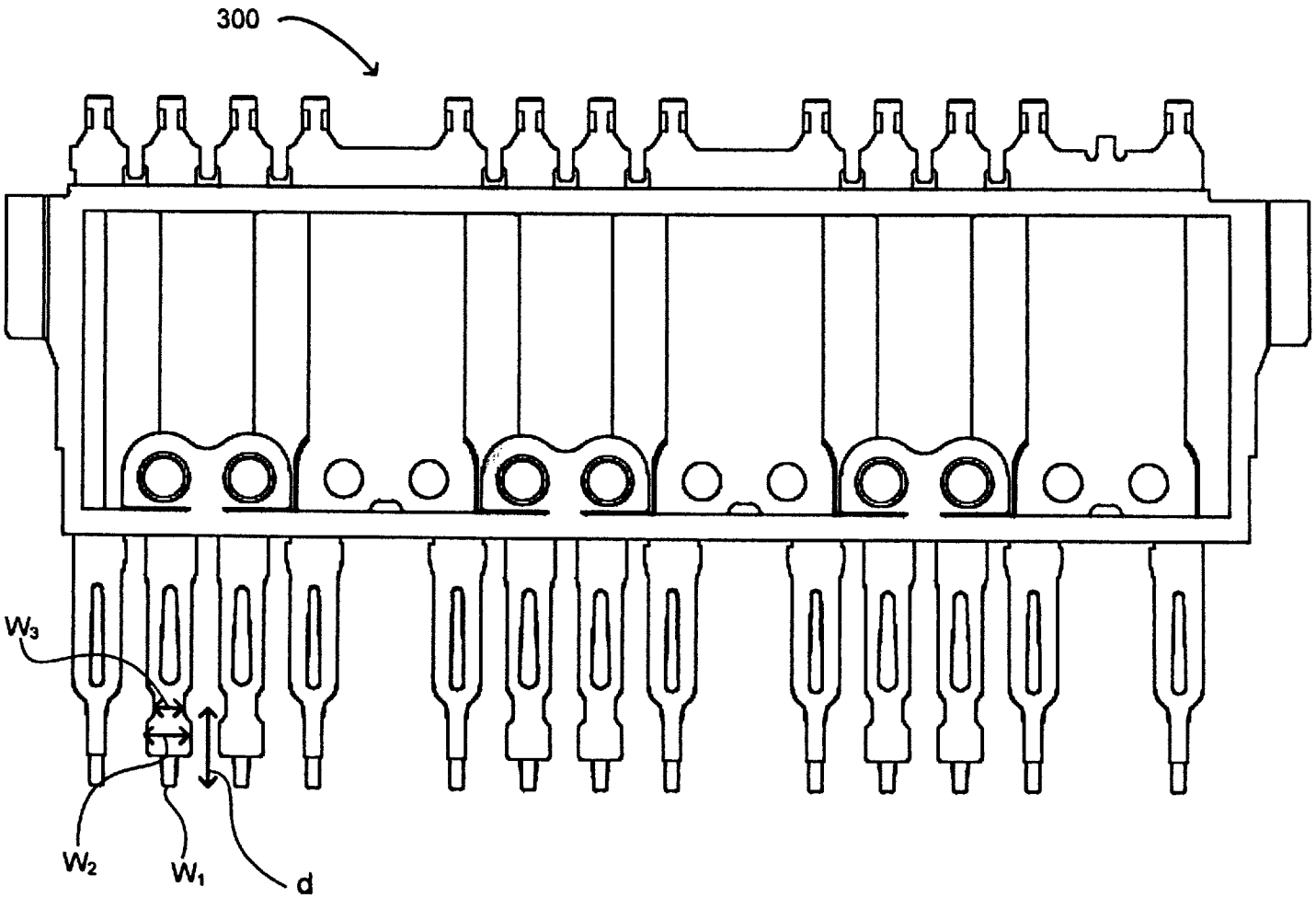
FIG. 3C is a plan view of the back side of the illustrative wafer half shown in FIG. 3A.

FIG. 3C is a plan view of a back side of the illustrative wafer half 300. The shape of the beam 315 can be seen in this view, including several changes in width. For example, the beam 315 may have a narrow tab at the distal end. A width $w_1$ of the tab may be between 0.1 mm and 0.3 mm. Above the narrow tab, the beam 315 may widen to a width $w_2$ in a contact region, which may be between 0.5 mm and 1 mm. Further up, the beam 315 may narrow again slightly at a neck portion having a width $w_3$, which may be between 0.2 mm and 0.5 mm The widened contact region may provide additional float, as described in greater detail below. The neck portion may be provided to offset a change in impedance that may result from the widened contact region.

Although the beam 315 undergoes multiple changes in width between the tab and the neck portion, these changes may not have significant impact on electrical properties (e.g., impedance) of the beam 315 because they take place over a distance d that may be small relative to a wavelength λ associated with a signal frequency of interest. For example, the beam 315 may be part of a conductive element configured as a signal conductor for carrying signals in a frequency range between 1 GHz-25 GHz, and the associated range of wavelengths may be 12 mm to 300 mm. Though, in some embodiments, the operating frequency of high frequency signals will be in the range of 3 GHz to 8 GHz, and the associated range of wavelengths may be 37.5 mm to 100 mm. If the distance d between the tab and the neck portion is no more than half of the wavelength λ, for example, no more than 18 mm, then the changes in width may not have any significant impact on the impedance of the beam 315. Accordingly, in some embodiments, the distance d may be between 0.2 mm and 2 mm, or between 0.2 mm and 1 mm, or between 0.2 mm and 0.5 mm, so as reduce any change in impedance of the beam 315. As a more specific example, the distance d may be around 4.2 mm or 4.3 mm.

Figure 3D:
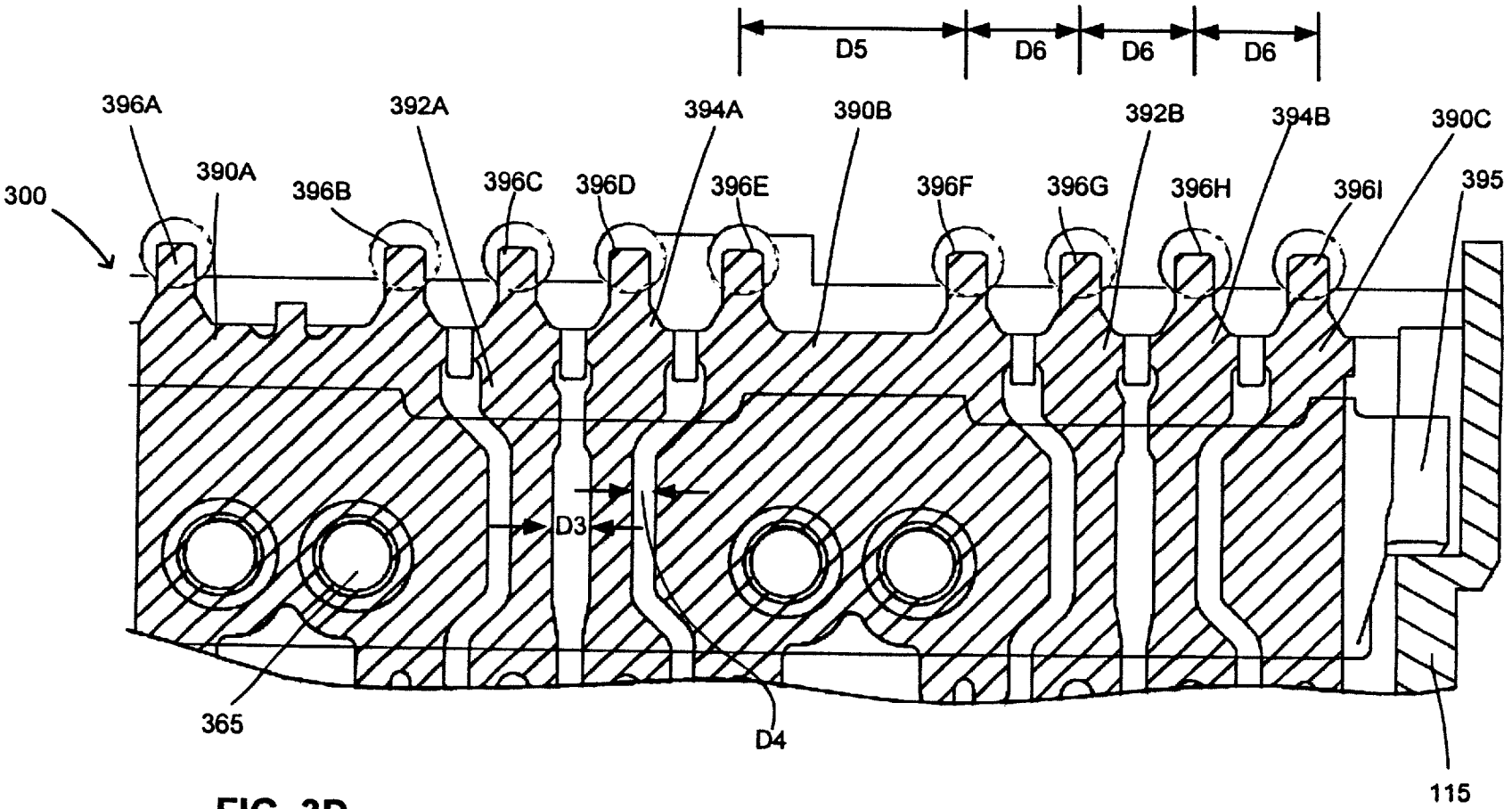
FIG. 3D is a cross sectional view through a portion of the illustrative wafer half shown in FIG. 3A.

FIG. 3D is a cross sectional view through a portion of a wafer 300. In the view illustrated in FIG. 3D, intermediate portions of the conducted elements within the wafer 300 are visible. The portion of wafer 300 illustrated in FIG. 3D contains intermediate portions of two pairs of signal conductors, shown as intermediate portions 392A and 394A, forming a first pair, and intermediate portions 392B and 394B forming a second pair.

Also visible in FIG. 3D are intermediate portions of ground conductors. Here, intermediate portions 390A, 390B, and 390C are shown. As can be seen, the intermediate portions of the ground conductors are wider than the intermediate portions of the signal conductors. As shown, intermediate portions of the ground conductors generally span the distance between adjacent pairs of signal conductors within a column. As a specific example, FIG. 3D shows intermediate portion 390B generally spanning the distance between intermediate portions 392B and intermediate portion 394A, which are signal conductors of adjacent pairs.

The widths of conductor intermediate portions (e.g., the intermediate portions 390A-C, 392A-B, and 394A-B) may be varied to achieved desired spacing between adjacent intermediate portions. For example, in some embodiments, a desired distance between intermediate portions of signal conductors (e.g., $D_3$ as shown in FIG. 3D) may be about 0.25 mm for an 85Ω connector and about 0.35 mm for a 100Ω connector. Similarly, in some embodiments, a desired distance between intermediate portions of a signal conductor and a ground conductor (e.g., $D_4$ as shown in FIG. 3D) may be about 0.37 mm for an 85Ω connector and about 0.45 mm for a 100Ω connector. Such changes in spacing between adjacent intermediate portions may be done without varying the spacing between external features such as the contact tails 396A-I. For example, in some embodiments, a distance between contact tails of a ground conductor (e.g., $D_5$ as shown in FIG. 3D) may be about 2.3 mm, while a distance between contact tails of adjacent conductors in a group of four conductors having a ground-signal-signal-ground pattern (e.g., $D_6$ as shown in FIG. 3D) may be about 1.15 mm, regardless of the spacing between adjacent intermediate portions of the same conductors. This may facilitate attachment to PCBs without requiring changes to mating interfaces on the PCBs.

In the example illustrated, intermediate portion 390C is approximately half the width of intermediate portion 390B. Intermediate portion 390C is at the end of the column of conductive elements within wafer 300. In embodiments in which wafer 300 includes only two pairs of signal conductors, intermediate portion 390A may form the opposing end of the column. In embodiments in which additional pairs of conductive elements are included in wafer 300, intermediate portion 390A may be shaped like intermediate portion 390B, and a further pair, having a configuration such as intermediate portions 392A and 394A, may be positioned adjacent intermediate portion 390A. Accordingly, though FIG. 3D illustrates only a portion of a column of conductive elements that may be formed within a wafer, the wafer may be extended to include any suitable number of columns by including further conductive elements in the pattern illustrated in FIG. 3D.

FIG. 3D illustrates other construction techniques that may be employed in some embodiments of a wafer. As can be seen, holes 365 are formed through intermediate portions of ground conductors, such as intermediate portions 390A and 390B. Further, contact tails, such as contact tails 396A, 396B, . . . 396I are shown extending from the intermediate portions of the conductive elements. Attachment locations for solder balls are shown in phantom upon contact tails 396A . . . 396I. Further, a projecting portion 395 of a wafer 300 is shown engaging a feature (e.g., a shoulder) in shell 115. Such a feature may establish a position of the wafer, which in turn may establish a position of the contact tails and solder balls relative to the shell 115. Such a feature may be included for each wafer, resulting in the solder balls attached to all of the wafers being positioned in a common place.

Figure 4A:
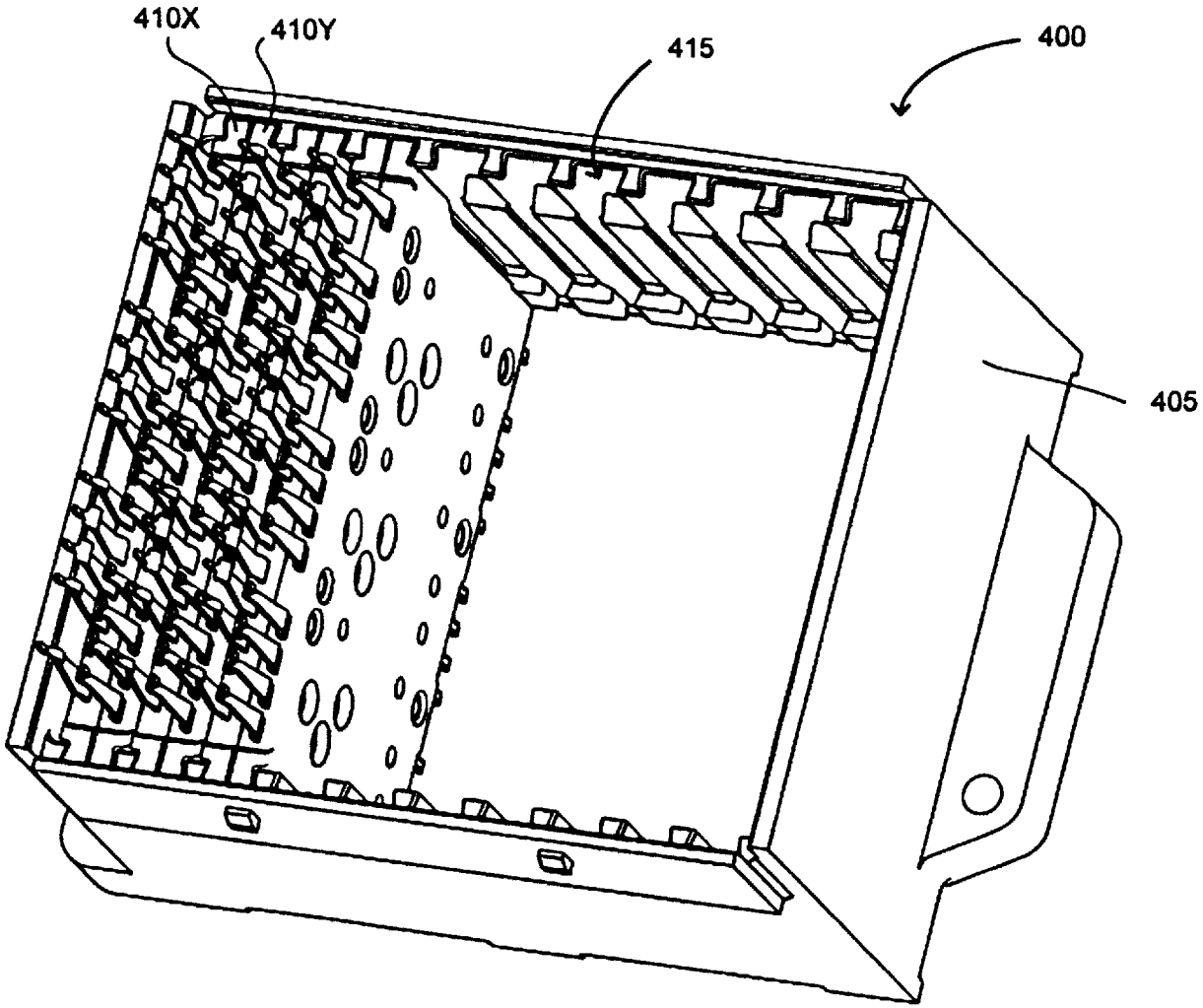
FIG. 4A is a perspective view of another illustrative connector suitable for use in an interconnection system, in accordance with some embodiments.

FIG. 4A is a perspective view of an illustrative connector 400, in accordance with some embodiments of the present disclosure. Like the connector 100A shown in FIG. 1A, the connector 400 may be suitable for use in an interconnection system with a two-piece connector.

In FIG. 4A, the connector 400 is shown from a direction of a mating face adapted to mate with the other connector in the two-piece connector. In this example, the connector 400 has a housing made of two separable pieces, a rectangular tube-like shell 405 having parallel grooves formed on the inside of two opposing sidewalls for receiving a plurality of wafers, and a slotted cover (not shown) that partially encloses the shell at the mating face of the connector 400. The slotted cover 420 is shown in FIG. 4C and described in greater detail below. Alternatively, FIG. 4A may depict an embodiment in which no cover is used on the mating face of the connector 400.

In the example shown in FIG. 4A, a plurality of wafers are aligned in parallel in the shell 405, including a wafer formed by wafer halves 410X and 410Y. The shell 405 has parallel opposing sides with grooves formed on the inside walls, such as groove 415. The wafers may be inserted into the grooves and secured, for example, using a rigid attachment mechanism such that the wafers themselves become support members for the shell. Such an attachment may include adhesives, welding, and/or any other suitable attachment mechanisms. Some attachment mechanisms, such as adhesives, may completely prevent vertical movement of an attached wafer (e.g., up and down along a groove). Other attachment mechanisms may allow a restricted amount of vertical movement along the groove, but may prevent the attached wafer from sliding completely out of the groove. An example of this latter type of attachment mechanism is described below in connections with FIGS. 5A-B.

Figure 4B:
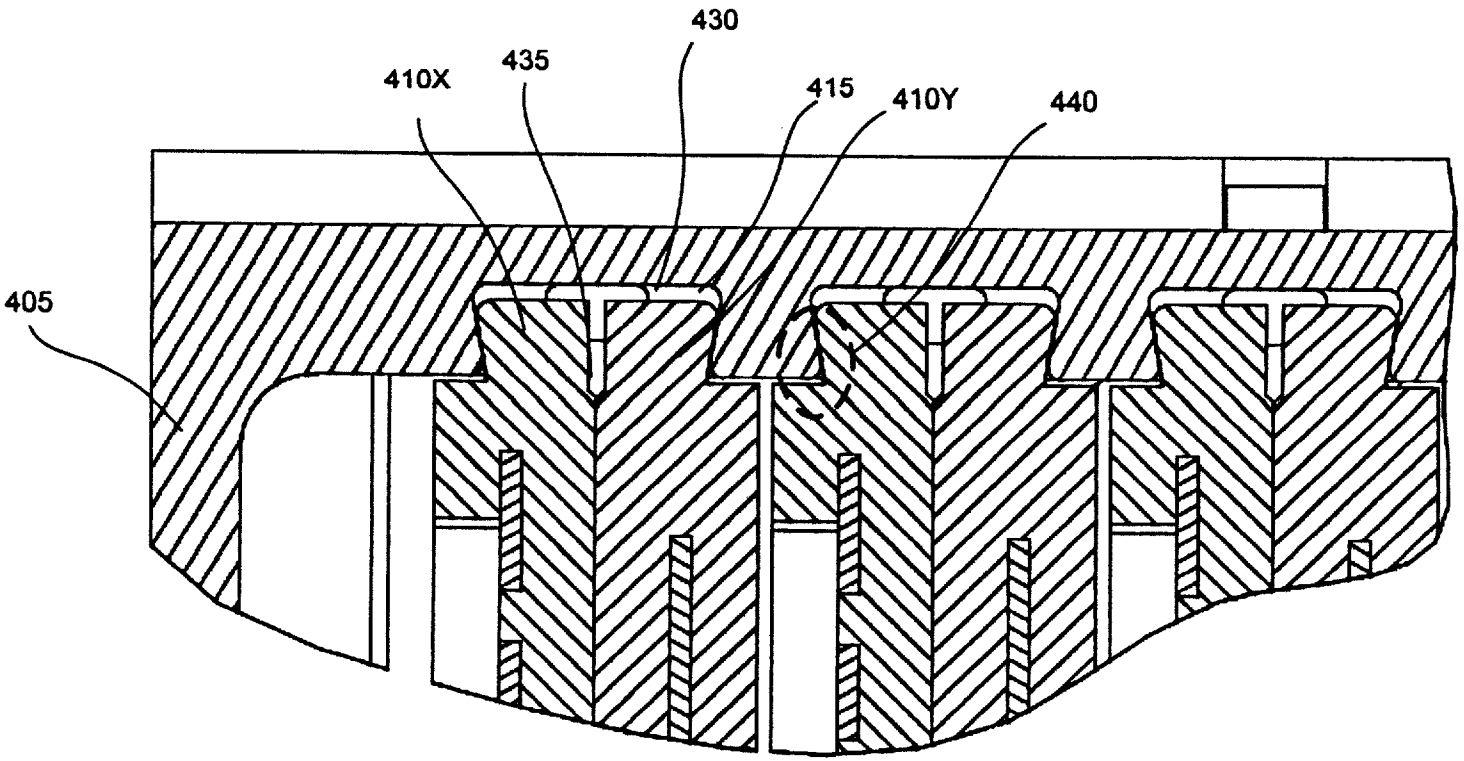
FIG. 4B is a cross-sectional view of a portion of the illustrative connector shown in FIG. 4A, taken along a plane that is parallel to a mating face.
Figure 4C:
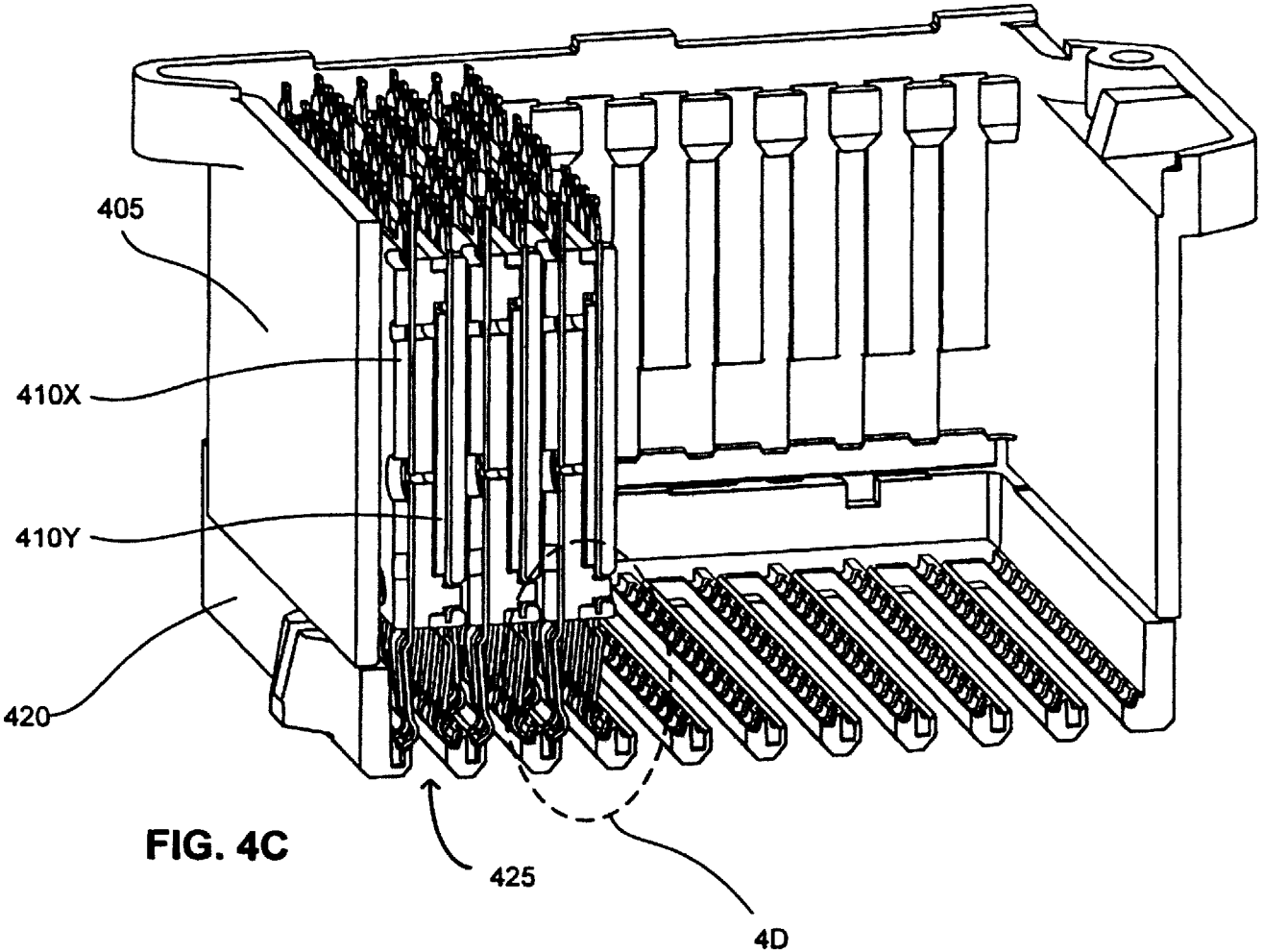
FIG. 4C is a cross section through the illustrative connector shown in FIG. 4A.

FIG. 4B shows a cross-sectional view of a portion of the connector 400 taken along a plane that is parallel to the mating face of the connector 400 and perpendicular to the grooves formed on the side walls of the shell 405. Partial cross-sections of three wafers are shown in this view, including the wafer formed by the wafer halves 410X and 410Y. Each wafer has a dove-tail projection at an end, adapted to be inserted into a groove of the shell 405. Each groove also has a dove-tail shape, conforming to the shape of a wafer end. This configuration may substantially prevent lateral and rotational movement of a wafer inserted into a groove, thereby providing a relatively rigid attachment between the inserted wafer and the shell 405.

In this example, the wafer halves 410X and 410Y are shaped to provide a gap 430 between the projections of the wafer halves and a floor of groove 415. Such a gap may provide a suitable amount of clearance to facilitate insertion of the projections into the groove 415 during an assembly process. The wafer halves 410X and 410Y may be further shaped to provide another gap 435 between the projections of the wafer halves, which may help to ensure that the projections of the wafer halves will fit into the groove 415 despite manufacturing variances in the wafer halves and/or the shell 405. Furthermore, the fit between the projections of wafer halves and sidewalls of a groove (e.g., as indicated by a dashed oval 440 in FIG. 4B) may be relatively snug, which may serve as a locating feature to facilitate proper alignment of the wafers inserted into the shell 405.

Although dove-tail shaped wafer projections and grooves may provide some mechanical advantages as discussed above, it should be appreciated that the present disclosure does not require the use of dove-tail shaped wafer projections and grooves. Other suitable attachment mechanisms, such as conventional straight-sided wafer projections and grooves, may also be used.

FIG. 4C is a cross section through the connector 400 shown in FIG. 4A. However, the embodiment of FIG. 4C includes an illustrative cover 420 that engages the shell 405 and partially encloses the mating face of the connector 400. The cover 420 includes slots, such as slot 425, through which wafers of a corresponding connector may be inserted to mate with wafers of the connector 400.

In the example shown in FIG. 4C, beam-shaped mating contact portions from each wafer half of a same wafer are positioned along opposite sides of a same slot formed in the cover 420, so that tabs extending from the beam-shaped mating contact portions of each wafer half engage a recess along a corresponding edge of the slot. For example, tabs extending from beams of the wafer half 410X engage a recess along one side of slot 425, while tabs extending from beams of the wafer half 410Y engage a recess along the opposite side of the slot 425. This configuration allows the beams to be shaped so that spring force in the beam biases the beams on opposing sides of a slot together, while preventing distal ends of the beams from extending into the slot 425. Accordingly, such a configuration reduces a likelihood that a beam may be damaged (e.g., stubbed) upon insertion of a wafer of a corresponding connector into the slot 425. In some embodiments, the beams may formed so as not to be biased into the slot 425. However, such spring bias may improve mechanical and/or electrical connections between the beams and corresponding pad-shaped mating contact portions of the wafer inserted into the slot 425.

FIG. 4C also reveals an illustrative manufacturing approach. The wafers illustrated may be inserted into the shell 405 with sufficient force that the tabs of a wafer half engage with a corresponding recess along an edge of a corresponding slot. Each wafer may be inserted to a point that contact tails of the installed wafers are aligned substantially on a same plane. Each wafer may then be secured in this position using any suitable fastening technique. In this way, the contact tails of the installed wafers will collectively form an array that is planar and parallel to an attachment face of the connector 400 (e.g., within limits of manufacturing tolerances). Such a construction technique may improve planarity of the contact tail array, which may in turn improve reliability of electrical connections formed when the connector 400 is soldered onto a PCB.

While various advantages of the embodiment illustrated in FIG. 4C are described above, it should be appreciated that the various inventive concepts disclosed herein are not limited to any particular manner of implementation. For example, the connector 400 may be made with or without the slotted cover 420, or with another cover that is differently shaped.

The inventors have recognized and appreciated that, in some applications, it may be desirable to omit selected wafers from a shell. For instance, in some embodiments, one or more wafers in a connector may be used to carry power. A wafer carrying power may have fewer, but wider conductive elements than a wafer with signal conductors as described above. Additionally, a wafer carrying power may have no lossy insert captured between the wafer halves, and each wafer half may carry electrical currents of about 1 A to 2 A per termination. For instance, in the example of FIG. 3A, the wafer half 300 includes 13 terminations and therefore may be suitable for carrying a current of about 13 A. When a wafer is used to carry power at a sufficiently high voltage (e.g., higher than 38V or, more specifically, 48V), it may be desirable to provide additional space between wafers for electrical clearance. For example, it may be desirable not to have any other wafer installed immediately adjacent to a wafer carrying power.

The inventors have further recognized and appreciated that a support member, such as a "dummy" wafer, may be installed in a shell where a "real" wafer having conductive elements is omitted (e.g., to provide electrical clearance for a wafer carrying power). Such a dummy wafer may be made of an insulative material (e.g., molded plastic) and may have similar shapes, dimensions, and/or attachment features as a real wafer (e.g., dovetail pieces at either end for insertion into grooves formed in a shell). As explained below in connection with FIG. 4D, the presence of such a dummy wafer may improve structural integrity of a shell in which one or more real wafers are omitted.

Figure 4E:
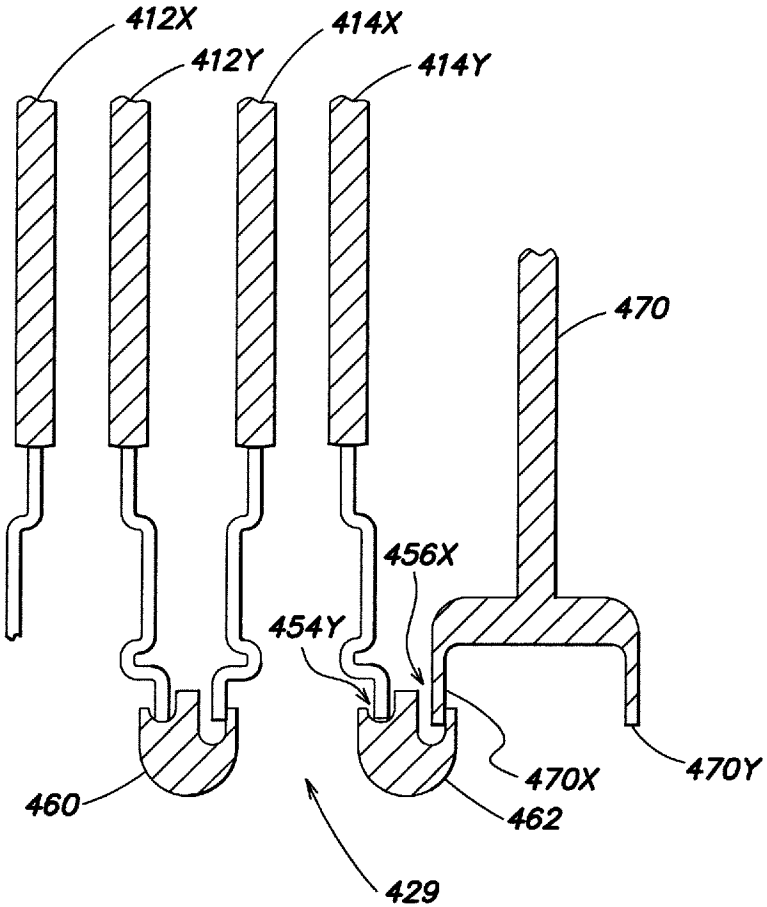
FIG. 4E shows the same view as FIG. 4D, with the addition of an illustrative dummy wafer installed in the illustrative connector, in accordance with some embodiments.
Figure 4D:
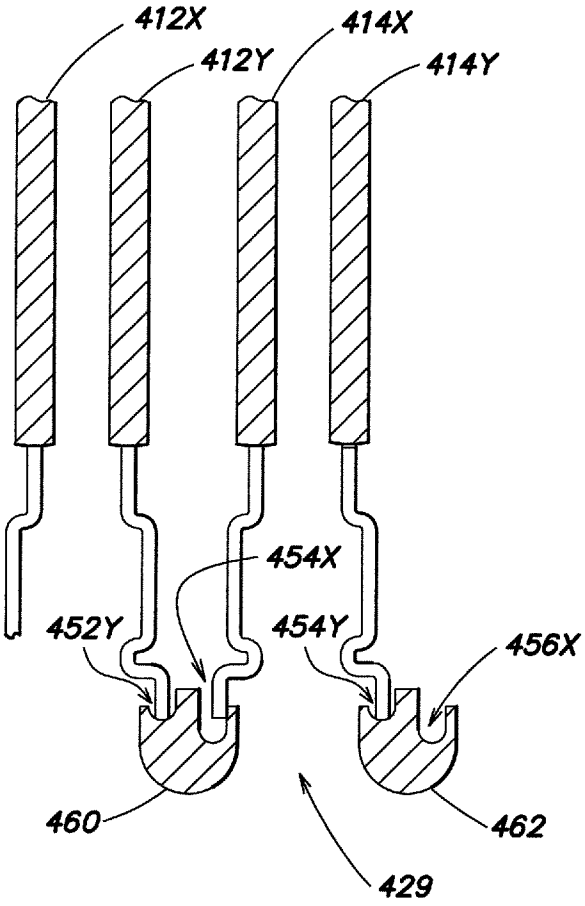
FIG. 4D is a schematic view of an enlarged cross section at an area 4D, as indicated in FIG. 4C.

FIG. 4D is a schematic view of an enlarged cross section at an area 4D, as indicated in FIG. 4C. This view shows wafer halves 412X and 412Y, which together form a wafer, and wafer halves 414X and 414Y, which together form another wafer installed adjacent to the wafer half 412Y. This view also shows recesses 452Y, 454X, 454Y, and 456X formed in the cover 420, with a slot 429 formed between the recesses 454X and 454Y.

In the example shown in FIG. 4D, tabs extending from beams of the wafer halves 412Y and 414X are inserted into, respectively, the recesses 452Y and 454X. As discussed above in connection with FIG. 4C, each beam may be shaped so as to exert a spring force on a wall of the recess into which the beam is inserted. Thus, the beams of the wafer halves 412Y and 414X may exert spring forces on a portion 460 of the cover 420 in which the recesses 452Y and 454X are formed, with the beams of the wafer half 412Y pulling in one direction and the beams of the wafer half 414X pulling in the opposite direction. As a result, the spring forces generated by the beams of the wafer halves 412Y and 414X may cancel each other.

Similarly, in the example shown in FIG. 4D, tabs extending from beams of the wafer half 414Y are inserted into the recess 454Y. However, because no wafer is installed adjacent to the wafer half 414Y, no tabs are inserted into the recess 456X, so that the beams of the wafer half 414Y may exert spring forces on a portion 462 of the cover 420 in which the recesses 454Y and 456X are formed, without any counteracting forces in the other direction. Such imbalance may cause the portion 462 to bend, which may interfere with a wafer of a corresponding connector being inserted into the slot 429.

Accordingly, in some embodiments, a support member, such as a dummy wafer, may be inserted into the shell 405 at a location where a real wafer having conductive elements is not inserted. One such embodiment is illustrated in FIG. 4E, which shows the same view as FIG. 4D, with the addition of a dummy wafer 470 installed adjacent to the wafer half 414Y. In this example, the dummy wafer 470 has one or more tabs 470X adapted to be inserted into the recess 456X of the portion 462 of the cover 420. Once inserted into the recess 456X. the tabs 470X may provide forces that cancel out the spring forces generated by the beams of the wafer half 414Y, thereby preventing the portion 462 from bending into the slot 429. The dummy wafer may additionally include tabs 470 adapted to be inserted into a recess formed in another portion of the cover 420 (not shown) to prevent that other portion from bending.

In this example, each dummy wafer may be molded from an insulative material, such as a material used to form a housing of the connector. The dummy wafer may have a width and an outer envelope matching a signal or power wafer, but need not contain any conductive elements. It should be appreciated that any suitable number of support members may be used in a connector, as aspects of the present disclosure are not limited in this respect. For instance, a support member may be used at every location where a real wafer is not inserted. Alternatively, support members may be used only at some, but not all, of the locations at which real wafers are not inserted. Further still, while support members may be beneficial, aspects of the present application are not limited to using any support members at all.

Figure 5A:
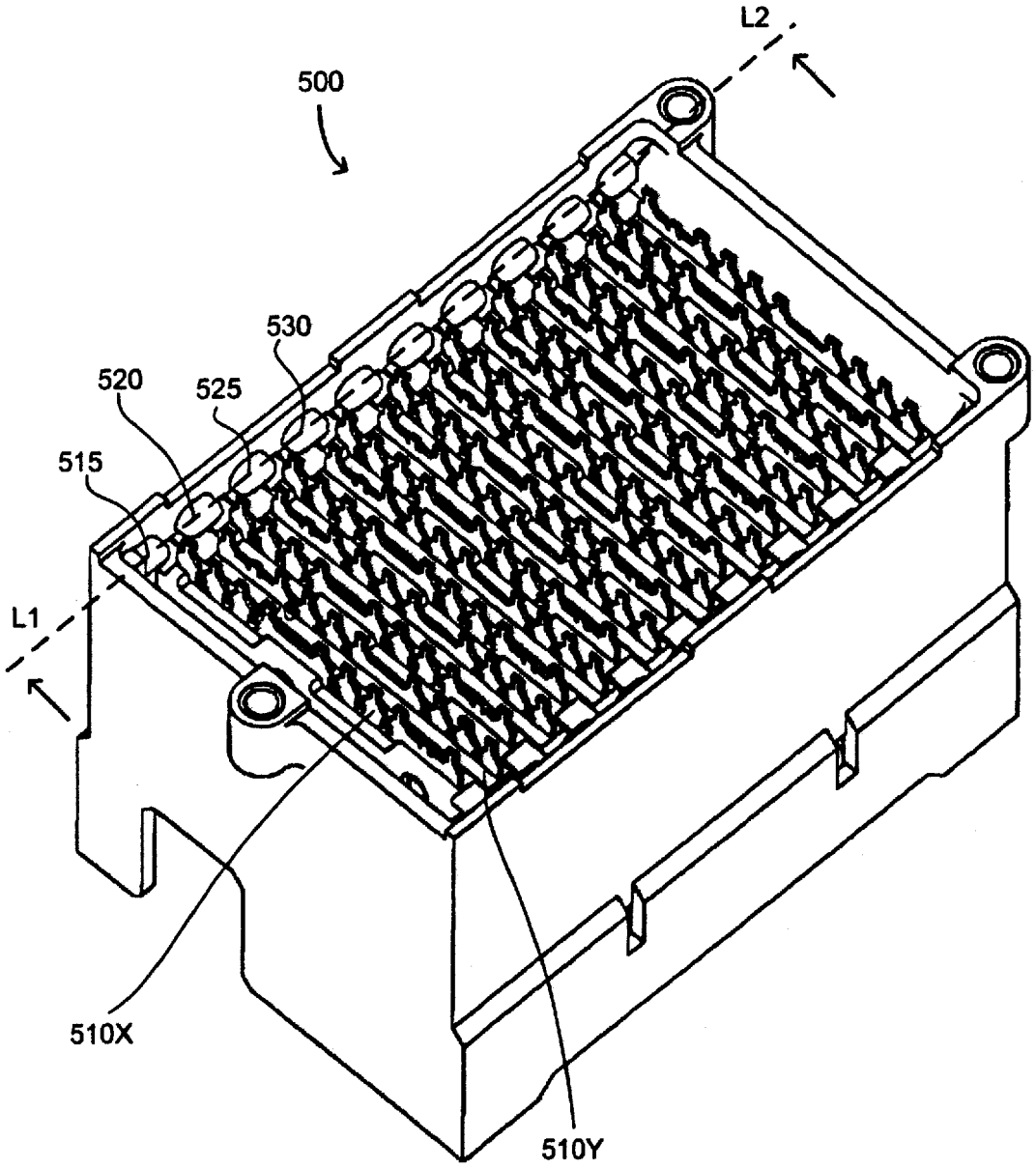
FIG. 5A is a perspective view of yet another illustrative connector suitable for use in an interconnection system, in accordance with some embodiments.

FIG. 5A is a perspective view of an illustrative connector 500, in accordance with some embodiments of the present disclosure. Similar to the connector 100B shown in FIG. 1B, the connector 500 may be suitable for use as a portion of a two-piece connector in an electrical interconnection system.

FIG. 5A shows the connector 500 from a direction of an attachment face adapted for mounting onto a PCB. Though, in the embodiment illustrated in FIG. 5A, solder balls have not yet been attached to the contact tails. In this example, the connector 500 includes a plurality of wafers installed in a connector shell 505. The connector shell 505 has parallel grooves formed on the inside of two opposing sidewalls for receiving the plurality of wafers, although in FIG. 5A the grooves are obscured from view by the installed wafers. A plurality of cap portions, such as cap portions 515, 520, 525, and 530, are formed above the grooves on the sidewalls of the shell 505 to at least partially close or seal the openings of the grooves. In this configuration, the cap portions may prevent the installed wafers from sliding out of the grooves.

Figure 5B:
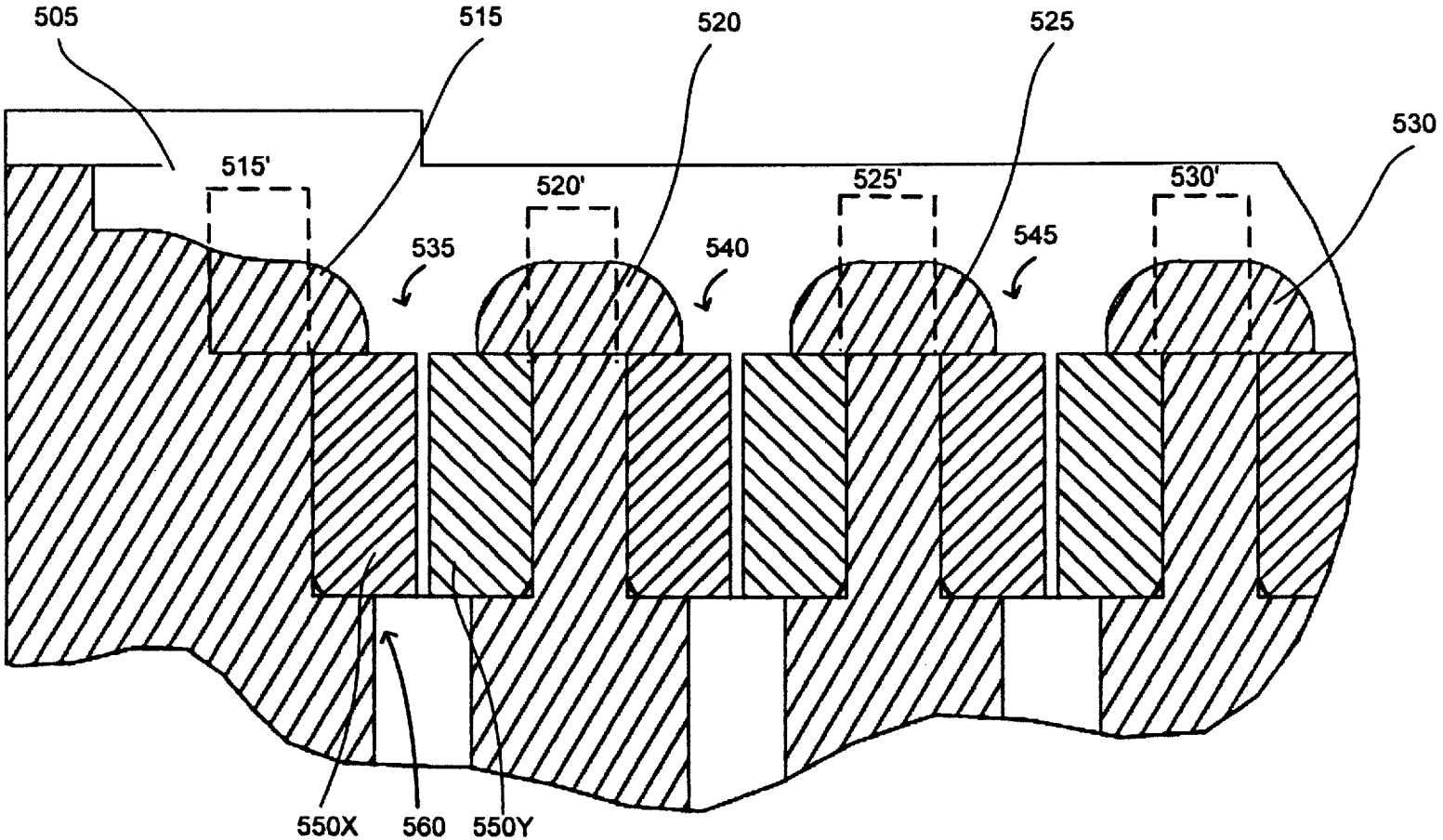
FIG. 5B is a partial cross sectional view of the illustrative connector shown in FIG. 5A.

FIG. 5B illustrates a partial cross section of the connector 500 taken vertically along the line L1-L2. In this view, three grooves 535, 540, and 545 formed on the sidewalls of the shell 505 can be seen. Each groove has a protruding portion of a wafer inserted therein. For example, a wafer formed by wafer halves 510X and 510Y is shown to have protruding portions 550X and 550Y inserted into the groove 535. The protruding portions 550X and 550Y, for example, may be shaped like protruding portions 250X and 250Y illustrated in FIG. 2A, but a wafer may include protruding portions of any suitable shape. In the example shown in FIG. 5B, the grooves 535, 540, and 545 may be separated by protruding ribs formed on the sidewalls of the shell 505. Each separating rib may be wider near the base and narrower at an intermediate portion, forming a shoulder portion (e.g., a shoulder 560 shown in FIG. 5B) upon which an inserted protruding portion of a wafer half may rest. Each separating rib may also have a cap portion formed at the top (e.g., the cap portions 515, 520, 525, and 530). Because the cap portions 515, 520, 525, and 530 are wider than the separating ribs, they extend into the opening of the grooves 535, 540, and 545, thereby preventing the inserted wafers from sliding up along the grooves 535, 540, and 545. Such shoulder and cap portions may serve as locating features to facilitate proper vertical alignment of wafers inserted into the shell 505.

In some embodiments, the cap portions 515, 520, 525, and 530 may be formed by deforming portions of the separating ribs. For example, as shown in phantom in FIG. 5B, the separating ribs may be initially formed to extend further upward towards an edge of the shell 505. These upward extensions 515', 520', 525', and 530' may provide extra material near the openings of the grooves 535, 540, and 545. Once the wafers are inserted into the groove 535, 540, and 545, the extra material of the upward extensions 515', 520', 525', and 530' may be deformed into the cap portions 515, 520, 525, and 530 to at least partially seal the openings, thereby holding the wafers in place. Deformation of the upward extensions 515', 520', 525', and 530' may by achieved in any suitable way, such as using a heated tool to soften thermoplastic material used to form the shell 505.

In the example shown in FIG. 5B, the cap portions 515, 520, 525, and 530 hold the wafers firmly in place, with no room for vertical movement. In practice, some small amount of vertical space may remain in one or more grooves due to manufacturing variances. In alternative embodiments, the cap portions 515, 520, 525, and 530 may be formed in such a way as to leave some desirable amount of vertical space in each groove to allow an installed wafer to slide up and down in a constrained fashion. This may allow the wafers to self-align when positioned for mounting on a surface of a PCB. For example, each wafer may move vertically independently of other wafers so that contact tails of the installed wafers collectively form an array that conforms to a contour of the surface of the PCB (which may be substantially planar), thereby improving reliability of electrical connections formed when the connector 500 is soldered onto the surface of the PCB.

FIG. 6A is a perspective view of an illustrative wafer 600 that may be used in a connector of a two-piece electrical connector, in accordance with some embodiments of the present disclosure. For example, the wafer 600 may be used in the connector 100B shown in FIG. 1B and the connector 500 shown in FIG. 5B. The wafer 600 may be constructed using techniques described above in connection with the wafer 200 of FIG. 2A. However, in this case, mating contact portions of conductive elements are shaped as pads, rather than beams. Accordingly, in the embodiment illustrated FIG. 6A, an insulative portion 610X of a wafer half 600X may be more expansive than the insulative portion 210X of the wafer half 200X shown in FIG. 2A, so that the pads are at least partially embedded in the insulative portion 610X. This configuration may provide structural support to the pads so that the pads are substantially non-yielding.

In the example shown in FIG. 6A, the pads of the wafer half 600X are designed to be complementary to the beams of the wafer half 200X shown in FIG. 2A. For example, the pads of the wafer half 610X are arranged in three groups, corresponding respectively to the three groups of beams of the wafer half 200X. As a more specific example, pads 625X, 630X, 635X, and 640X are arranged in one group, and are configured to align, respectively, with the beams 225X, 230X, 235X, and 240X shown in FIG. 2A when the two corresponding connectors are mated with each other.

The conductive pads may server as mating contact portions of conductive elements that pass through insulative portion 610X and terminate in contact tails. In the example shown in FIG. 6A, the conductive elements associated with the pads 630X and 635X may be configured for use as signal conductors, while the conductive elements associated with the pads 625X and 640X may be configured for use as ground conductors. Within insulative portion 610X, the conductive elements may be shaped similar to those in wafer 300, as illustrated in FIG. 3D. As described above, the conductive elements designated as ground conductors are wider than conductive elements designated to carry high speed signals.

The relative widths of the signal and ground conductors may be carried through to the mating contact portions. Accordingly, the pads 625X and 640X are wider than the pads 630X and 635X, which may improve electrical and/or mechanical properties of the two-piece connector. The wider ground conductors may provide improved electrical properties by shielding signal conductors in an adjacent wafer. Wafer 600Y, though it may have an identical construction to wafer 600X, is flipped relative to wafer 600X when the wafers are attached. As a result, a pad shaped like pad 640X in wafer 600Y will align with a each pair of signal conductors, such as signal conductors 630X and 635X, or 645X and 650X.

The shape of the mating contact portions of wafer 600X, in combination with the shape of mating contact portions of a complementary wafer to be mated to wafer 600X, may also provide float. As explained in greater detail below in connection with FIGS. 7A-B, by providing "float" between corresponding mating contact portions allows the mating contact portions to make suitable electrical connections despite a small amount of lateral misalignment in the centerlines of the mating contact portions.

In the example shown in FIG. 6A, the pad 640X may be substantially wider than the other pads and may span the space between adjacent pairs of conductive elements configured as signals conductors (i.e., between the pair 630X and 635X and the pair 645X and 650X). Thus, the pad 640X may serve as a common ground conductor shared by adjacent groups of conductors. However, it should be appreciated that the present disclosure does not require the use of shared ground conductors. In alternative embodiments, separate ground conductors may be used for each group of conductors. Separating the ground conductors, for example, may allow the ground conductors to be connected to conductive elements at different voltage levels. As a specific example, in some embodiments, separate ground conductors may be connected to different DC power supplies or to a DC power supply and a source of a low frequency signal. Either a DC power supply or a low frequency signal source may act as an AC ground in some systems. However, the specific levels to which ground conductors are connected in a system are not critical to the invention. Connectors, constructed as described herein, may be used in an electronic assembly in any suitable way.

FIG. 6B is an exploded view of the illustrative wafer 600 shown in FIG. 6A. In this view, the wafer 600 can be seen to include two wafer halves 600X and 600Y and an elongated lossy member 670 disposed therebetween. The wafer 600 may be manufactured using techniques described above in connection with the wafer 200 illustrated in FIG. 2A, including, but not limited to, the use of identical wafer halves and capturing the lossy member 670 between the wafer halves.

Figure 7A:
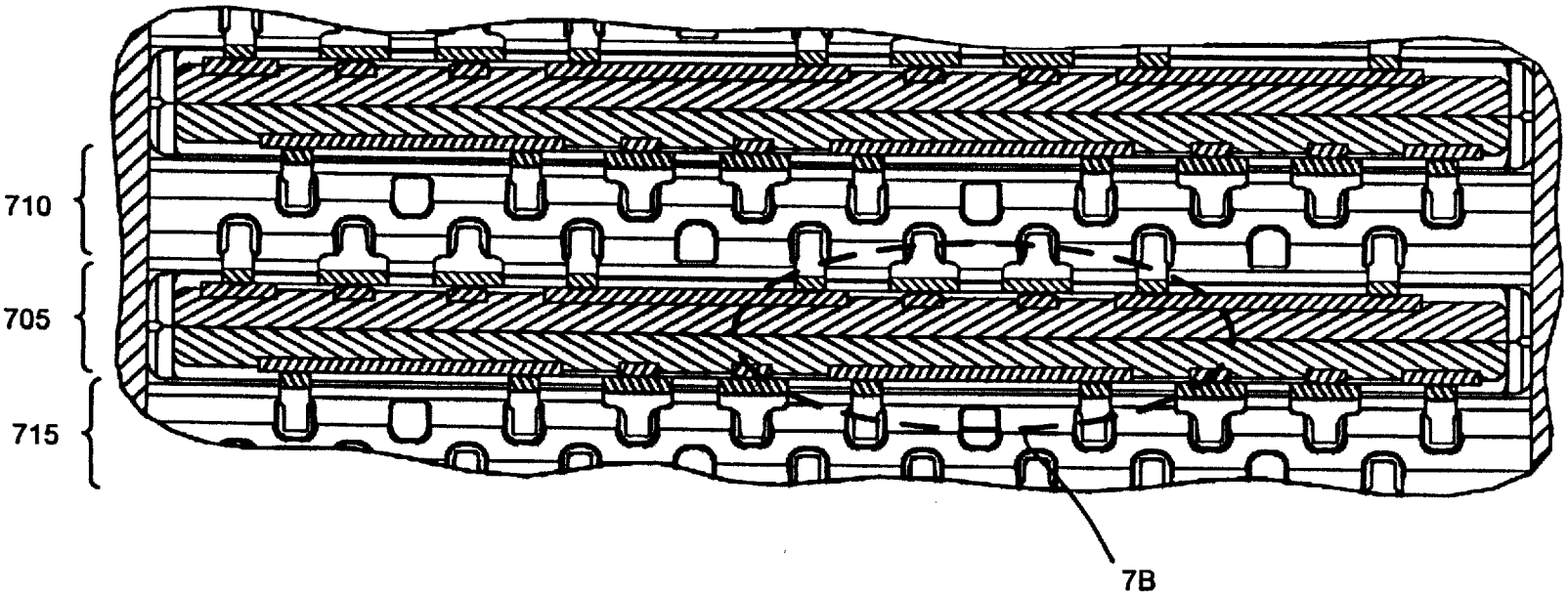
FIG. 7A is a cross sectional view of a mating interface of an illustrative two-piece connector, with the two component connectors fully mated with each other, in accordance with some embodiments.
Figure 7B:
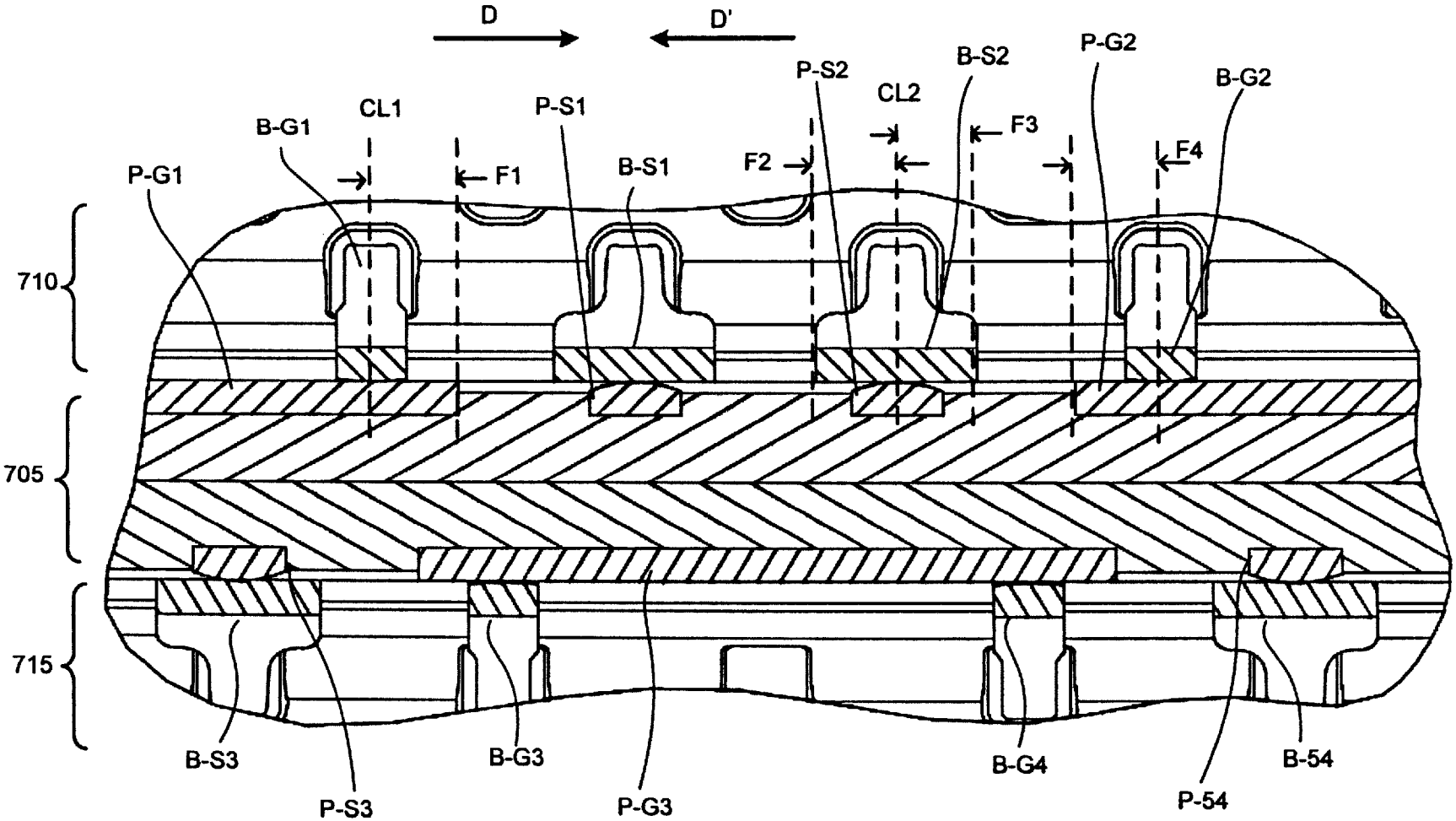
FIG. 7B is an enlarged cross sectional view of the portion of the mating interface designated 7B in FIG. 7A.

FIGS. 7A-B show partial cross sections (at different magnifications) of a mating interface of an illustrative two-piece connector, with the two component connectors fully mated with each other, in accordance with some embodiments of the present disclosure. These cross sections are taken along a plane parallel to the mating faces of the component connectors and perpendicular to the lengths of the conductive elements in the component connectors.

FIG. 7A shows cross sections of at least three wafers 705, 710, and 715. The wafer 705 may be of the same type as the wafer 600 shown in FIG. 6A, and may include pad-shaped mating contact portions. The wafers 710 and 715 may be of the same type as the wafer 200 shown in FIG. 2A, and may include beam-shaped mating contact portions. In the example shown in FIG. 7A, the pads of one wafer half of the wafer 705 are aligned with the beams of one wafer half of the wafer 710, while the pads of the other wafer half of the wafer 705 are aligned with the beams of one wafer half of the wafer 715.

FIG. 7B shows an enlarged cross section at an area 7B, as indicated in FIG. 7A. Visible in this view are beams B-G1, B-S1, B-S2, and B-G2 of the wafer 710, aligned respectively with pads P-G1, P-S1, P-S2, and P-G2 of the wafer 705. Also visible are pads P-S3 and P-S4 of the wafer 705, aligned respectively with beams B-S3 and B-S4 of the wafer 715. Pad P-G3 of the wafer 705 spans a substantial portion of the space between the pads P-S3 and P-S4 and is aligned with both beams B-G3 and B-G4 of the wafer 715. As the labels suggest, the beams B-S1, B-S2, B-S3, and B-S4 and the pads P-S1, P-S2, P-S3 and P-S4 may be associated with conductive elements designated as signal conductors, while the beams B-G1, B-G2, B-G3, and B-G4 and the pads P-G1, P-G2, and P-G3 may be associated with conductive elements designated as ground conductors.

In the example shown in FIG. 7B, the pad P-G3 is relatively wide (e.g., wider than the pads P-S3 and P-S4), so that the corresponding beams B-G3 and B-G4 may slide side to side slightly relative to the pad P-G3 while maintaining sufficient electrical connections. Similarly, the beam B-S3 is relatively wide (e.g., wider than the beams B-G3 and B-G4), so that the corresponding pad P-S3 may slide side to side slightly relative to the beam B-S3 while maintaining sufficient electrical connection. However, note that ground conductors and signal conductors have reversed the relative dimensions: ground conductors have wider pads and narrower beams, while signal conductors have wider beams and narrower pads.

In FIG. 7B, the beams and pads are shown with their center-lines aligned. A good electrical connection between each beam and a respective mating pad when the center lines of the beams and pads are aligned. However, perfect alignment requires tight manufacturing tolerances on all components of the connector. Because relying on tight manufacturing tolerances can increase the cost of manufacture and increase the risk of faulty parts if those tolerances are not achieved, a connector may be designed with float to allow appropriate mating even if the center lines of the beams and pads are not aligned. Conventionally, float has been achieved by making pads wider than the contact points of beams designed to mate with them.

To provide greater signal density, not all of the pads are wider than the beams. Yet, in accordance with some embodiments, float is nonetheless provided by varying relative sizes of the pads and contact regions of the beams that mate to them. Though the ground pads are wider than the contact regions of the beams that mate to them, in the embodiment illustrated in FIG. 7B, the signal pads are narrower than the contact regions of the beams of the signal conductors. Float is provided in the illustrated embodiment by making the contact regions of the beams of the signal conductors wider than the contact regions on the beams of the ground conductors.

FIG. 7B illustrates wafers that are in the designed, or nominal positions. In the nominal positions, all of the beams and pads are aligned. The amount of lateral displacement from this nominal position that can be tolerated with the corresponding mating contact portions still making suitable electrical contact represents the float of the electrical connector. For example, beam B-G1 has a nominal position relative to its corresponding pad P-G1 such that a distance between centerline CL1 of beam B-G1 and an edge of pad P-G1 is F1. This distance represents the float for beam B-G1 along the direction indicated by an arrow D shown in FIG. 7B. That is, the beam B-G1 can shift from its nominal position by an amount F1 in the direction D and still make good electrical contact with the pad P-G1. For other mating contacts of ground conductors, the ground pads are similarly wider, and extend beyond the nominal mating point to provide a comparable degree of float.

For the signal conductors, the pads are not substantially wider than the contact regions of the beams. As can be seen for example, pad P-S2 is not wider than the contact region of beam B-S2. To the contrary, in the embodiment illustrated, the pads are narrower than the contact regions of the beams of the signal conductors. As illustrate in FIG. 3C and FIG. 7B, the width $w_2$ of the contact regions of the beams is wider than the pads. As a result, the beams can be misaligned relative to their nominal positions and still make suitable electrical contact.

For example, beam B-S2 is shown in it nominal position aligned on the centerline CL2 of pad P-S2. Because of the additional width of the contract region of beam B-S2, it can float by an amount F2 along the direction D and still make acceptable electrical connection to the pad.

Overall for the connector, the float along the direction D may be set by the smaller of F1 and F2. The float along the opposite direction D' may similarly be set by the distances F3 and F4 shown in FIG. 7B. Accordingly, in some embodiments, the conductive elements may be shaped such that F1, F2, F3, and F4 match (e.g., are approximately equal). Such a design may provide a suitable degree of float while allowing for an increased density of the conductive elements. For example, pads P-S1 and P-S2 may be spaced closer to each other and closer to adjacent ground pads P-G1 and P-G2 than if those pads were widened to provide an amount of float equal to F1.

In addition to providing float, beams associated with signal conductors (e.g., the beams B-S1, B-S2, B-S3, and B-S4) may be made wider to control the spacing between a pair of beams configured to carry a differential signal (e.g., the beams B-S1 and B-S2). For example, as discussed above in connection with FIG. 3A, the distance between the inner edges of the beams B-S1 and B-S2 may impact the impedance of the differential signal conducting path formed by the beams B-S1 and B-S2, which may in turn impact signal quality.

Figure 8A:
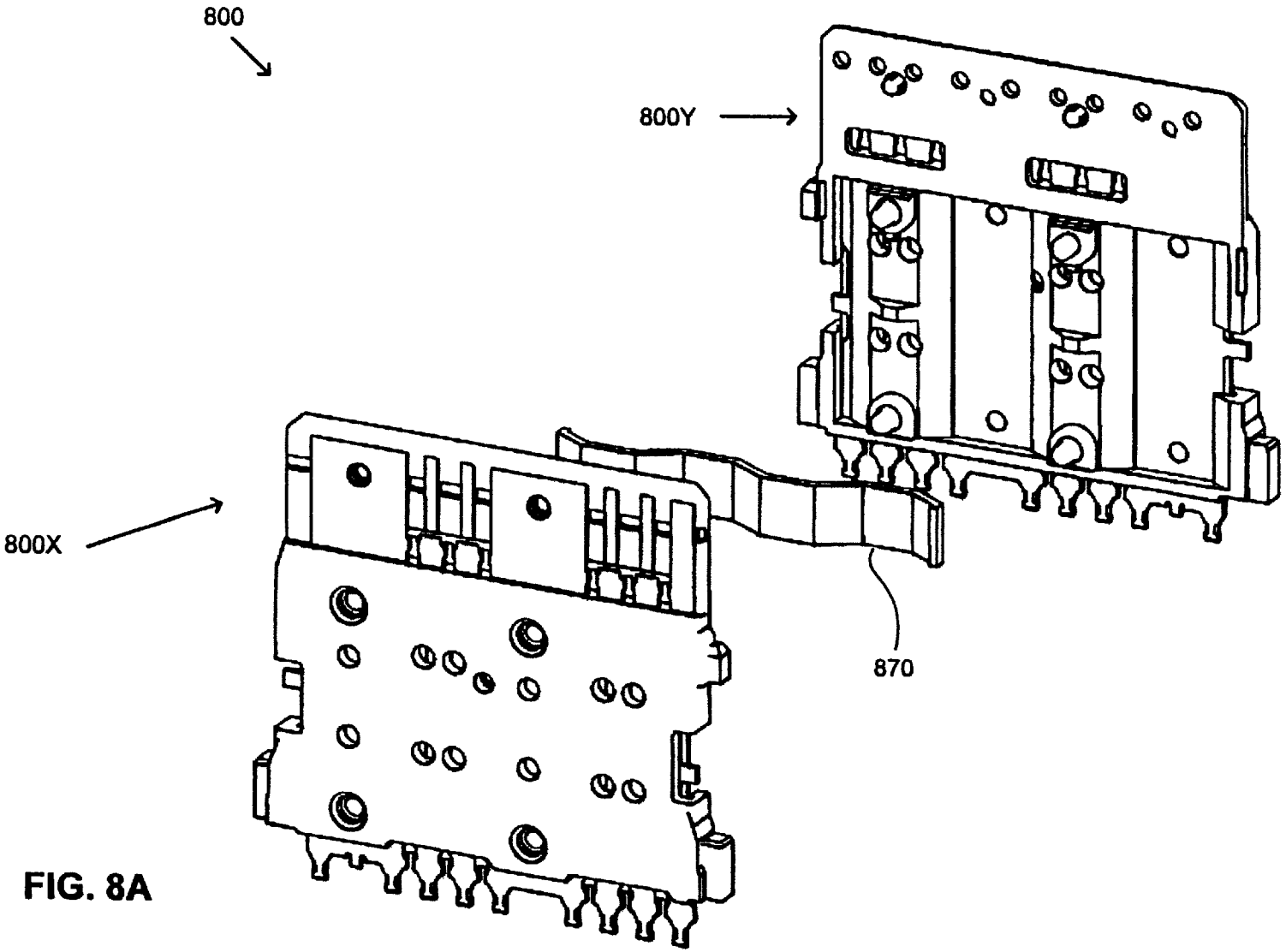
FIG. 8A is an exploded view of yet another an illustrative wafer suitable for use in a connector of a two-piece electrical connector, in accordance with some embodiments.

FIG. 8A is an exploded view of an illustrative wafer 800 that may be used in a connector of a two-piece electrical connector, in accordance with some embodiments of the present disclosure. The wafer 800 may be of a same type as the wafer 600 shown in FIG. 6A, and may be used in the connector 100B shown in FIG. 1B and the connector 500 shown in FIG. 5A.

In the example shown in FIG. 8A, the wafer 800 can be seen to include two wafer halves 800X and 800Y and a lossy member 870 disposed therebetween. The lossy member 870 is elongated in a direction parallel to columns of conductive elements at least partially embedded in the wafer halves 800X and 800Y. In the embodiment shown in FIG. 8A, the lossy member 870 extends substantially from one end of the wafer 800 to the other, though that is not a requirement. The lossy member may, in alternative embodiments, extend along only a portion of the wafer 800, for example, adjacent one or more groups, but not all, of conductive elements.

The wafer 800 may be manufactured using techniques described above in connection with the wafer 200 illustrated in FIG. 2A, including, but not limited to, the use of identical wafer halves and capturing the lossy member 870 between the wafer halves.

The wafer 800 may differ from the wafer 600 in height. For example, the wafer 800 may be taller than the wafer 600 shown in FIG. 6A, so that the lossy member 870 is disposed along only a portion of the height of the wafer 800. (Alternatively, the wafers 800 and 600 may have similar heights, but the lossy member 870 disposed in the wafer 800 may be narrower than the lossy member 670 disposed in the wafer 600.)

Figure 8B:
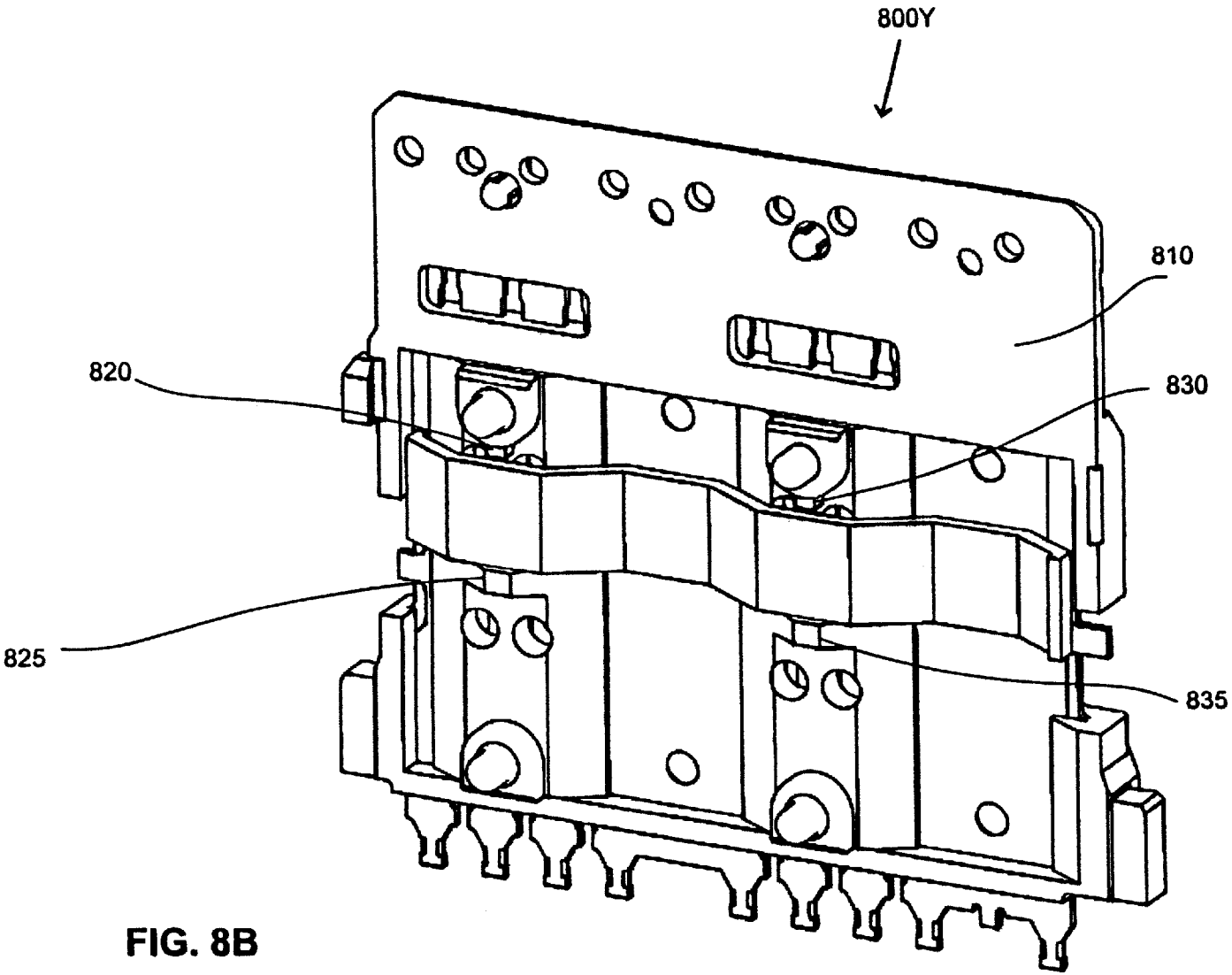
FIG. 8B shows a perspective view of a wafer half of the illustrative wafer shown in FIG. 8A, with a lossy member disposed on the wafer half, in accordance with some embodiments.

FIG. 8B shows a perspective view of the wafer half 800Y, with the lossy member 870 disposed thereon. The lossy member 870 has a width measured in a direction parallel to the direction in which conductive elements extend. In this example, the width is such that the lossy member extends only partially along the length of intermediate portions of the conductive elements that are within an insulative portion 810 of the wafer half 800Y. A percentage of the length of the intermediate portions spanned by the lossy member 870 may depend on the height of the wafer 800 and/or an overall height of the two-piece electrical connector in which the wafer 800 is intended to be used. Such a percentage is not critical to practicing the various inventive concepts disclosed herein. In some embodiments, the lossy member 870 may have a width on the order of a few millimeters, such as between 1 and 2 mm, between 2 and 5 mm, or between 5 and 10 mm. However, the width may also be less than any of these dimensions. Alternatively, the width may be greater than these dimensions, such as on the order of 20 to 25 mm, or 25 to 30 mm.

In various embodiments, the lossy member 870 may be positioned at any suitable place along the length of the intermediate portions of the conductive elements of the wafer half 800Y. For example, the lossy member 870 may be adjacent contact tails of the conductive elements or, alternatively, adjacent mating contact portions of the conductive elements. In some other embodiments, the lossy member may be positioned approximately midway along the length of the conductive elements. In yet some other embodiments, more than one lossy member may be present, for example, lossy members may be disposed in parallel at different locations along the length of the intermediate portions of the conductive elements of the wafer half 800Y.

In the example shown in FIG. 8B, the insulative portion 810 of the wafer half 800Y may have raised portions 820, 825, 830, and 835. These raised portions may be shaped and arranged to form a channel extending in a direction perpendicular to the direction in which conductive elements extend. The channel may be of a size (e.g., width) suitable for receiving the lossy member 870. For instance, in the example shown in FIG. 8, a distance between the raised portions 825 and 830 may be similar to the width of the lossy member 870, so that the lossy member fits snugly into the channel. In alternative embodiments, the distance between the raised portions 825 and 830 may be larger than the width of the lossy member 870, so that the lossy member may slide up and down (i.e., along the direction in which conductive elements extend) within the channel. Other mechanisms may also be used to attach the lossy member 870 to a wafer half, in addition to, or instead of, forming a channel on the inner surface of the wafer half.

Figure 9A:
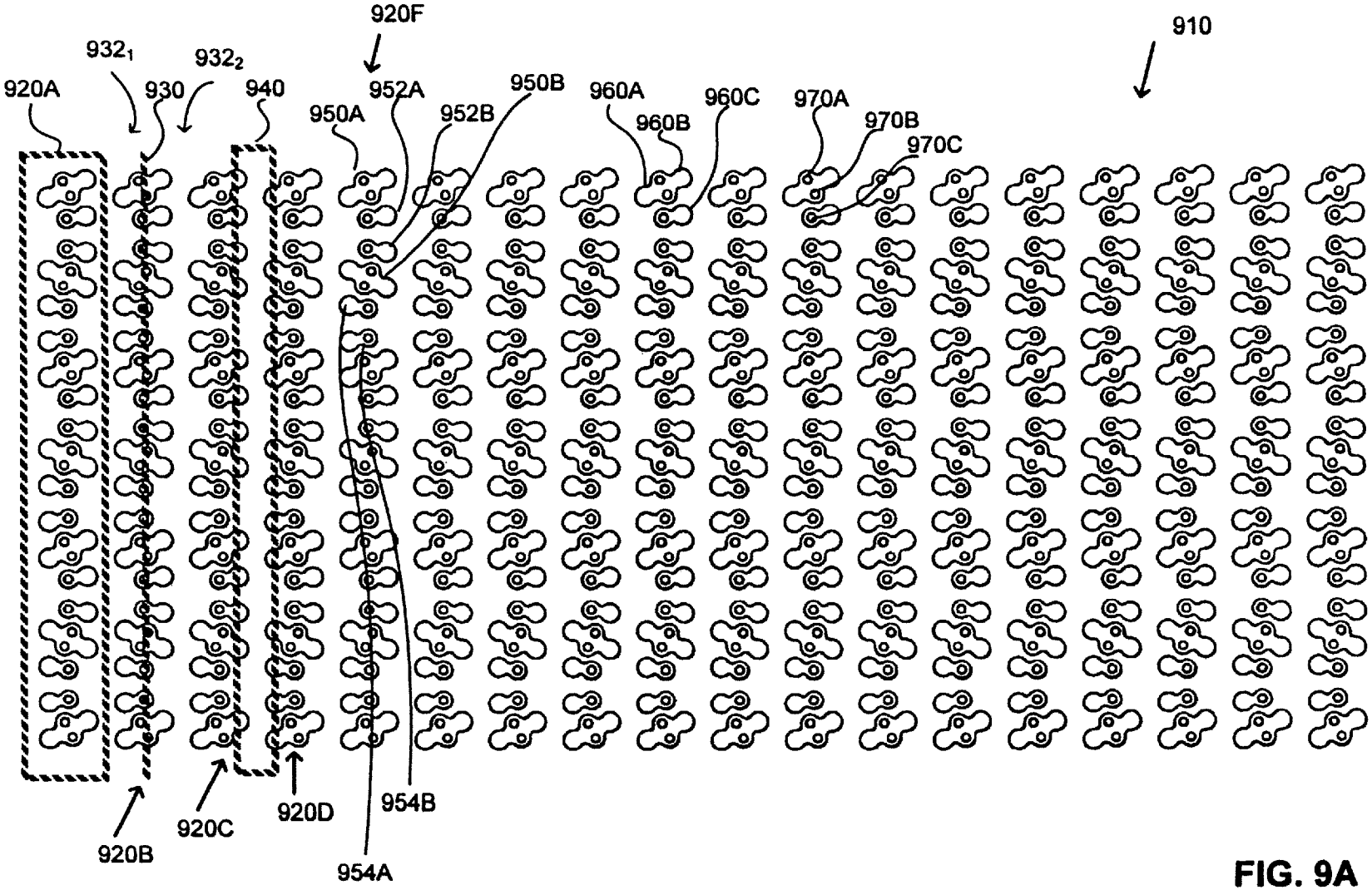
FIG. 9A shows an illustrative footprint for attachment of a connector to a printed circuit board, in accordance with some embodiments.

FIG. 9A illustrates a footprint for attachment of a connector to a printed circuit board. Footprint 910 represents conductive pads that may be formed on a surface of a printed circuit board in a pattern that will align pads with solder balls attached to contact tails of a connector assembled as described above. Footprint 910 may be used with a connector assembled from wafers having beams, such as is illustrated in FIG. 2A, or a connector assembled from wafers having pads, such as is illustrated in FIG. 6A.

In the embodiment illustrated, footprint 910 contains multiple columns of pads, such as column 920A. In this embodiment, each of the columns contains the same arrangement of pads. The pads in each of the columns, such as column 920A, are positioned to align with contact tails from a wafer that is assembled into a connector.

Within each of the columns, the pads have different shapes and orientations. These shapes and orientations may provide a high density, mechanically robust footprint that provides good signal integrity and facilitates routing of signals to the pads in the footprint such that the overall cost of manufacturing an electronic assembly may be reduced.

Each of the pads in footprint 910 has at least one via. The vias serve to make electrical connections between the pads, which are formed on a surface of an electronic assembly, and conductive structures within the electronic assembly. For example, footprint 910 may be formed on the surface of a printed circuit board, using known printed circuit board manufacturing techniques. Within the printed circuit board, conductive structures form signal traces and ground planes. Vias through the pads of footprint 910 may connect each pad to such a conductive structure within the printed circuit board.

In the embodiment shown in FIG. 9A, a characteristic of footprint 910 is that the vias of pads within each column may be aligned along the column. For example, in column 920B, the vias of the pads forming the column are aligned generally along line 930. The vias of the other columns are, in the embodiment illustrated, similarly aligned. As a result, area between the columns is generally free of vias and may be used as a routing channel. In FIG. 9A, routing channel 940 is illustrated between columns 920C and 920D. In various embodiments, the width of the routing channel 940 may be between 0.5 mm and 3 mm, or between 0.8 mm and 2 mm, or between 1 mm and 1.5 mm.

Because the routing channel 940 is generally free of vias, within the printed circuit board or other substrate on which footprint 910 is formed, conductive traces may be routed in routing channel 940. In contrast, if vias past through routing channel 940, those vias would either block the routing of traces within that region or reduce the density with which traces could be routed in that region by requiring the traces to be routed in such a way that a sufficient clearance around any via was provided.

Accordingly, in the illustrative embodiment, the routing channels 940 provide a mechanism by which signal traces may be readily routed in regions of the printed circuit board that underlie footprint 910. In this way, traces may be routed to the vias attached to the pads, even at the very center of footprint 910. Routing traces to make connections to internal pads of a footprint can sometimes undesirably increase the cost of an electronic assembly incorporating high density components. The increased cost, for example, results from an increase in the number of layers of a printed circuit board or other substrate on which the footprint is formed. Providing routing channels 940 may reduce the need for such additional layers, thereby reducing cost.

The pads in each of the columns may have different shapes, depending on their intended role. For example, in FIG. 9A, pad 950A is designated as a ground pad. A ground pad, in the embodiment illustrated, is shaped for connection to contact tails, which may be associated with two different conductive elements within a connector or other component. In an embodiment in which contact tails are attached to a printed circuit board through the use of solder ball, a pad 950 may contain two solder attachment regions, such as solder attachment regions 960A and 960B. In footprint 910, solder attachment regions 960A and 960B are generally circular, facilitating solder ball attachment. However, it should be appreciated that, in other embodiments, solder attachment regions may have other shapes.

FIG. 9A illustrates that each of the columns also includes pads for attachment to a signal conductor. For example, pad 952A may serve as a point of attachment for a contact tail from a signal conductor within a connector or other component. Each of the signal contact pads may similarly include a solder attachment region, such as solder attachment region 960C. In this example, solder attachment region 960C is shaped generally the same as solder attachment regions 960A and 960B for a ground pad. Though, signal pad 952A contains a single solder attachment region.

Each of the pads may include one or more vias. In the embodiment illustrated, each of the ground pads contains two vias, such as vias 970A and 970B in a via region of the ground pad. A signal pad contains one via, in the embodiment illustrated, such as via 970C in a via region of a signal pad.

Each of the columns may have a repeating pattern of ground pads and signal pads. For example, in column 920E, a pair of signal pads 952A and 952B are positioned adjacent ground pad 950A. A further ground pad 950B is also included in the column, such that signal pads 952A and 952B are between ground pads 950A and 950B. A further pair of signal pads 954A and 954B are adjacent ground pad 950B. This pattern of two ground pads and two pairs of signal pads is then repeated along the length of the column. As can be seen in FIG. 9A, though each of the ground pads and each of the signal pads is generally of the same shape, the pads are melted with different orientations, which provides a high density footprint with good signal integrity.

As shown in FIG. 9A, different orientations of the pads are used to provide solder attachment regions on different sides of the column. For example, it can be seen along column 920B, for example, that a first portion of the solder attachment regions of the pads in that column are positioned on a first side $\mathbf{932}_1$ of the column. A second portion of the solder attachment regions are on the second side $\mathbf{932}_2$ of the column. This positioning of the pads allows contact tails from two wafer halves to be attached to pads in the same column. In some embodiments, those wafer halves may be wafer halves of a common wafer. In other embodiments, the wafer halves attached to pads in the same column may be wafer halves from adjacent wafers in a connector.

The orientations of the conductive pads along a column may also facilitate a high density of pads along a column. Each of the pads is angled with respect to the centerline of the column, and different pads in a repeating segment of the column may have different angles.

Figure 9B:
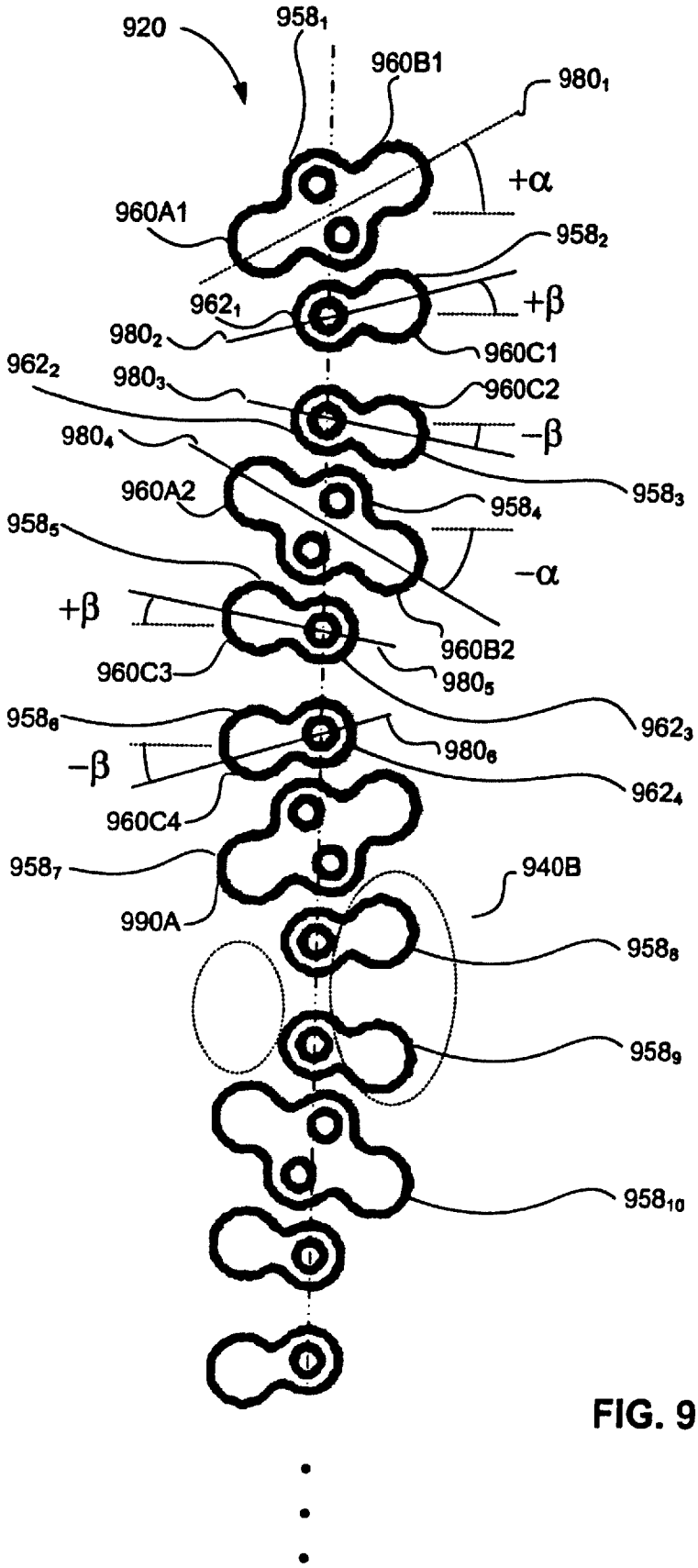
FIG. 9B shows a portion of a column of pads in the footprint shown in FIG. 9A.

FIG. 9B shows a portion of a column 920 of pads, in accordance with some embodiments. In this embodiment, a first ground pad $\mathbf{958}_1$ in column 920 includes solder attachment regions 960A1 and 960B1. The solder attachment regions 960A1 and 960B1 are on opposite ends of the pad along an axis $\mathbf{980}_1$. The pad $\mathbf{958}_1$ is angled with respect to the column 920 such that the axis $\mathbf{980}_1$ makes an angle plus alpha with a normal to the column. The second pad $\mathbf{958}_2$ has an axis $\mathbf{980}_2$ with a solder attachment region 960C1 on one side of the pad and a via region $\mathbf{962}_1$ on the other side of the pad in a direction along axis $\mathbf{980}_2$. Axis $\mathbf{980}_2$ is angled, relative to a normal of the column 920 at an angle plus beta.

Pad $\mathbf{958}_3$ is also angled with respect to the column 920. In this example, pad $\mathbf{958}_3$ has a solder attachment region 960C2 and a via area $\mathbf{962}_2$ on opposing ends of the pad along an axis $\mathbf{980}_3$. The axis $\mathbf{980}_3$ is angled with respect to a normal to the column 920 at an angle minus beta. In this example, pads $\mathbf{958}_2$ and $\mathbf{958}_3$ are angled by the same amount but in different directions.

The fourth pad in the column, pad $\mathbf{958}_4$, includes an axis $\mathbf{980}_4$. Solder attachment regions 960A2 and 960B2 are on opposing ends of the pad along axis $\mathbf{980}_4$. Axis $\mathbf{980}_4$ is angled with respect to a centerline of column 920 by an angle minus alpha. In this example, pad $\mathbf{958}_4$ is angled by the same amount as pad $\mathbf{958}_1$. However, pad $\mathbf{958}_4$ is angled in the opposite direction from pad $\mathbf{958}_4$. In this example, the angling of the pads $\mathbf{958}_1 \ldots \mathbf{958}_4$ is selected to uniformly space the solder attachment regions 960B1, 960C1, 960C2 and 960B2. Though, it should be appreciated that any suitable dimensions may be used in forming a connector footprint.

A fifth pad, pad $\mathbf{958}_5$, in the series that is repeated to form column 920 is also angled with respect to the column. In this case, the pad $\mathbf{958}_5$ has a solder attachment region 960C3 on an opposite side of column 920 from solder attachment regions 960B1, 960C1, 960C2 and 960B2. Though, pad $\mathbf{980}_5$ similarly has an axis $\mathbf{980}_5$ with a solder attachment region 960C3 and a via area $\mathbf{962}_3$ on opposing ends of the pad along axis $\mathbf{980}_5$. Pad $\mathbf{958}_5$ may be angled with respect to column 920 such that axis $\mathbf{980}_5$ makes an angle of plus beta with respect to a normal to column 920. In this example, the angle of axis $\mathbf{980}_5$ may be the same as the angle of axis $\mathbf{980}_2$. However, the angle of axis $\mathbf{980}_5$ is measured relative to a normal on the opposite side of column 920.

Similarly, a pad $\mathbf{958}_6$ may have an axis $\mathbf{980}_6$ defined by solder attachment region 960*c*4 and via area $\mathbf{962}_4$. Axis $\mathbf{980}_6$ is angled at an angle of minus beta with respect to a normal of column 920. The angles of pads $\mathbf{980}_5$ and $\mathbf{980}_6$ may be selected to provide uniform spacing between the solder attachment regions along both sides of column 920. This pattern of two ground pads and two pairs of signal pads may then be repeated along the length of column 920, providing uniform spacing between solder attachment regions on both sides of the column.

The angling of contact pads, as described above, allows for a high density of contact pads along column 920. As can be seen in FIG. 9B angling of the ground pads creates regions between ground pads that are of different sizes on opposing sides of the column. The signal pads are positioned such that their solder attachment regions are positioned in the larger spaces. For example, between ground pad $\mathbf{958}_7$ and ground pad $\mathbf{958}_{10}$ there is a larger area in 990B on one side of column 920 and a smaller area 990A between pads $\mathbf{958}_7$ and $\mathbf{958}_{10}$. In this example, signal pads $\mathbf{958}_8$ and $\mathbf{958}_9$ are positioned between pads $\mathbf{958}_7$ and $\mathbf{958}_{10}$. The signal pads $\mathbf{958}_8$ and $\mathbf{958}_9$ are oriented with their solder attachment regions in the larger area 990B. This orientation allows the center to center spacing of the solder attachment regions of the signal pads $\mathbf{958}_8$ and $\mathbf{958}_9$ to be larger than the center to center spacing of the vias for signal pads $\mathbf{958}_8$ and $\mathbf{958}_9$ while still being positioned between solder attachment regions for adjacent ground pads $\mathbf{958}_7$ and $\mathbf{958}_{10}$. In this manner, a high density footprint with good signal integrity properties is achieved.

Figure 9C:
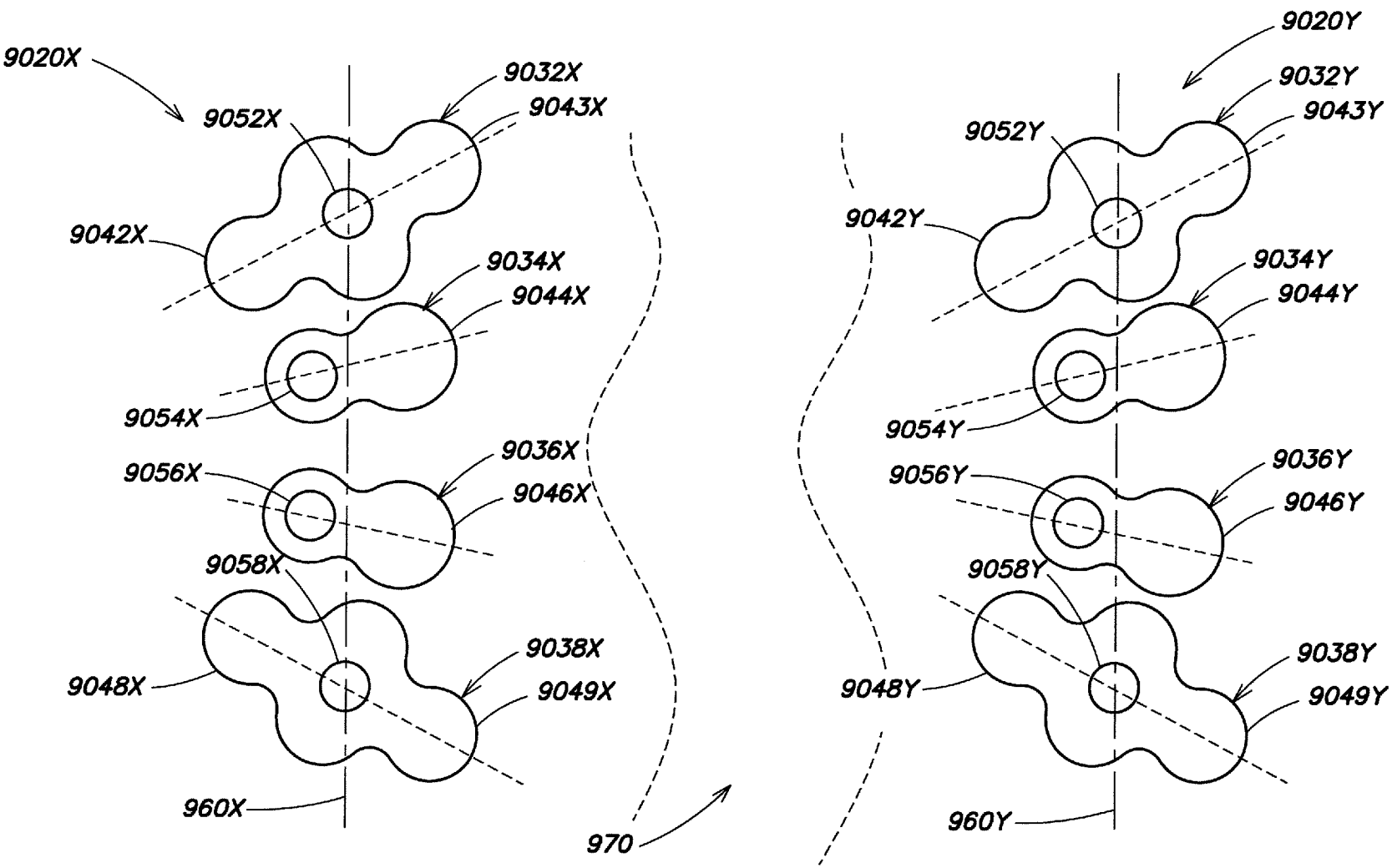
FIG. 9C shows portions of two columns of pads, in accordance with some further embodiments.

FIG. 9C shows portions of two columns 9020X and 9020Y of pads, in accordance with some further embodiments. In this example, the column 9020X includes two ground pads 9032X and 9038X, and two signal pads 9034X and 9036X disposed between the two ground pads 9032X and 9038X. The ground pad 9032X includes two solder attachment regions 9042X and 9043X, and a via 9052X is disposed in a via region located between the solder attachment regions 9042X and 9043X. Similarly, the ground pad 9038X includes two solder attachment regions 9048X and 9049X, and a via 9058X is disposed in a via region located between the solder attachment regions 9048X and 9049X. The signal pad 9034X includes a solder attachment region 9044X, and a via 9054X is disposed in a via region located adjacent to the solder attachment region 9044X. Similarly, the signal pad 9036X includes a solder attachment region 9046X, and a via 9056X is disposed in a via region located adjacent to the solder attachment region 9046X.

In the example shown in FIG. 9C, the column 9020Y includes two ground pads 9032Y and 9038Y and two signal pads 9034Y and 9036Y arranged in a manner that is similar to the ground pads 9032X and 9038X and the signal pads 9034X and 9036X of the column 9020X. In particular, the ground pad 9032Y includes two solder attachment regions 9042Y and 9043Y and a via 9052Y disposed therebetween. Similarly, the ground pad 9038Y includes two solder attachment regions 9048Y and 9049Y and a via 9058Y disposed therebetween. The signal pad 9034Y includes a solder attachment region 9044Y and an adjacent via region having a via 9054Y disposed therein. Similarly, the signal pad 9036Y includes a solder attachment region 9046Y and an adjacent via region having a via 9056X disposed therein.

Unlike in the embodiments shown in FIGS. 9A-B, each of the illustrative ground pads shown in FIG. 9C (e.g., the ground pad 9032X) contains a single via (e.g., the via 9052X). This arrangement may allow for smaller ground pads and in turn a higher density of pads in a footprint. However, it should be appreciated that any suitable number of vias may be provided in a pad (e.g., one, two, three, etc.), and different pads in the same footprint may have different numbers of vias, as aspects of the present disclosure are not limited to the use of any particular number of vias.

Furthermore, the illustrative vias along a column shown in FIG. 9C (e.g., the vias 9052X, 9054X, 9056X, and 9058X) need not be aligned along the same line. For example, the signal vias 9054X and 9056X may be slightly offset from a line 960X going through the ground vias 9052X and 9058X. Similarly, the signal vias 9054Y and 9056Y may be slightly offset from a line 960Y going through the ground vias 9052Y and 9058Y. In this manner, a routing channel 970 between the two columns of vias may not be completely straight. Rather, the routing channel 970 may have a serpentine shape, as illustrated in dotted lines in FIG. 9C, to provide a uniform spacing relative to the signal or ground vias.

FIGS. 10A-F show yet another example of a wafer half 1000X, in accordance with some embodiments of the present disclosure. Like the illustrative wafer halves 200X and 200Y shown in FIGS. 2A-C and the illustrative wafer half 300 shown in FIGS. 3A-D, the wafer half 1000X may be joined with another like wafer half to form a wafer that is suitable for use in a connector such as the connector 100A shown in FIG. 1A. However, unlike the wafer halves 200X and 200Y and the wafer half 300, which are adapted to receive a lossy member (e.g., the illustrative lossy member 270 shown in FIG. 2C), the wafer half 1000X may include a portion of overmolded lossy material, such as a portion of overmolded conductive plastic. The portion of lossy material overmolded onto the wafer half 1000X may provide benefits similar to those provided by the lossy member 270, such as dampening of resonances that may form in ground conductors, and such overmolding may be used instead of or in addition to a lossy insert.

Figure 10A:
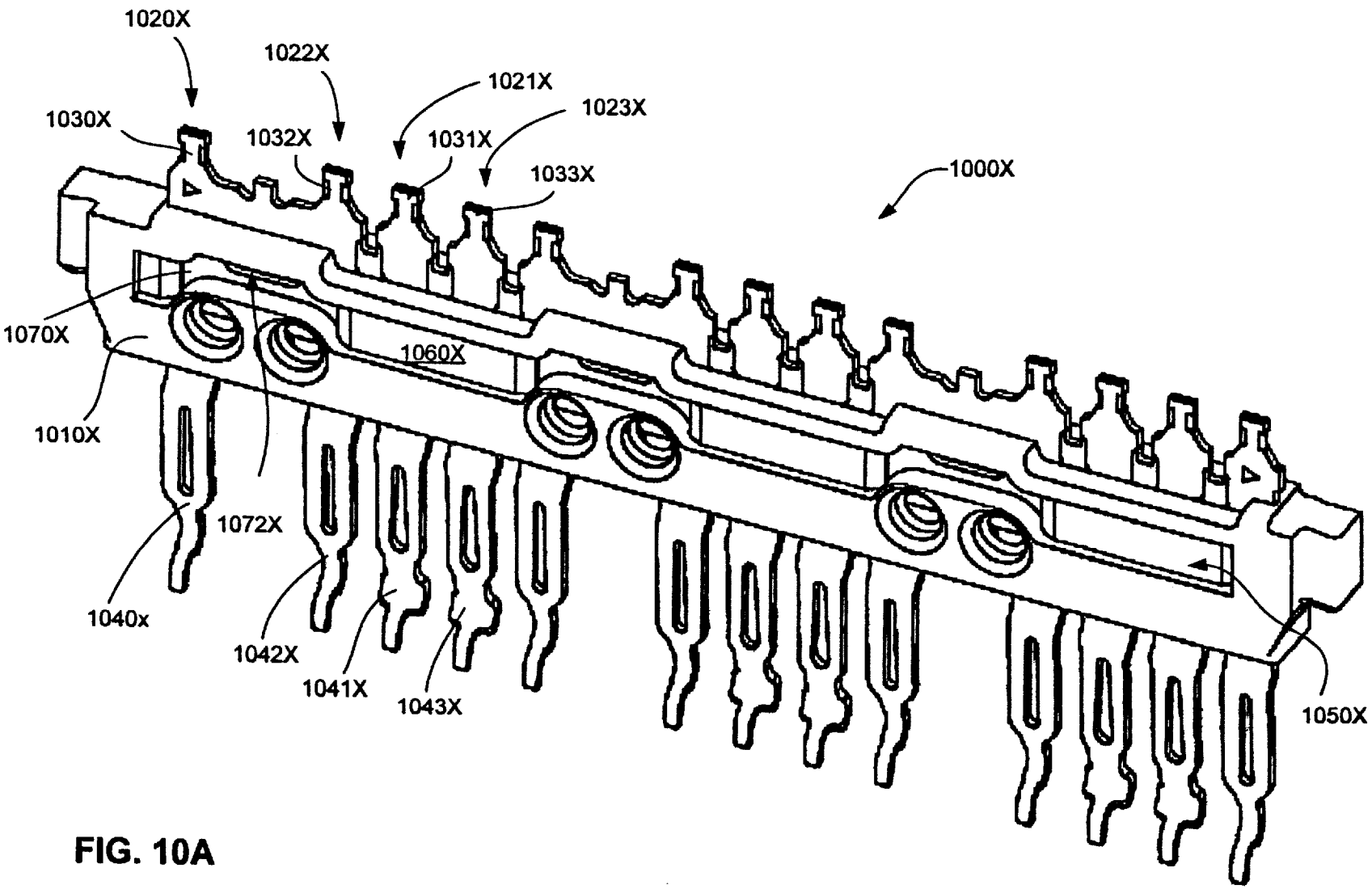
FIG. 10A is a perspective view of a front side of an illustrative wafer half, prior to overmolding of lossy material, in accordance with some embodiments.
Figure 11A:
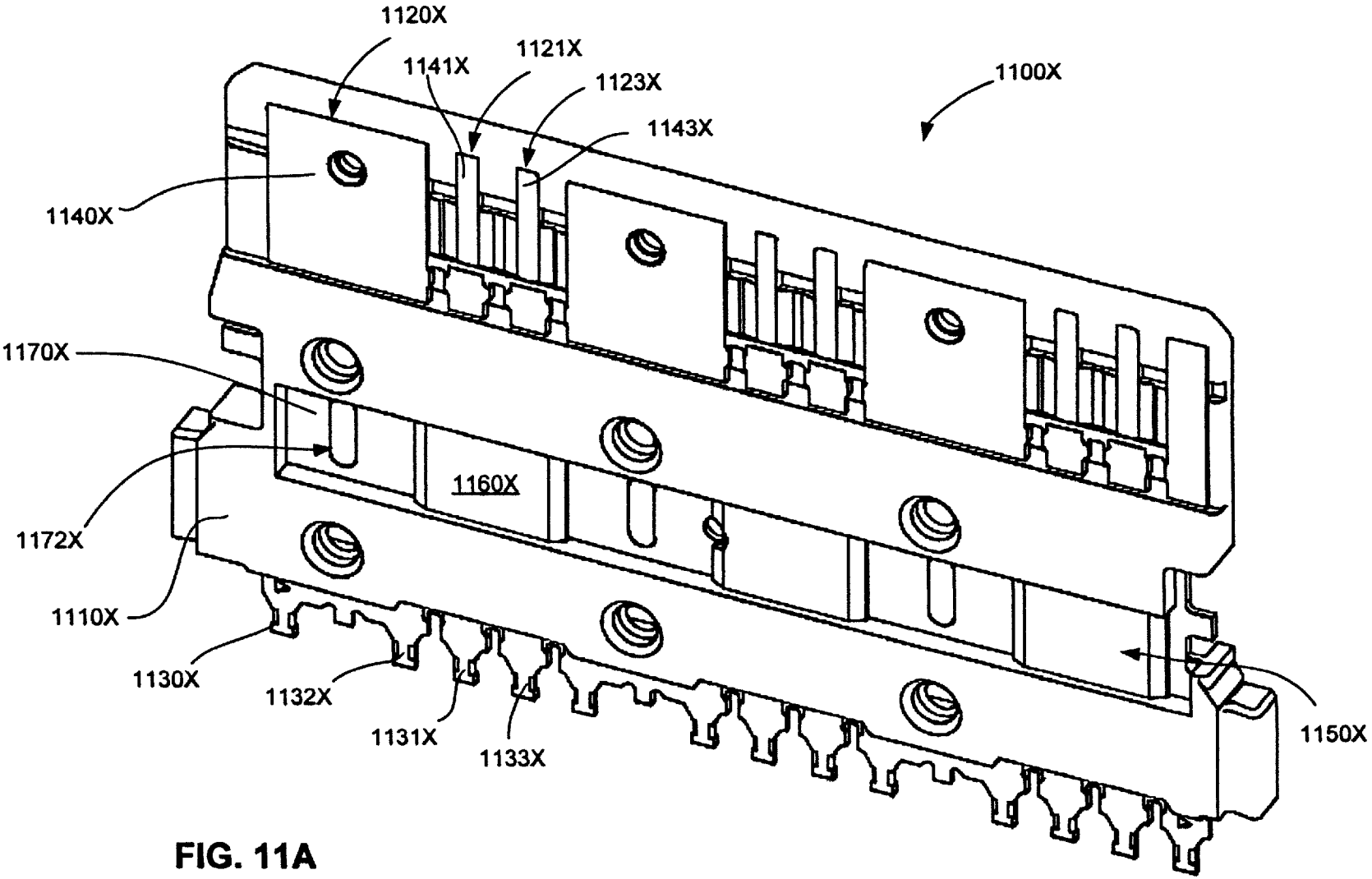
FIG. 11A is a perspective view of a front side of another illustrative wafer half, prior to overmolding of lossy material, in accordance with some embodiments.

FIG. 10A is a perspective view of the front side of the illustrative wafer half 1000X, prior to overmolding of lossy material, in accordance with some embodiments. In this example, the wafer half 1000X includes an insulative portion 1010X at least partially enclosing a plurality of conductive elements disposed generally in parallel to each other (e.g., conductive elements 1020X-1023X). Each conductive element may have exposed portions not covered by the insulative portion 1010X. Such exposed portions may include contact tails (e.g., contact tails 1030X-1033X) for attachment to a PCB, and beam-shaped mating contact portions (e.g., beams 1040X-1043X) for mating with pad-shaped mating contact portions of conductive elements in a corresponding connector (e.g., as shown in FIG. 11A and discussed in greater detail below).

In the example shown in FIG. 10A, some conductive elements in the illustrative wafer half 1000X may be adapted for use as ground conductors, while some other conductive elements in the wafer half 1000X may be adapted for use as signal conductors. For instance, the conductive elements 1020X and 1022X may be adapted for use as ground conductors, while the conductive elements 1021X and 1023X may be adapted for use as signal conductors. Furthermore, adjacent ground conductors, such as 1020X and 1022X, may be joined by a planar intermediate portion 1070X, which may be conductive and may spanned the distance between the ground conductors 1020X and 1022X. In embodiments in which ground conductors are used, portions of the ground conductors may be exposed to make contact with the lossy material after overmolding.

Figure 10B:
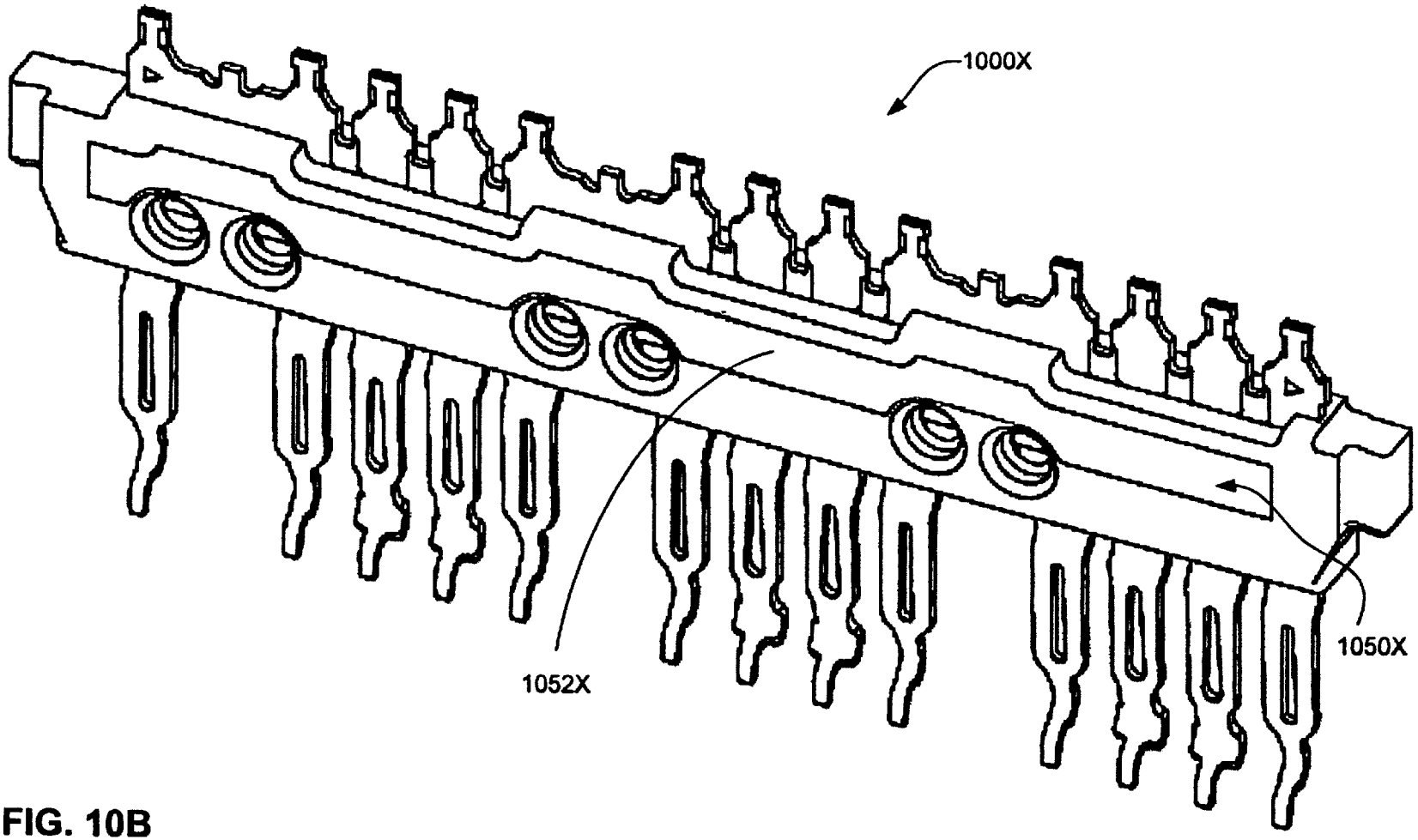
FIG. 10B is another perspective view of the illustrative wafer half shown in FIG. 10A, with lossy material disposed in a channel, in accordance with some embodiments.

In the example shown in FIG. 10A, a channel 1050X is formed in the insulative portion 1010X and is configured to be filled with a molten lossy material during an overmolding process. An illustrative result of such an overmolding process is shown in FIG. 10B, which is a perspective view of the front side of the wafer half 1000X shown in FIG. 10A, with lossy material 1052X disposed in the channel 1050X.

In the example shown in FIG. 10A, the channel 1050X extends along a direction that is perpendicular to the plurality of conductive elements enclosed by the insulative portion 1010X. Furthermore, the channel 1050X may extend across approximately the entire length of the wafer half 1000X, so that the channel 1050X may span all of the conductive elements. In this manner, when the channel 1050X is filled with the lossy material 1052X, the lossy material 1052X may be in close proximity to each of the conductive elements in the wafer half 1000X. However, in alternative embodiments, a channel may extend only partially across a wafer half and may span only some, but not all, of the conductive elements in the wafer half. Additionally, in some embodiments, multiple channels may be formed in the insulative portion 1010X. Such channels may be parallel to each other, with each channel spanning some or all of the conductive elements. In this manner, lossy material may be in close proximity to each conductive element at multiple locations along the length of the conductive element.

In some further embodiments, overmolded lossy material may be in electrical contact with multiple ground conductors, or in closer proximity to ground conductors than to signal conductors. For instance, in the example shown in FIG. 10A, the channel 1050X may be configured in such a manner that portions of ground conductors, such as the planar intermediate portion 1070X spanning the ground conductors 1020X and 1022X, are exposed at a floor of the channel 1050X, so that the ground conductors 1020X and 1022X will be in electrical contact with the lossy material 1052X disposed in the channel 1050X. By contrast, signal conductors may be insulated from the lossy material 1052X. For instance, the signal conductors 1021X and 1023X are insulated from the lossy material 1052X by an insulative portion 1060X in the example of FIG. 10A.

Figure 10C:
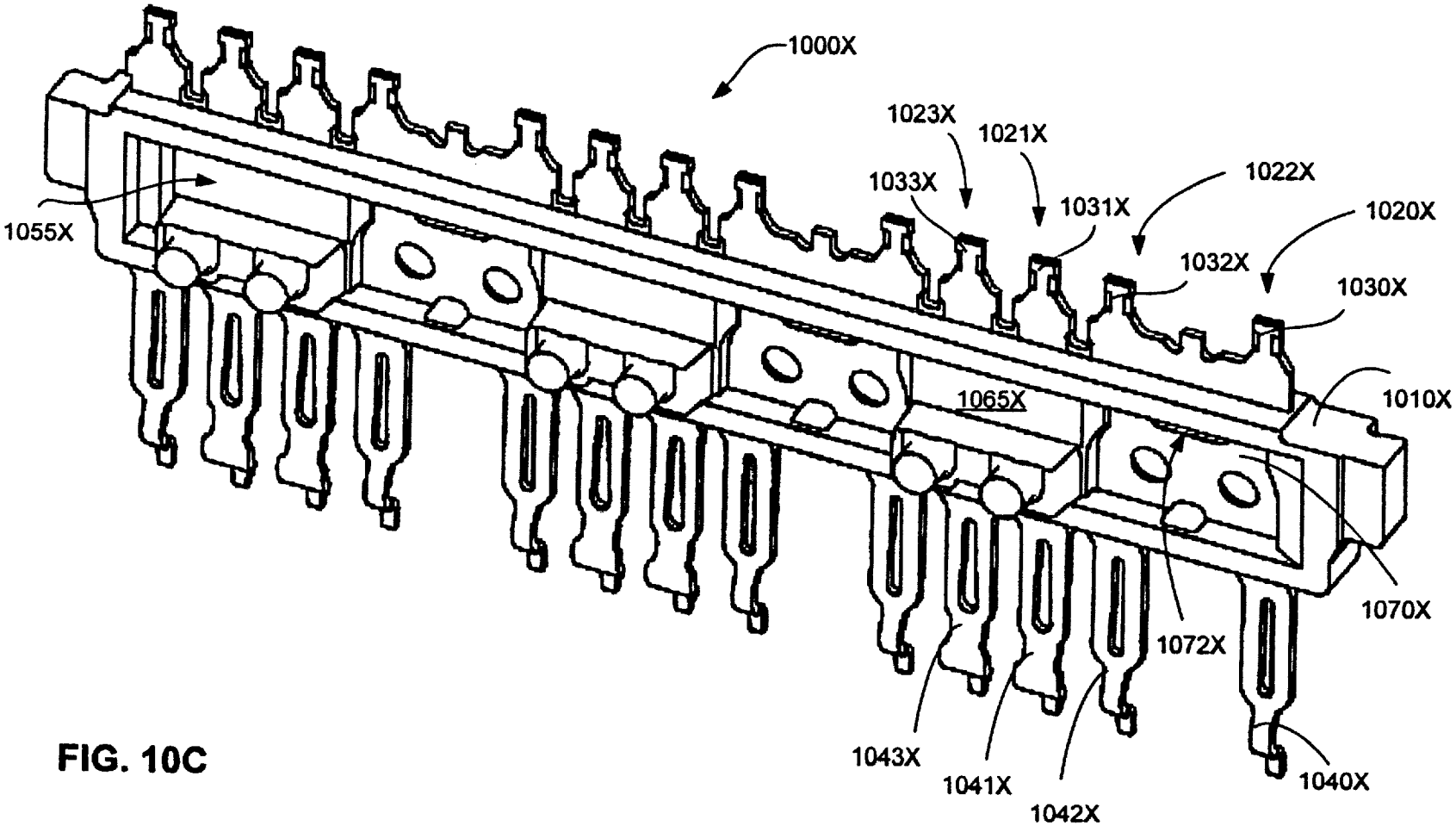
FIG. 10C is a perspective view of a back side of the illustrative wafer half shown in FIG. 10A, prior to overmolding of lossy material, in accordance with some embodiments.
Figure 10D:
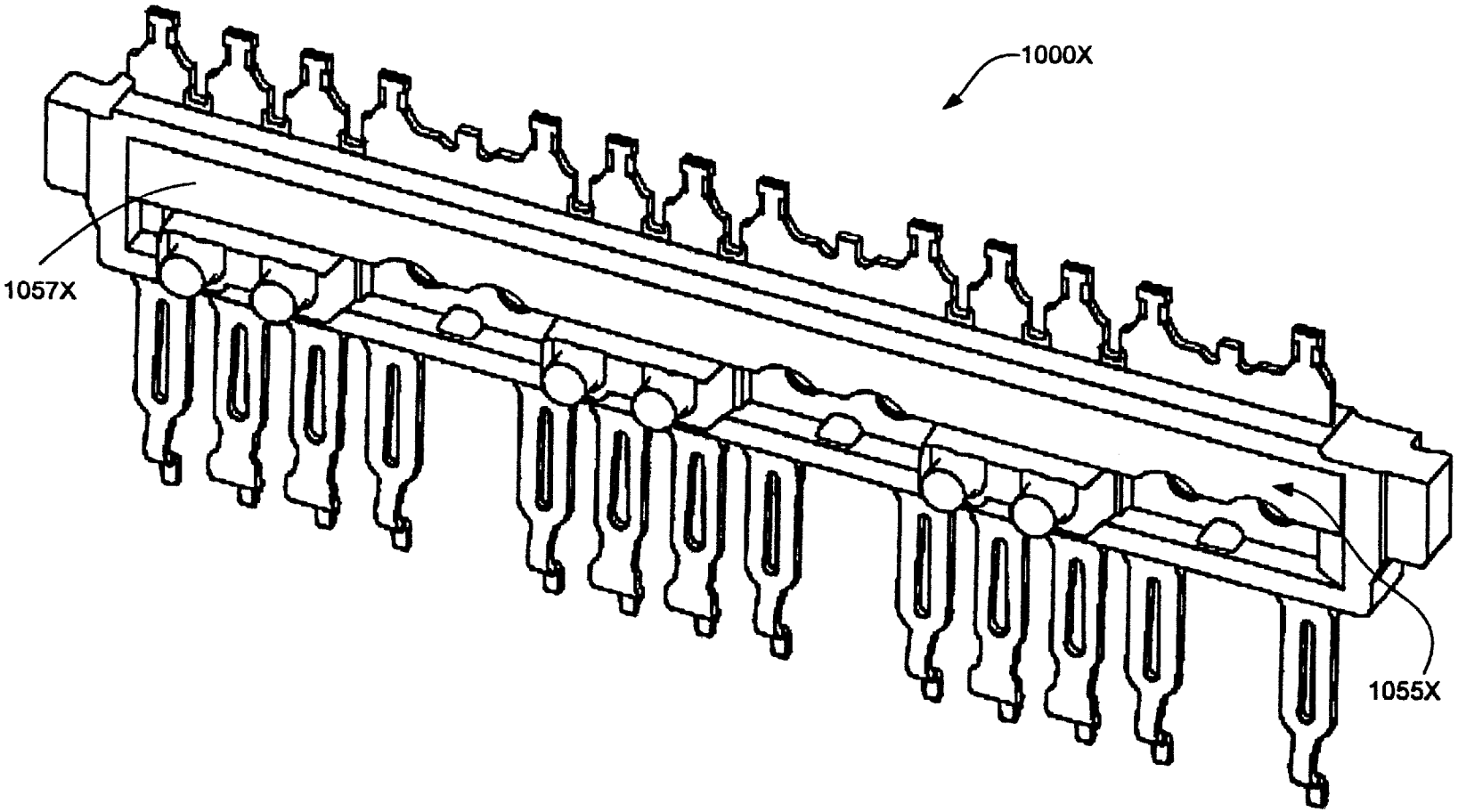
FIG. 10D is another perspective view of the back side of the illustrative wafer half shown in FIG. 10A, with lossy material disposed in a channel, in accordance with some embodiments.

FIG. 10C is a perspective view of the back side of the illustrative wafer half 1000X shown in FIG. 10A, prior to overmolding of lossy material. In this example, a channel 1055X is formed in the insulative portion 1010X on the back side of the wafer half 1000X. Similar to the channel 1050X formed on the front side, the channel 1055X may be configured to be filled with a molten lossy material during an overmolding process. An illustrative result of such an overmolding process is shown in FIG. 10D, which is a perspective view of the back side of the wafer half 1000X shown in FIG. 10A, with lossy material 1057X disposed in the channel 1055X.

Also like the channel 1050X formed on the front side, the channel 1055X in the example of FIG. 10C extends approximately across the entire length of the wafer half 1000X, so that the channel 1055X spans all of the conductive elements enclosed by the insulative portion 1010X. Furthermore, in the example of FIG. 10C, portions of ground conductors, such as the planar intermediate portion 1070X spanning the ground conductors 1020X and 1022X, are exposed at a floor of the channel 1055X, so that the ground conductors 1020X and 1022X will be in electrical contact with the lossy material 1057X disposed in the channel 1055X. By contrast, the signal conductors 1021X and 1023X are insulated from the lossy material 1057X by an insulative portion 1065X.

The inventors have recognized and appreciated that it may be advantageous to mold the lossy material 1052X on the front side of the wafer half 1000X and the lossy material 1057X on the back side of the wafer half 1000X during the same molding process. This may simplify the manufacturing process and reduce costs. Accordingly, one or more features may be provided to allow molten lossy material to flow from one side of the wafer half 1000X to the opposite side. An example of such a feature is an opening 1072X in the planar intermediate portion 1070X that span the ground conductors 1020X and 1022X, as shown in FIG. 10A and FIG. 10C. Such an opening may allow molten lossy material to flow from the channel 1050X on the front side of the wafer half 1000X into the channel 1055X on the back side of the wafer half 1000X, or vice versa.

Figure 10E:
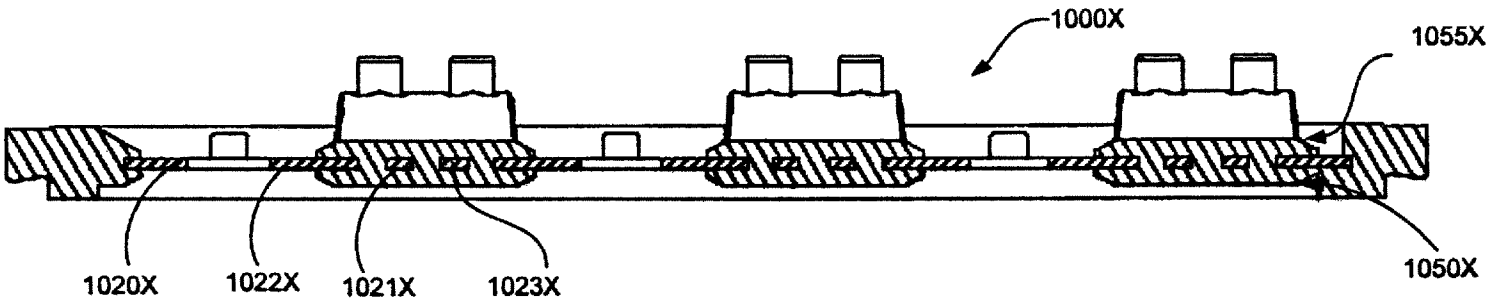
FIG. 10E is a cross-sectional view of the illustrative wafer half shown in FIG. 10A, prior to overmolding of lossy material, in accordance with some embodiments.
Figure 10F:
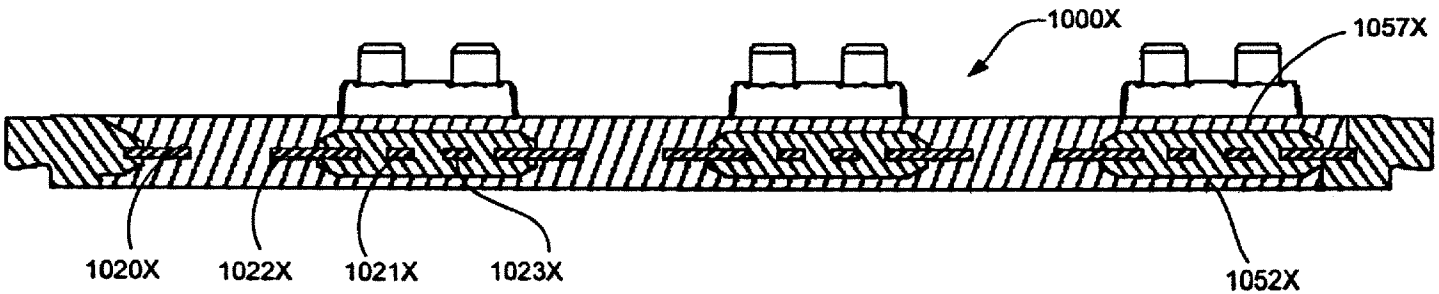
FIG. 10F is another cross-sectional view of the illustrative wafer half shown in FIG. 10A, with lossy material disposed both on the front side and on the backside, in accordance with some embodiments.

FIG. 10E is a cross-sectional view of the illustrative wafer half 1000X shown in FIG. 10A, prior to overmolding of lossy material. FIG. 10F is a cross-sectional view of the illustrative wafer half 1000X shown in FIG. 10A, after the lossy material 1052X has been deposited into the channel 1050X and the lossy material 1057X has been deposited into the channel 1055X.

Figure 10G:
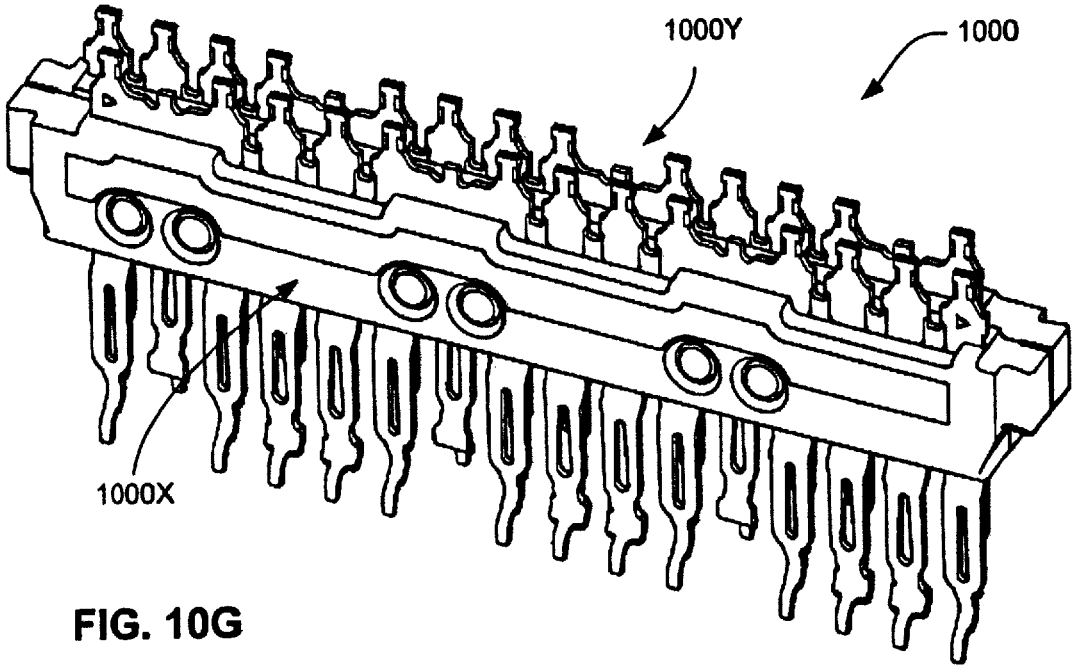
FIG. 10G is a perspective view of an illustrative wafer made of the illustrative wafer half shown in FIG. 10A and a like wafer half, in accordance with some embodiments.
Figure 10H:
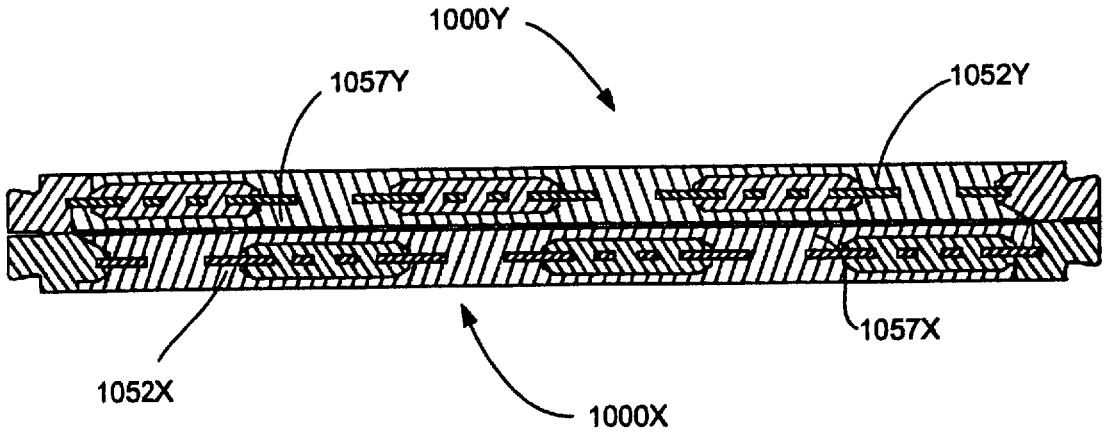
FIG. 10H is a cross-sectional view of the illustrative wafer shown in FIG. 10G.

FIG. 10G is a perspective view of an illustrative wafer 1000 suitable for use in the illustrative connector 100A shown in FIG. 1A. In this example, the wafer 1000 is made of the illustrative wafer half 1000X shown in FIG. 10A and a like wafer half 1000Y. FIG. 10H is a cross-sectional view of the illustrative wafer 1000 shown in FIG. 10G, with the lossy material 1052X deposited on the front side of the wafer half 1000X and the lossy material 1057X deposited on the back side of the wafer half 1000X, and lossy material 1052Y deposited on the front side of the wafer half 1000Y and lossy material 1057Y deposited on the back side of the wafer half 1000Y. The wafer halves 1000X and 1000Y may be held together by any of the attachment mechanisms discussed herein, or any other suitable attachment mechanism. However, it should be appreciated that the wafer 1000 in alternative embodiments may be formed as an integral piece or as a combination of more than two pieces.

FIGS. 11A-F show yet another example of a wafer half 1100X, in accordance with some embodiments of the present disclosure. Like the illustrative wafer halves 600X and 600Y shown in FIGS. 6A-B and the illustrative wafer halves 800X and 800Y shown in FIGS. 8A-B, the wafer half 1100X may be joined with another like wafer half to form a wafer that is suitable for use in a connector such as the connector 100B shown in FIG. 1B. However, unlike the wafer halves 600X and 600Y and the wafer halves 800X and 800Y, which are adapted to receive a lossy member (e.g., the illustrative lossy member 870 shown in FIG. 8A), the wafer half 1100X may include a portion of overmolded lossy material, such as a portion of overmolded conductive plastic, which may provide benefits similar to those provided by a lossy member, such as dampening of resonances that may form in ground conductors. In this regard, the wafer half 1100X may be similar to the illustrative wafer half 1000X shown in FIG. 10A.

FIG. 11A is a perspective view of the front side of the illustrative wafer half 1100X, prior to overmolding of lossy material, in accordance with some embodiments. In this example, the wafer half 1100X includes an insulative portion 1110X at least partially enclosing a plurality of conductive elements disposed generally in parallel to each other (e.g., conductive elements 1120X, 1121X, and 1123X). Each conductive element may have exposed portions not covered by the insulative portion 1110X. Such exposed portions may include contact tails (e.g., contact tails 1130X-1133X) for attachment to a PCB, and pad-shaped mating contact portions (e.g., pads 1040X, 1141X, and 1143X) for mating with beam-shaped mating contact portions of conductive elements in a corresponding connector (e.g., as shown in FIG. 10A and discussed above).

In the example shown in FIG. 11A, some conductive elements in the illustrative wafer half 1100X may be adapted for use as ground conductors, while some other conductive elements in the wafer half 1100X may be adapted for use as signal conductors. For instance, the conductive element 1120X may be adapted for use as a ground conductor, while the conductive elements 1121X and 1123X may be adapted for use as signal conductors.

Figure 11B:
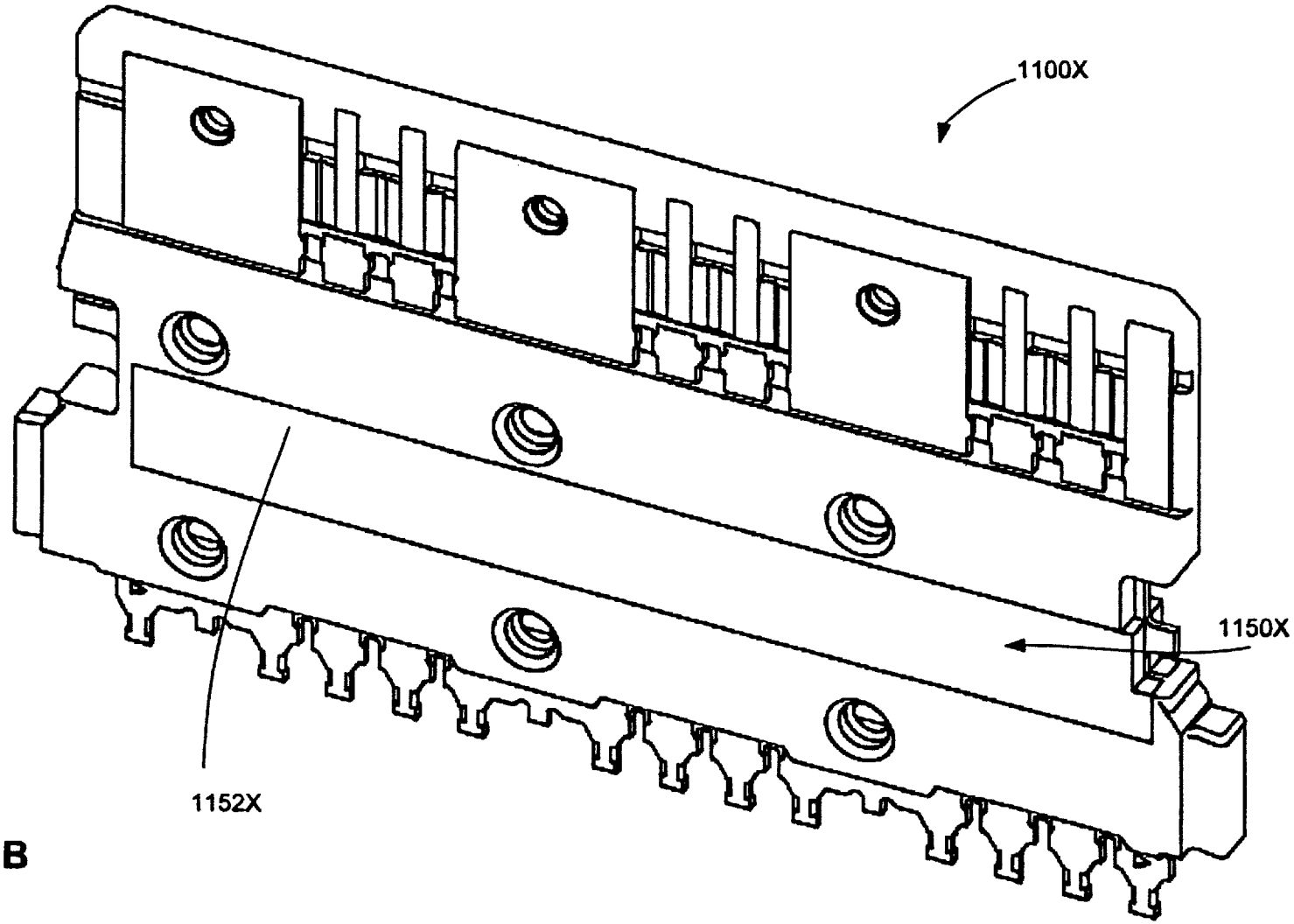
FIG. 11B is another perspective view of the illustrative wafer half shown in FIG. 11A, with lossy material disposed in a channel, in accordance with some embodiments.

In the example shown in FIG. 11A, a channel 1150X is formed in the insulative portion 1110X and is configured to be filled with a molten lossy material during an overmolding process. An illustrative result of such an overmolding process is shown in FIG. 11B, which is a perspective view of the front side of the wafer half 1000X shown in FIG. 11A, with lossy material 1152X disposed in the channel 1150X.

Similar to the channel 1050X shown in FIG. 10A, the channel 1150X may extend across approximately the entire length of the wafer half 1100X, which may provide similar benefits as discussed above. Also similar to the channel 1050X shown in FIG. 10A, the channel 1150X may be configured in such a manner that portions of ground conductors, such as a planar intermediate portion 1170X of the ground conductor 1120X, may be exposed at a floor of the channel 1150X, so that the ground conductor 1120X will be in electrical contact with the lossy material 1152X disposed in the channel 1150X. By contrast, signal conductors may be insulated from the lossy material 1152X. For instance, the signal conductors 1121X and 1123X may be insulated from the lossy material 1152X by an insulative portion 1160X.

Figure 11C:
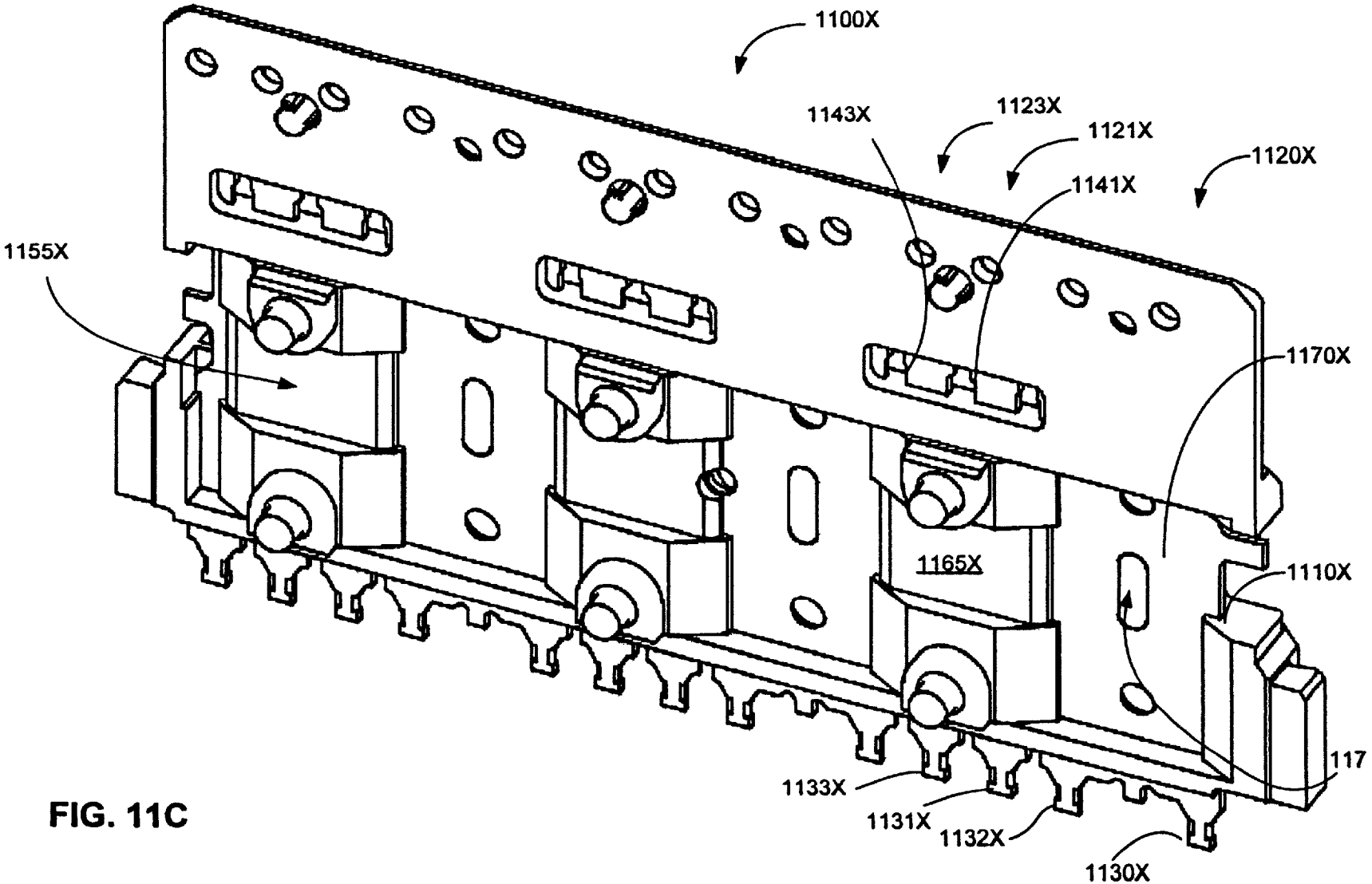
FIG. 11C is a perspective view of a back side of the illustrative wafer half shown in FIG. 11A, prior to overmolding of lossy material, in accordance with some embodiments.
Figure 11D:
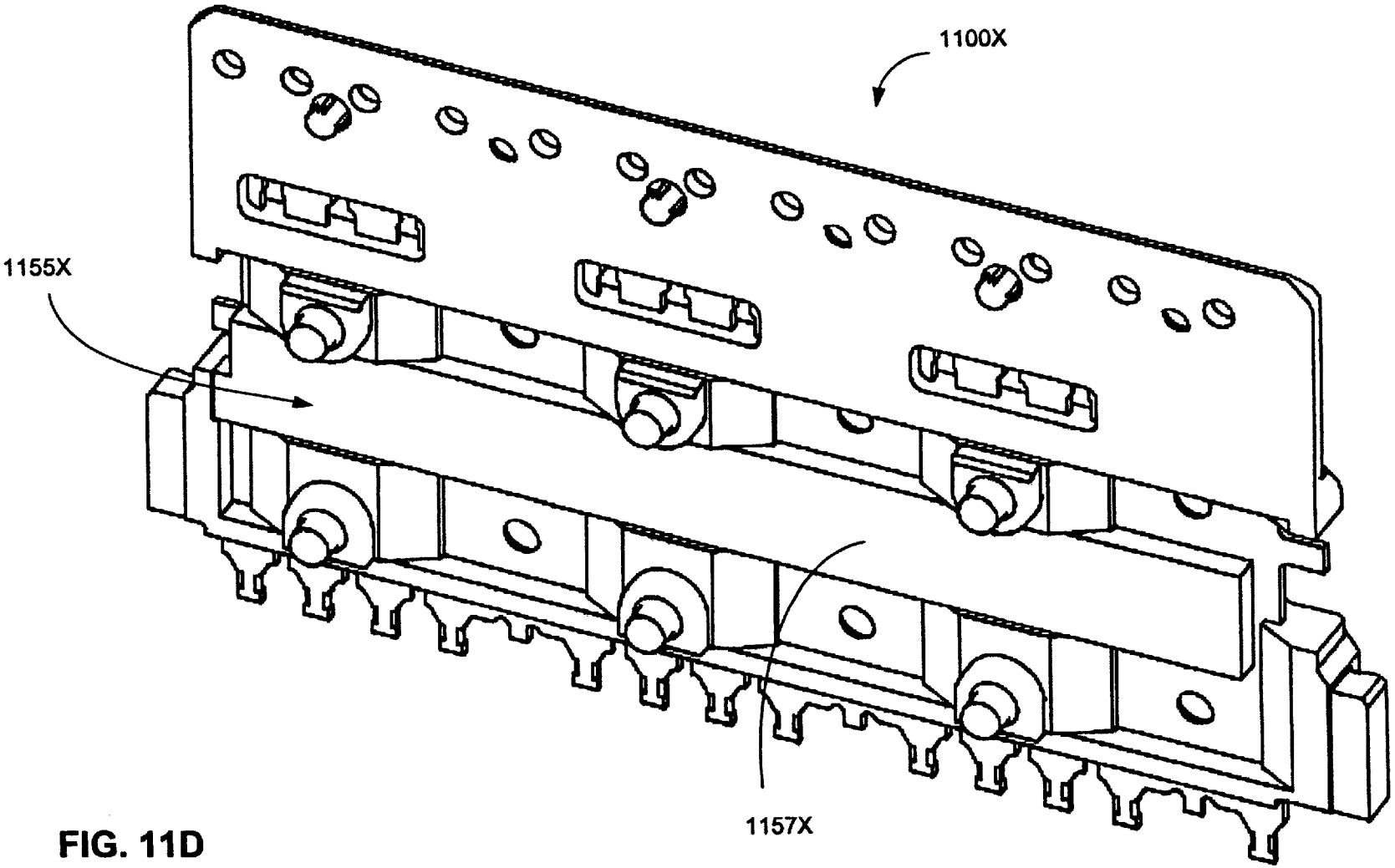
FIG. 11D is another perspective view of the back side of the illustrative wafer half shown in FIG. 11A, with lossy material disposed in a channel, in accordance with some embodiments.

FIG. 11C is a perspective view of the back side of the illustrative wafer half 1100X shown in FIG. 11A, prior to overmolding of lossy material. In this example, a channel 1155X is formed in the insulative portion 1110X on the back side of the wafer half 1100X. Similar to the channel 1150X formed on the front side, the channel 1155X may be configured to be filled with a molten lossy material during an overmolding process. An illustrative result of such an overmolding process is shown in FIG. 11D, which is a perspective view of the back side of the wafer half 1100X shown in FIG. 10A, with lossy material 1157X disposed in the channel 1155X.

Also like the channel 1150X formed on the front side, the channel 1155X in the example of FIG. 11C extends across approximately the entire length of the wafer half 1100X, so that the channel 1155X spans all of the conductive elements enclosed by the insulative portion 1110X. Furthermore, in the example of FIG. 11C, portions of ground conductors, such as the planar intermediate portion 1070X of the ground conductor 1020X, are exposed at a floor of the channel 1155X, so that the ground conductor 1120X will be in electrical contact with the lossy material 1157X disposed in the channel 1155X. By contrast, the signal conductors 1121X and 1123X are insulated from the lossy material 1157X by an insulative portion 1165X.

As with the illustrative wafer half 1000X shown in FIG. 10A, one or more features may be provided to allow molten lossy material to flow from one side of the wafer half 1100X to the opposite side. An example of such a feature is an opening 1172X in the planar intermediate portion 1170X of the ground conductor 1120X, as shown in FIG. 11A and FIG. 11C. Such an opening may allow molten lossy material to flow from the channel 1150X on the front side of the wafer half 1100X into the channel 1155X on the back side of the wafer half 1100X, or vice versa.

Figure 11E:
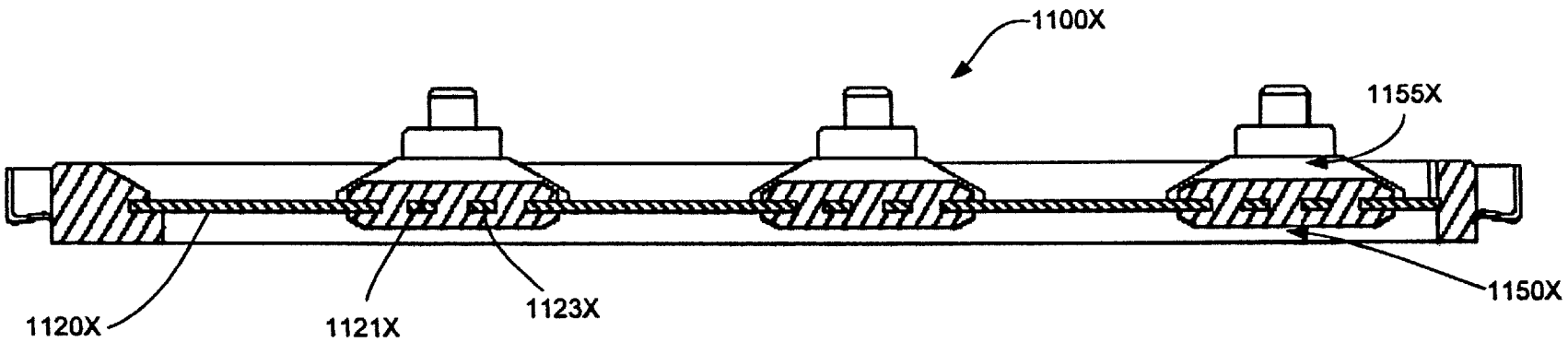
FIG. 11E is a cross-sectional view of the illustrative wafer half shown in FIG. 11A, prior to overmolding of lossy material, in accordance with some embodiments.
Figure 11F:
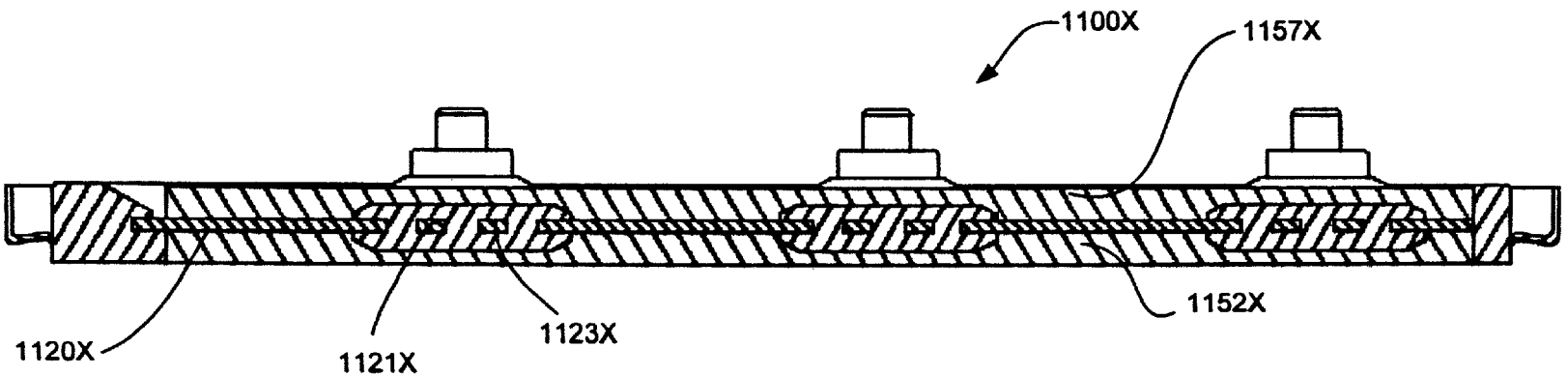
FIG. 11F is another cross-sectional view of the illustrative wafer half shown in FIG. 11A, with lossy material disposed both on the front side and on the backside, in accordance with some embodiments.

FIG. 11E is a cross-sectional view of the illustrative wafer half 1100X shown in FIG. 11A, prior to overmolding of lossy material. FIG. 11F is a cross-sectional view of the illustrative wafer half 1100X shown in FIG. 11A, after the lossy material 1152X has been deposited into the channel 1150X and the lossy material 1157X has been deposited into the channel 1155X.

Figure 11G:
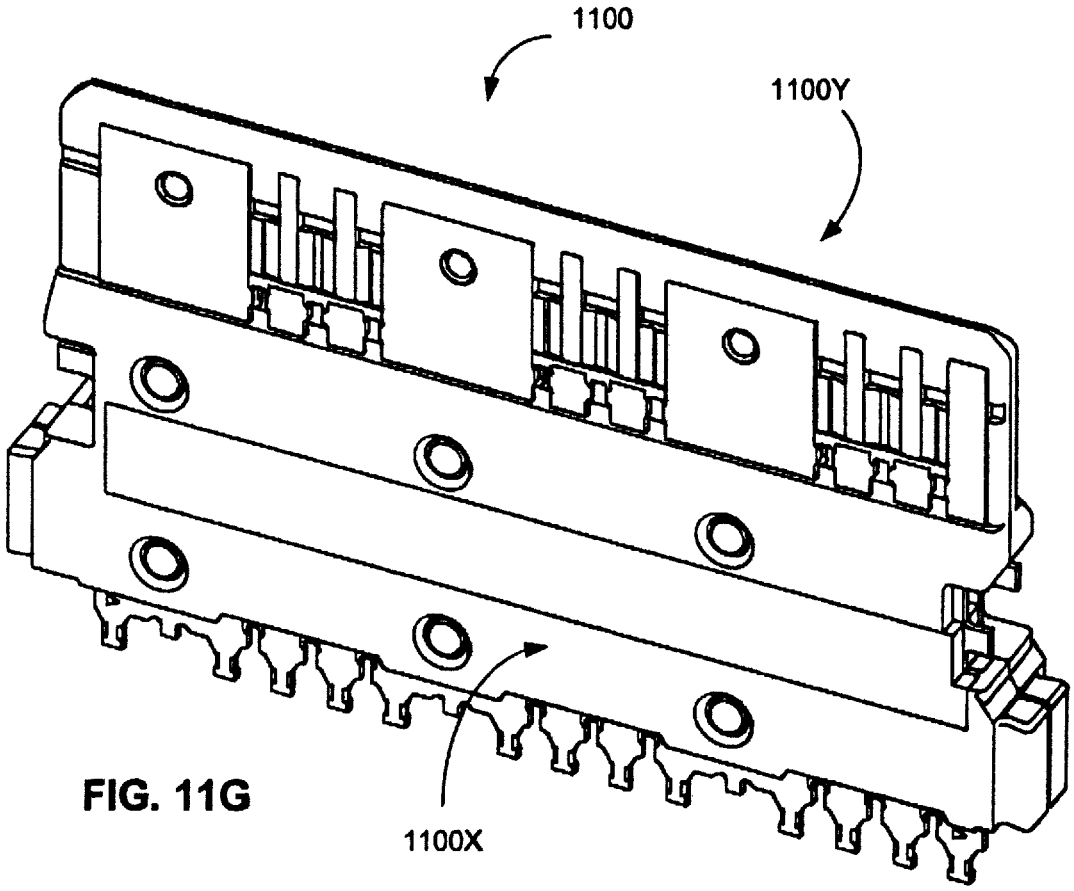
FIG. 11G is a perspective view of an illustrative wafer made of the illustrative wafer half shown in FIG. 11A and a like wafer half, in accordance with some embodiments.
Figure 11H:
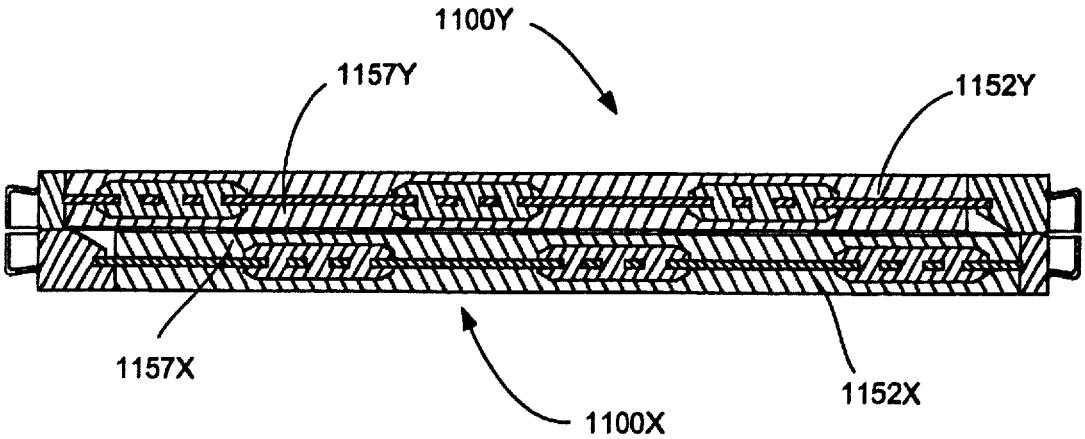
FIG. 11H is a cross-sectional view of the illustrative wafer shown in FIG. 11G.

FIG. 11G is a perspective view of an illustrative wafer 1100 suitable for use in the illustrative connector 100B shown in FIG. 1B. In this example, the wafer 1100 is made of the illustrative wafer half 1100X shown in FIG. 11A and a like wafer half 1100Y. FIG. 11H is a cross-sectional view of the illustrative wafer 1100 shown in FIG. 11G, with the lossy material 1152X deposited on the front side of the wafer half 1100X and the lossy material 1157X deposited on the back side of the wafer half 1100X, and lossy material 1152Y deposited on the front side of the wafer half 1100Y and lossy material 1157Y deposited on the back side of the wafer half 1100Y. The wafer halves 1100X and 1100Y may be held together by any of the attachment mechanisms discussed herein, or any other suitable attachment mechanism. However, it should be appreciated that the wafer 1100 in alternative embodiments may be formed as an integral piece or as a combination of more than two pieces.

As shown in FIGS. 10H and 11H, overmolding lossy material on both sides of a wafer half may result in a wafer having lossy material disposed on the outside (e.g., the lossy material 1052X and 1052Y shown in FIG. 10H and the lossy material 1152X and 1152Y shown in FIG. 11H), in addition to lossy material between two wafer halves (e.g., the lossy material 1057Y and 1057X shown in FIG. 10H and the lossy material 1157Y and 1157X shown in FIG. 11H). By contrast, in the embodiments shown in FIGS. 2C, 6B, and 8A, lossy material (in the form of a lossy insert) is disposed only between two wafer halves.

The inventors have recognized and appreciated that having lossy material disposed on outside surfaces of a wafer may provide additional benefits, such as controlling electromagnetic interference (EMI) to nearby circuit components. For instance, the inventors have recognized and appreciated that lossy material disposed on outside surfaces of a wafer may be effective in controlling EMI at frequencies between 4 GHz and 7 GHz.

While various benefits of overmolding lossy material onto both sides of a wafer half are discussed above, it should be appreciated that aspects of the present disclosure are not limited to the use of this technique. For example, in some embodiments, lossy material may be molded onto only one side of a wafer half. As a result, when two identical wafer halves are assembled, the lossy material may be disposed only on the inside of the resulting wafer, or only on the outside of the resulting wafer. Alternatively, the two identical wafer halves may be assembled in such a way that lossy material molded onto one wafer half is disposed on the inside of the resulting wafer, while lossy material molded onto the other wafer half is disposed on the outside of the resulting wafer. Thus, the resulting wafer may have lossy material disposed on the outside only on one side.

Furthermore, a lossy insert may be included between two wafer halves, regardless of whether lossy material has been molded onto the wafer halves. Further still, lossy material may be molded onto wafers of one connector but not wafers of a corresponding connector. For example, lossy material may be molded on a connector with pad-shaped mating contact portions, but not a corresponding connector with beam-shaped mating contact portions, or vice versa. Further still, in addition to, or instead of, overmolding lossy material onto wafer halves, lossy material may be disposed on the outside of a wafer using one or more lossy inserts that are attached to the wafer in any suitable manner, Various inventive concepts disclosed herein are not limited in their applications to the details of construction and the arrangements of components set forth in the following description or illustrated in the drawings. The inventive concepts are capable of other embodiments and of being practiced or of being carried out in various ways. Also, the phraseology and terminology used herein is for the purpose of description and should not be regarded as limiting. The use of "including," "comprising," "having," "containing," or "involving," and variations thereof herein, is meant to encompass the items listed thereafter and equivalents thereof as well as additional items.

Having thus described several aspects of at least one embodiment of the present disclosure, it is to be appreciated various alterations, modifications, and improvements will readily occur to those skilled in the art.

As an example, a connector designed to carry differential signals was used to illustrate inventive concepts. Some or all of the techniques described herein may be applied to signal conductors that carry single-ended signals.

Further, although many inventive aspects are shown and described with reference to a mezzanine connector, it should be appreciated that the present invention is not limited in this regard, as the inventive concepts may be included in other types of electrical connectors, such as backplane connectors, cable connectors, stacking connectors, power connectors, flexible circuit connectors, right angle connectors, or chip sockets.

Also, though it is described that wafers are rigidly attached to their respective shells, in some embodiments, the attachment may not be rigid or may not be rigid in all directions. For example, the channels in the walls of the shell into which the wafers are inserted may be sealed to retain the wafers. However, the wafers may be allowed to slide along the channels so that all of the wafers may align relative to the surface of a printed circuit board to which the connector is attached.

As a further example, connectors with three differential signal pairs in a column were used to illustrate the inventive concepts. However, the connectors with any desired number of signal conductors may be used.

Further, embodiments where illustrated in which contact tails are shaped to receive solder balls such that a connector may be mounted to a printed surface board using known surface mount assembly techniques. Other connector attachment mechanisms may be used and contact tails of connectors may be shaped to facilitate use of alternative attachment mechanisms. For example, to support surface mount techniques in which component leads are placed on solder paste deposited on the surface of a printed circuit board, the contact tails may be shaped as pads. As a further alternative, the contact tails may be shaped as posts that engage holes on the surface of the printed circuit board. As yet a further example, connectors may be mounted using press fit attachment techniques. To support such attachment, the contact tails may be shaped as eye of the needle contacts or otherwise contain compliant sections that can be compressed upon insertion into a hole on a surface of a printed circuit board.

Also, though embodiments of connectors assembled from wafer subassemblies are described above, in other embodiments connectors may be assembled from wafers without first forming subassemblies. As an example of another variation, connectors may be assembled without using separable wafers by inserting multiple columns of conductive members into a housing.

In the embodiments illustrated, some conductive elements are designated as forming a differential pair of conductors and some conductive elements are designated as ground conductors. These designations refer to the intended use of the conductive elements in an interconnection system as they would be understood by one of skill in the art. For example, though other uses of the conductive elements may be possible, differential pairs may be identified based on preferential coupling between the conductive elements that make up the pair. Electrical characteristics of the pair, such as its impedance, that make it suitable for carrying a differential signal may provide an alternative or additional method of identifying a differential pair. For example, a pair of signal conductors may have an impedance of between 75 Ohms and 100 Ohms. As a specific example, a signal pair may have an impedance of 85 Ohms +/−10%. As another example of differences between signal and ground conductors, in a connector with differential pairs, ground conductors may be identified by their positioning relative to the differential pairs. In other instances, ground conductors may be identified by their shape or electrical characteristics. For example, ground conductors may be relatively wide to provide low inductance, which is desirable for providing a stable reference potential, but provides an impedance that is undesirable for carrying a high speed signal.

Further, though designated a ground conductor, it is not a requirement that all, or even any, of the ground conductors be connected to earth ground. In some embodiments, the conductive elements designated as ground conductors may be used to carry power signals or low frequency signals. For example, in an electronic system, the ground conductors may be used to carry control signals that switch at a relatively low frequency. In such an embodiment, it may be desirable for the lossy member not to make direct electrical connection with those ground conductors. The ground conductors, for example, may be covered by the insulative portion of a wafer adjacent the lossy member.

Such alterations, modifications, and improvements are intended to be part of this disclosure, and are intended to be within the spirit and scope of the invention. Accordingly, the foregoing description and drawings are by way of example only.

The invention claimed is:

1. A connector, comprising:

an insulative portion and a plurality of conductive elements, each of the plurality of conductive elements comprising a beam extending from the insulative portion, the beams being disposed in a plurality of columns, each column comprising a first beam and a second beam, wherein:

the first beam is associated with a first conductive element configured as a ground conductor;

the first beam comprises a first contact region near a distal end of the first beam, the first contact region having a first width;

the second beam is associated with a second conductive element configured as a signal conductor;

the second beam comprises a second contact region near a distal end of the second beam, the second contact region having a second width larger than the first width;

the connector is a first connector, the insulative portion is a first insulative portion, and the plurality of conductive elements is a first plurality of conductive elements;

the first connector is in combination with a second connector adapted to mate with the first connector, the second connector comprising a second insulative portion and a second plurality of conductive elements, each of the second plurality of conductive elements comprising a pad extending from the second insulative portion, the pads being disposed in a plurality of columns, each column comprising a first pad and a second pad;

the first pad is associated with a third conductive element configured as a ground conductor;

the first pad comprises a third contact region adapted to make electrical contact with the first contact region of the first beam, the third contact region having a third width;

the second pad is associated with a fourth conductive element configured as a signal conductor; and the second pad comprises a fourth contact region adapted to make electrical contact with the second contact region of the second beam, the fourth contact region having a fourth width smaller than the third width;

the first connector further comprises a third beam, the third, first, and second beams being arranged in a sequence; and the third width of the third contact region of the first pad is wider than a distance between the third and first beams, so that the third contact region is capable of making electrical connection with the third and first beams simultaneously.

2. The connector of claim 1, wherein, for each column, a first distance in a first direction along the column between a first center line of the first beam and a first edge of the first pad matches a second distance in a second direction along the column, between a second centerline of the second pad and a second edge of second beam.

3. The electrical interconnection system of claim 1, wherein:

the first and second beams are adjacent;

the connector further comprises third and fourth beams, the first, second, third, and fourth beams being arranged in a sequence;

the third beam is associated with a third conductive element configured as a signal conductor;

the third beam comprises a third contact region near a distal end of the third beam, the third contact region having the second width;

the fourth beam is associated with a fourth conductive element configured as a ground conductor; and the fourth beam comprises a fourth contact region near a distal end of the fourth beam, the fourth contact region having the first width.

4. The electrical interconnection system of claim 1, wherein:

each of the plurality of conductive elements further comprises an attachment end; and the connector further comprises a plurality of solder balls, each solder ball of the plurality of solder balls being attached to an attachment end of a respective conductive element of the plurality of conductive elements.

5. The electrical interconnection system of claim 4, wherein:

the attachment end of each of the plurality of conductive elements narrows at a tip to form a narrowed region, and the respective solder ball is attached to the narrowed region.

6. The connector of claim 1, wherein:

the second beam further comprises:

a tab portion at the distal end, the tab portion being adjacent to the second contact region, the tab portion having a tab width smaller than the second width; and a neck portion adjacent to the second contact region, the neck portion being opposite from the tab portion, the neck portion having a neck width smaller than the second width.

7. The connector of claim 6, wherein:

a distance between the tab portion and the neck portion is between 0.2 mm and 1 mm.

8. The connector of claim 6, wherein:

a ratio between the second width and the neck width is between 2:1 and 2.5:1.

9. A wafer for an electrical connector, the wafer comprising:

an insulative portion; and a plurality of conductive elements held by the insulative portion, each of the conductive elements comprising a beam-shaped contact portion, the contact portions of the plurality of conductive elements being disposed in a column, and each contact portion comprising an opening in the beam-shaped contact portion, the opening having a closed perimeter and being configured to control at least one mechanical property of the beam-shaped contact portion while providing a selected edge to edge spacing between adjacent beam-shaped contact portions, wherein:

the opening has a width that is larger towards a distal end of the beam-shaped contact portion than a proximal end of the beam-shaped contact portion so as to reduce an amount of material towards the distal end to thereby reduce stiffness of the beam-shaped contact portion and provide a selected distribution of spring force along a length of the beam-shaped contact portion when the beam-shaped contact portion is deflected, wherein the width of the opening is along a direction that is perpendicular to an inserting direction of a plurality of corresponding mating contact portions of a mating connector.

10. The wafer of claim 9, wherein:

the plurality of conductive elements comprises a plurality of pairs of conductive elements, and for each pair of conductive elements a first contact portion and a second contact portion have an edge to edge spacing, the edge to edge spacing being uniform over a region of each of the first contact portion and the second contact portion; and the opening in the first contact portion and the second contact portion is disposed in the region.

11. The wafer of claim 9, wherein:

each of the plurality of conductive elements has a uniform width over a region of the beam-shaped contact portion; and the opening in each of the plurality of conductive elements is disposed in the region.

12. The wafer of claim 9, wherein:

for each of the plurality of conductive elements, the opening is teardrop shaped.

13. The wafer of claim 9, wherein:

for each of the plurality of conductive elements, the beam-shaped contact portion extends from the insulative portion.

14. The wafer of claim 9, wherein:

the opening in each contact portion is shaped to distribute force uniformly along the length of the contact portion when the beam-shaped contact portion is deflected.

15. An electrical connector comprising:

an insulative portion; and a plurality of conductive elements, each of the conductive elements comprising a beam extending from the insulative portion, the beams being disposed in a plurality of columns, each column comprising a pair of adjacent beams, the beams of the pair each comprising an opening, each opening being wider near a distal end of a respective beam and narrower near a proximal end of the respective beam, wherein the distal end of the respective beam comprises a single contact region and each opening is configured to control at least one mechanical property of the respective beam while providing a selected edge to edge spacing between the adjacent beams, wherein:

each opening has a width that is larger towards a distal end of the respective beam than a proximal end of the respective beam so as to reduce an amount of material towards the distal end to thereby reduce stiffness of the respective beam and provide a selected distribution of spring force along a length of the respective beam when the respective beam is deflected, wherein the width of the opening is along a direction that is wherein the width of the opening is along a direction that is perpendicular to an inserting direction of a plurality of corresponding mating contact portions of a mating connector.

16. The electrical connector of claim 15, wherein, for each pair of adjacent beams in each of the plurality of columns, an edge to edge spacing between the adjacent beams is uniform over a region enclosing the openings in the adjacent beams.

17. The electrical connector of claim 15, wherein:

for each pair in each of the plurality of columns, the beams and the openings of the pair are configured to provide uniform impedance and to distribute force uniformly along the beams upon deflection of the beams.

18. The electrical connector of claim 15, wherein:

each column of the plurality of conductive elements further comprises a third beam adjacent to the pair of adjacent beams; the openings of the pair of adjacent beams have a first shape; and the third beam has a third opening of a second shape different from the first shape.

19. The electrical connector of claim 18, wherein the third opening has a uniform width along at least a portion of the third beam.

20. The electrical connector of claim 15, wherein the beams each have a unitary structure.

21. An electronic assembly comprising:

a printed circuit board (PCB); and a connector coupled to the PCB, the connector comprising an insulative shell and first and second wafers inserted into the insulative shell, wherein:

the first wafer comprises at least one first mating contact portion and at least one first contact tail, the at least one first contact tail being electrically coupled to at least one first conductive element in the PCB;

the second wafer comprises at least one second mating contact portion and at least one second contact tail, the at least one second contact tail being electrically coupled to at least one second conductive element in the PCB;

the first wafer is inserted into a first channel formed on an interior side wall of the insulative shell;

the second wafer is inserted into a second channel formed on the interior side wall of the insulative shell, the second channel being parallel to the first channel;

the insulative shell comprises first and second cover portions, the first cover portion mechanically engaging the at least one first mating contact portion of the first wafer, the second cover portion mechanically engaging the at least one second mating contact portion of the second wafer;

the connector further comprises a support member inserted into a third channel formed on the interior side wall of the insulative shell between the first and second channels, the support member comprises at least one first support feature mechanically engaging the first cover portion to offset forces generated by the at least one first mating contact portion of the first wafer, the first support feature being electrically isolated from the PCB; and the support member further comprises at least one second support feature mechanically engaging the second cover portion to offset forces generated by the at least one second mating contact portion of the second wafer.

22. The electronic assembly of claim 21, wherein the first and second cover portions are integral to the insulative shell.

23. The electronic assembly of claim 21, wherein the insulative shell comprises a cover component, and wherein the cover component comprises the first and second cover portions.

24. The electronic assembly of claim 21, wherein the first cover portion comprises first and second recesses, and wherein the at least one first mating contact portion of the first wafer is inserted into the first recess and the at least one first support feature of the support member is inserted into the second recess.

25. The electronic assembly of claim 21, wherein the support member comprises a planar insulative portion, and wherein the at least one first support feature and the at least one second support feature extend from the planar insulative portion.

26. The electronic assembly of claim 25, wherein the at least one first support feature and the at least one second support feature comprise compliant conductive material.

27. A connector comprising:

an insulative shell; and first and second wafers inserted into the insulative shell, wherein:

the first wafer comprises a first plurality of conductive elements partially enclosed by a first insulative portion of the first wafer;

the second wafer comprises a second plurality of conductive elements partially enclosed by a second insulative portion of the second wafer;

the first wafer is inserted into a first channel formed on an interior side wall of the insulative shell;

the second wafer is inserted into a second channel formed on the interior side wall of the insulative shell, the second channel being parallel to the first channel;

the insulative shell comprises first and second cover portions, the first cover portion mechanically engaging mating contact portions of the first plurality of conductive elements of the first wafer, the second cover portion mechanically engaging mating contact portions of the second plurality of conductive elements of the second wafer;

the connector further comprises a support member inserted into a third channel formed on the interior side wall of the insulative shell between the first and second channels;

the support member comprises at least one first support feature mechanically engaging the first cover portion to offset forces generated by the mating contact portions of the first plurality of conductive elements of the first wafer; and the support member further comprising at least one second support feature mechanically engaging the second cover portion to offset forces generated by the mating contact portions of the second plurality of conductive elements of the second wafer.

28. The connector of claim 27, wherein the first and second cover portions are integral to the insulative shell.

29. The connector of claim 27, wherein the insulative shell comprises a cover component, and wherein the cover component comprises the first and second cover portions.

30. The connector of claim 27, wherein the first cover portion comprises first and second recesses, and wherein the mating contact portions of the first plurality of conductive elements of the first wafer are inserted into the first recess and the at least one first support feature of the support member is inserted into the second recess.

31. The connector of claim 27, wherein the support member is a unitary member.

32. The connector of claim 27, wherein the support member comprises a planar insulative portion, and wherein the at least one first support feature and the at least one second support feature extend from the planar insulative portion.

33. The connector of claim 32, wherein the at least one first support feature and the at least one second support feature comprise compliant conductive material.

34. The connector of claim 27, wherein the first plurality of conductive elements of the first wafer are adapted to carry power.

35. The connector of claim 34, wherein the first plurality of conductive elements of the first wafer are adapted to carry power at a voltage higher than 38V.

36. The connector of claim 34, wherein each of the first plurality of conductive elements of the first wafer is adapted to carry a current of about 1 A to 2 A.

* * * * *

UNITED STATES PATENT AND TRADEMARK OFFICE

CERTIFICATE OF CORRECTION

PATENT NO. : 8,491,313 B2
APPLICATION NO. : 13/365197
DATED : July 23, 2013
INVENTOR(S) : David M. McNamara et al.

It is certified that error appears in the above-identified patent and that said Letters Patent is hereby corrected as shown below:

In the Claims:

Claim 15, column 40, line 36, please delete the second occurrence of the words "wherein the width of the opening is along a direction that is".

Signed and Sealed this
First Day of October, 2013

Teresa Stanek Rea
*Deputy Director of the United States Patent and Trademark Office*